US005882814A

United States Patent [19]

Fuller et al.

[11] Patent Number: 5,882,814

[45] Date of Patent: Mar. 16, 1999

[54] IMAGING MEMBERS CONTAINING HIGH PERFORMANCE CHARGE TRANSPORTING POLYMERS

[75] Inventors: Timothy J. Fuller, Pittsford; Leon A. Teuscher, Williamsville; Damodar M. Pai, Fairport; John F. Yanus, Webster, all of N.Y.

[73] Assignee: Xerox Corporation, Stamford, Conn.

[21] Appl. No.: 976,238

[22] Filed: Nov. 21, 1997

[51] Int. Cl.[6] ..... G03G 5/047

[52] U.S. Cl. ..... 430/59; 430/96

[58] Field of Search ..... 430/58, 59, 96

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,818,650 | 4/1989 | Limburg et al. | 430/56 |
| 4,935,487 | 6/1990 | Yanus et al. | 528/203 |
| 4,956,440 | 9/1990 | Limburg et al. | 528/99 |
| 5,030,532 | 7/1991 | Limburg et al. | 430/56 |
| 5,336,577 | 8/1994 | Spiewak et al. | 430/59 |
| 5,728,498 | 3/1998 | Yanus et al. | 430/59 |

FOREIGN PATENT DOCUMENTS 63-247757-A2 11/1988 Japan .

*Primary Examiner*—John Goodrow
*Attorney, Agent, or Firm*—Judith L. Byorick

[57] ABSTRACT

Disclosed is an imaging member which comprises a conductive substrate, a photogenerating layer, and a charge transport layer comprising a polymer of the formulae I, II, III, IV, V, VI, VII, VIII, IX, or X as further defined herein.

13 Claims, 2 Drawing Sheets

IMAGING MEMBERS CONTAINING HIGH PERFORMANCE CHARGE TRANSPORTING POLYMERS

BACKGROUND OF THE INVENTION

The present invention is directed to improved photosensitive imaging members. More specifically, the present invention is directed to photosensitive imaging members containing improved charge transport layers. One embodiment of the present invention is directed to an imaging member which comprises a conductive substrate, a photogenerating material, and a polymer of the formula

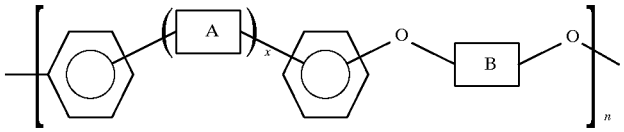

I

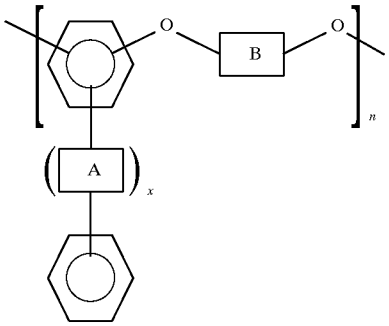

II

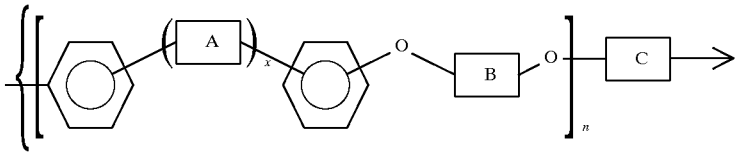

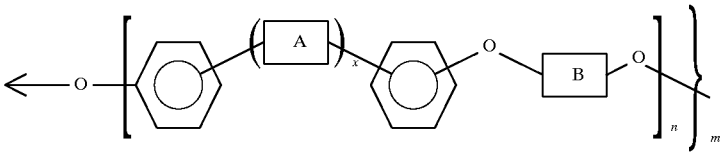

III

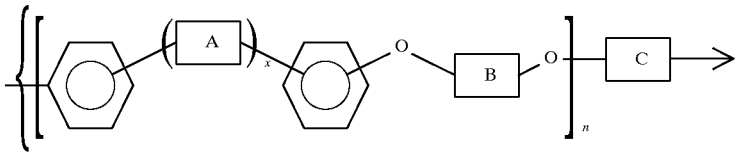

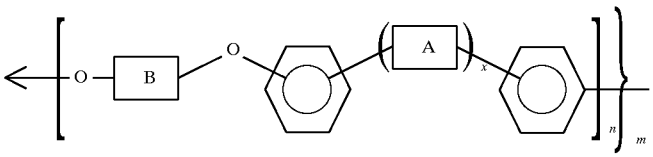

IV

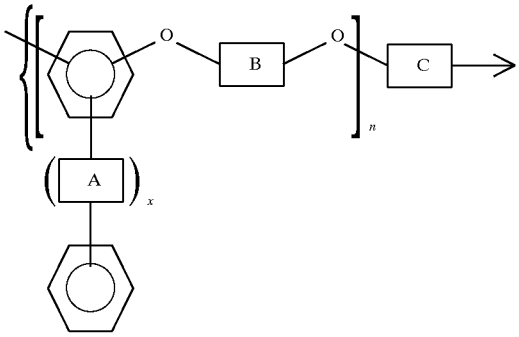

V

-continued
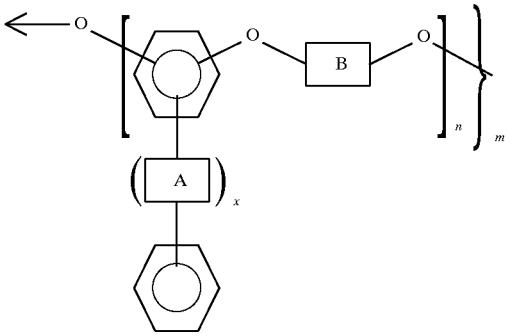
VI
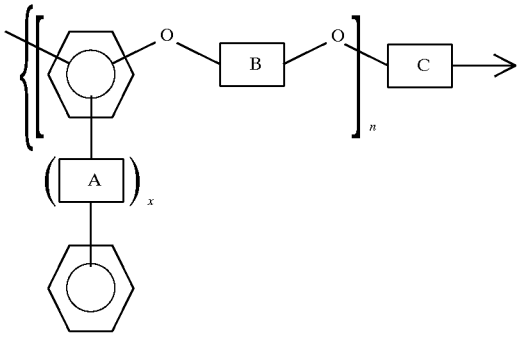
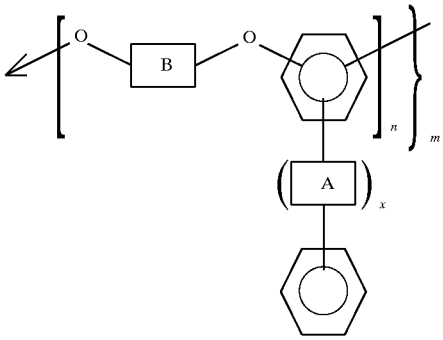
VII
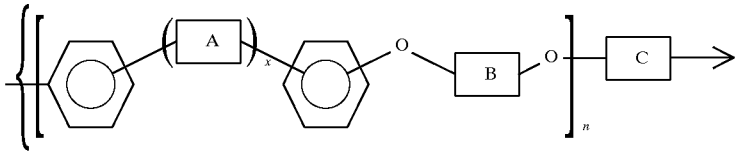
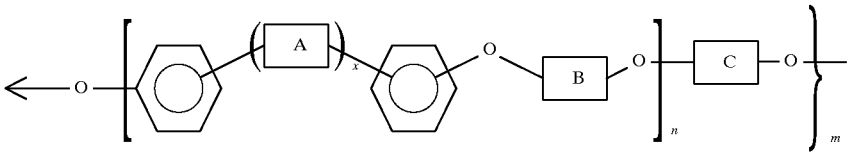
VIII
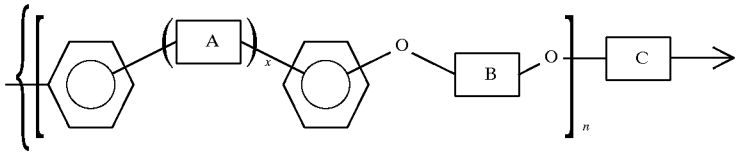
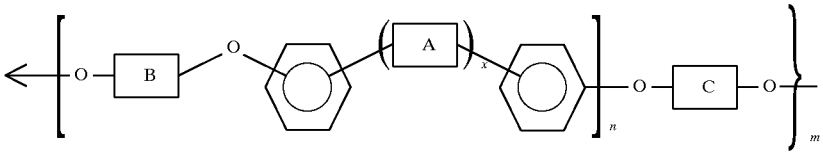

-continued
IX
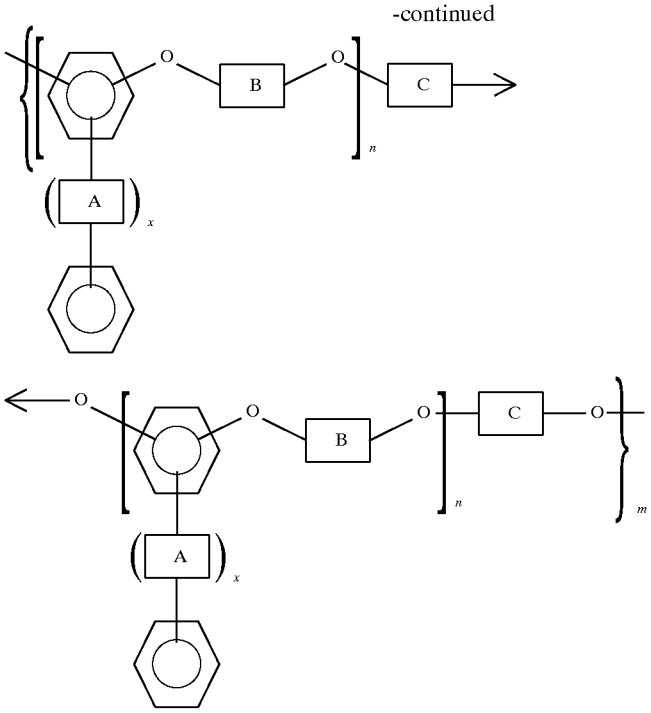
or
X
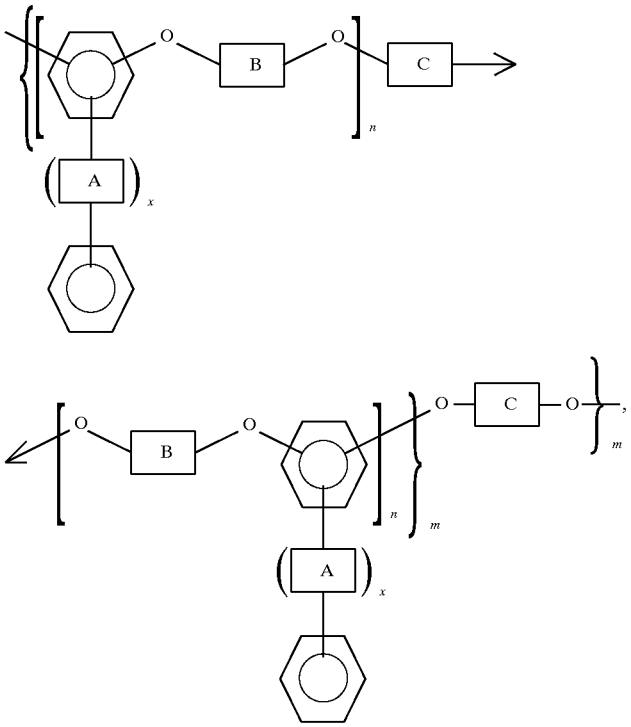
wherein x is an integer of 0 or 1, A is
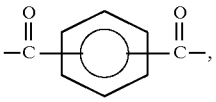
-continued
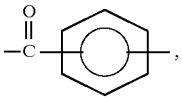

-continued
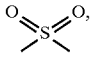
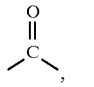
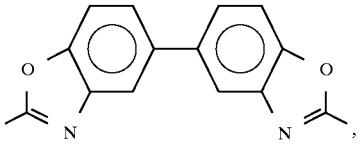
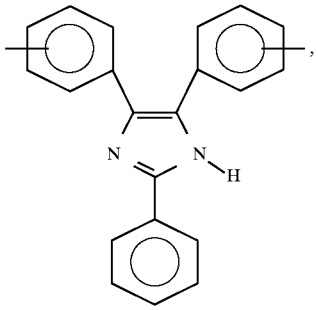
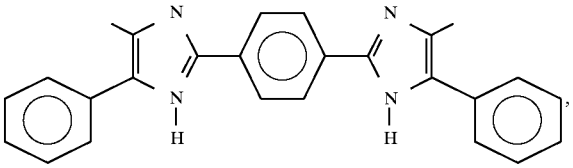
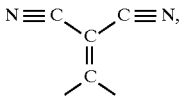
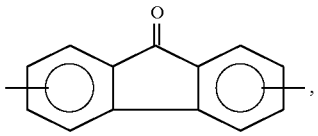
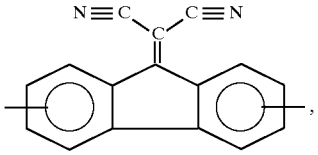
or mixtures thereof, B is
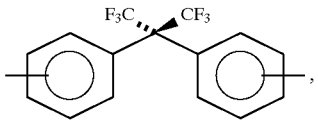
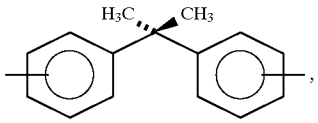
-continued
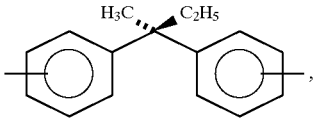
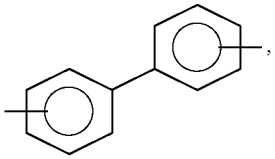
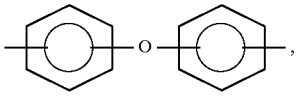
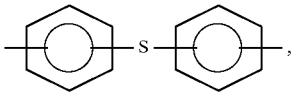
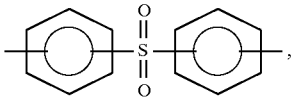
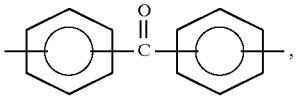
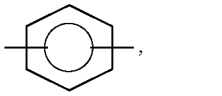
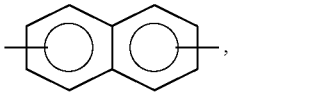
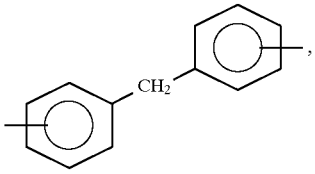
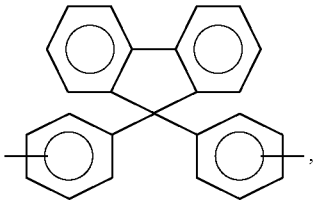
$-(CH_2)_v-$,
wherein v is an integer of from 1 to about 20,
$-(CH_2O)_i-$ wherein t is an integer of from 1 to about 20,
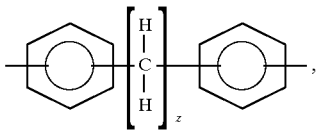
wherein z is an integer of from 2 to about 20,
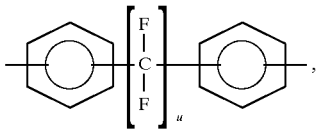
wherein u is an integer of from 1 to about 20,
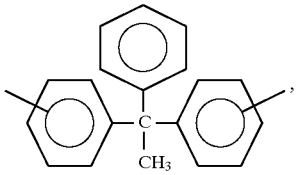
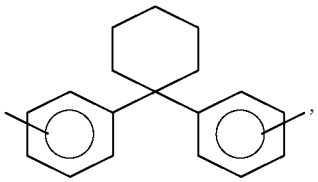
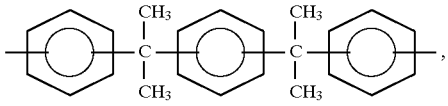
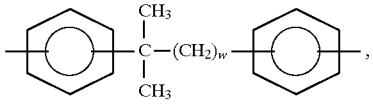
wherein w is an integer of from 1 to about 20,
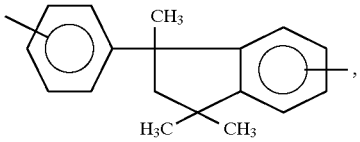
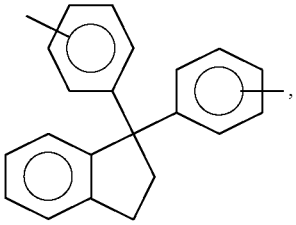
-continued
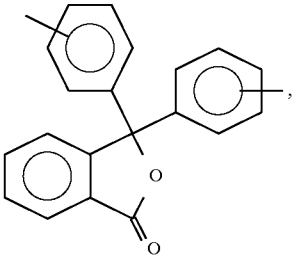
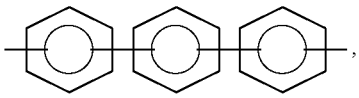
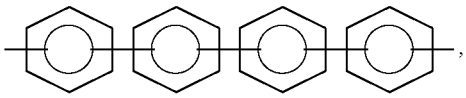
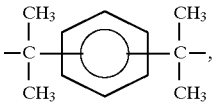
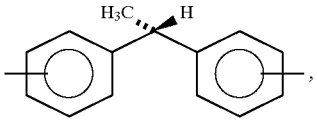
or
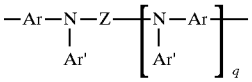
wherein (1) Z is
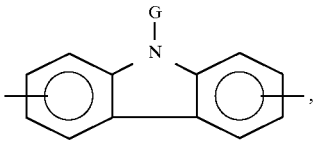
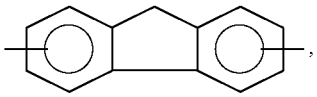
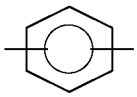
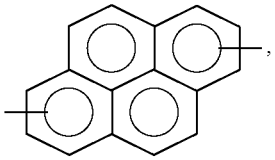
or
$-Ar-(X)_p-Ar-$ wherein p is 0 or 1; (2) Ar is

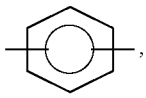

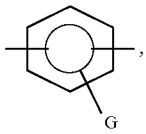

or

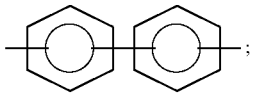

(3) G is an alkyl group selected from alkyl or isoalkyl groups containing from about 2 to about 10 carbon atoms; (4) Ar' is

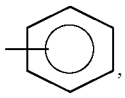

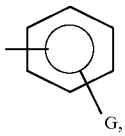

or

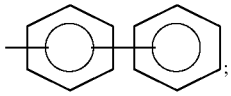

(5) X is

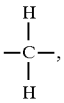

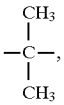

$-O-$, $-S-$,

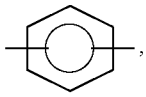

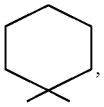

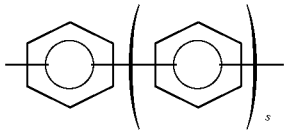

wherein s is 0, 1, or 2,

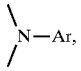

or

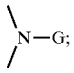

and (6) q is 0 or 1; or mixtures thereof, wherein at least some of the "B" groups are of the formula

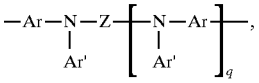

C is

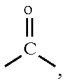

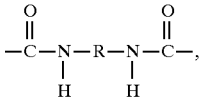

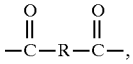

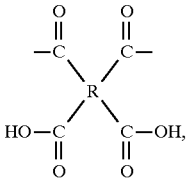

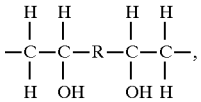

or mixtures thereof, wherein R is an alkyl group, an aryl group, an arylalkyl group, or mixtures thereof, and m and n are integers representing the number of repeating units.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive imaging member, exposing the imaging member to a light and shadow image to dissipate the charge on the areas of the imaging member exposed to the light, and developing the resulting electrostatic latent image by depositing on the image a finely divided electroscopic material known as toner. In the Charge Area Development (CAD) scheme, the toner will normally be attracted to those areas of the imaging member which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Imaging members for electrophotographic imaging systems comprising selenium alloys vacuum deposited on substrates are known. Imaging members have also been prepared by coating substrates with photoconductive particles dispersed in an organic film forming binder. Coating of rigid drum substrates has been effected by various techniques such as spraying, dip coating, vacuum evaporation, and the like. Flexible imaging members can also be manufactured by processes that entail coating a flexible substrate with the desired photoconducting material.

Some photoresponsive imaging members consist of a homogeneous layer of a single material such as vitreous selenium, and others comprise composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder. Imaging members prepared according to the teachings of this patent contain a binder layer with particles of zinc oxide uniformly dispersed therein coated on a paper backing. The binders disclosed in this patent include materials such as polycarbonate resins, polyester resins, polyamide resins, and the like.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin, are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein.

In addition, U.S. Pat. No. 3,041,167 discloses an overcoated imaging member containing a conductive substrate, a photoconductive layer, and an overcoating layer of an electrically insulating polymeric material. This member can be employed in electrophotographic imaging processes by initially charging the member with an electrostatic charge of a first polarity, followed by exposing it to form an electrostatic latent image that can subsequently be developed to form a visible image.

Japanese Patent Publication 63-247757 A2, the disclosure of which is totally incorporated herein by reference, discloses an electrophotographic photosensitive body consisting of a body in which a photoconductive layer laminated on a conductive support contains a charge generating substance and/or a charge transporting substance, and at least one polyether ketone polymer consisting of structural units which can be expressed by the following general formulae (I) and (II)

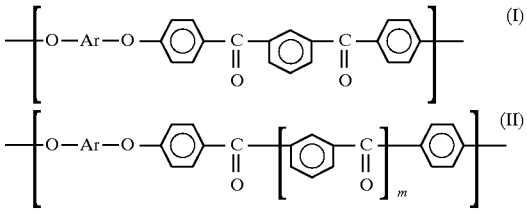

(I)

(II)

wherein m is 0 or 1 and Ar indicates

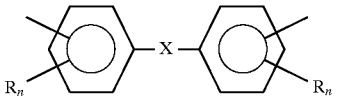

wherein R is an alkyl group, n is 0, 1, or 2, and X indicates

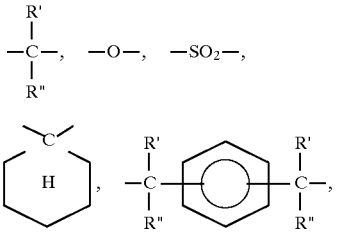

with R' and R" each independently indicating —H, —$CH_3$, —$C_2H_5$,

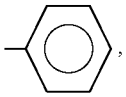

wherein the proportion of structural units in the polymer expressed by the general formula (I) is from 0.1 to 1.0 and the proportion of structural units in the polymer expressed by the general formula (II) is 0 to 0.9.

U.S. Pat. No. 5,336,577 (Spiewak et al.), the disclosure of which is totally incorporated herein by reference, discloses a thick organic ambipolar layer on a photoresponsive device which is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

U.S. Pat. No. 4,801,517 (Frechet et al.), the disclosure of which is totally incorporated herein by reference, discloses an electrostatographic imaging member and an electrophotographic imaging process for using the imaging member in which the imaging member comprises a substrate and at least one electroconductive layer, the imaging member comprising a polymeric arylamine compound represented by the formula

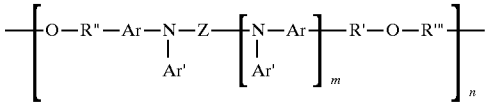

wherein n is between about 5 and 5,000, m is 0 or 1, Z is selected from certain specified aromatic and fused ring groups, Ar is selected from certain specified aromatic groups, R is selected from certain specified alkyl groups, Ar' is selected from certain specified aromatic groups, and R' and R" are independently selected from certain specified alkylene groups.

U.S. Pat. No. 4,806,443 (Yanus et al.), the disclosure of which is totally incorporated herein by reference, discloses an electrostatographic imaging member and an electrophotographic imaging process for using the imaging member in which the imaging member comprises a substrate and an electroconductive layer, the imaging member comprising a polymeric acrylamine compound represented by the formula

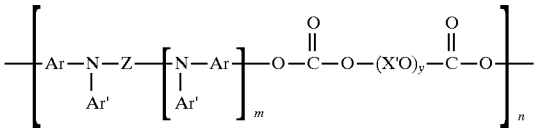

wherein n is between 5 and about 5,000, m is 0 or 1, y is 1, 2, or 3, Z is selected from certain specified aromatic and fused ring groups, Ar is selected from certain specified aromatic groups, Ar' is selected from certain specified aromatic groups, and X' is an alkylene radical selected from the group consisting of alkylene and isoalkylene groups containing 2 to 10 carbon atoms. The imaging member may comprise a substrate, charge generation layer, and a charge transport layer.

U.S. Pat. No. 4,806,444 (Yanus et al.) and U.S. Pat. No. 4,935,487 (Yanus et al.), the disclosures of each of which are totally incorporated herein by reference, disclose an electrostatographic imaging member and an electrophotographic imaging process for using the imaging member in which the imaging member comprises a substrate and an electroconductive layer, the imaging member comprising a polymeric arylamine compound represented by the formula

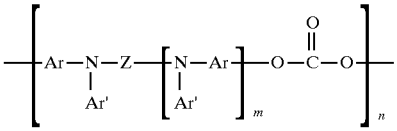

wherein n is between about 5 and about 5,000, m is 0 or 1, Z is selected from certain specified aromatic and fused ring groups, Ar is selected from certain specified aromatic groups, and Ar' is selected from certain specified aromatic groups. The imaging member may comprise a substrate, charge generation layer, and a charge transport layer.

U.S. Pat. No. 4,818,650 (Limburg et al.) and U.S. Pat. No. 4,956,440 (Limburg et al.), the disclosures of each of which are totally incorporated herein by reference, disclose an electrostatographic imaging member and an electrophotographic imaging process for using the imaging member in which the imaging member comprises a substrate and at least one electroconductive layer, the imaging member comprising a polymeric arylamine compound represented by the formula

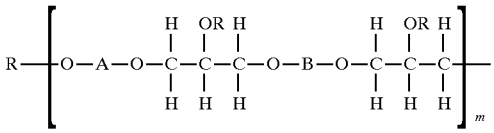

wherein R is selected from the group consisting of —H, —$CH_3$, and —$C_2H_5$, m is between about 4 and about 1,000, A is selected from the group consisting of an arylamine group represented by the formula

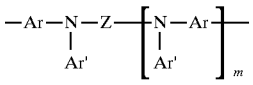

wherein m is 0 or 1, Z is selected from certain specified aromatic and fused ring groups that also contain an oxygen or sulfur atom, certain linear or cyclic hydrocarbon groups, and certain amine groups, Ar is selected from certain specified aromatic groups, Ar' is selected from certain specified aromatic groups, and B is selected from the group consisting of the arylamine group as defined for A and

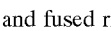

wherein Ar is as defined above and V is selected from an oxygen or sulfur atom, certain linear or cyclic hydrocarbon groups, or a phenylene group, and at least A or B contains the arylamine group. The imaging member may comprise a substrate, charge generation layer, and a charge transport layer.

U.S. Pat. No. 5,030,532 (Limburg et al.), the disclosure of which is totally incorporated herein by reference, discloses an electrostatographic imaging member comprising a support layer and at least one electrophotoconductive layer, said imaging member comprising a polyarylamine polymer represented by the formula

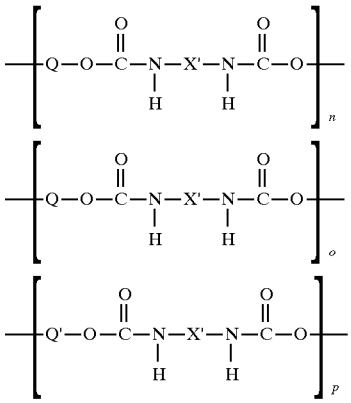

wherein n is between about 5 and about 5,000, or 0 if p>0, o is between about 9 and about 5,000, or is 0 if p>0 or n=0, p is between about 2 and about 100, or is 0 if n>0, X' and X" are independently selected from a group having bifunctional linkages, Q is a divalent group derived from certain hydroxy terminated arylamine reactants, Q' is a divalent group derived from a hydroxy terminated polyarylamine containing the group defined for Q and having a weight average molecular weight between about 1,000 and about 80,000, and the weight average molecular weight of the polyarylamine polymer is between about 10,000 and about 1,000,000.

Copending application U.S. Ser. No. (not yet assigned; Attorney Docket No. D/96194, filed concurrently herewith, with the named inventors Timothy J. Fuller, Leon A. Teuscher, John F. Yanus, Damodar M. Pai, Kathleen M. Carmichael, Edward F. Grabowski, and Paul F. Zukoski, the disclosure of which is totally incorporated herein by reference, discloses an imaging member which comprises a conductive substrate, a photogenerating material, and a binder comprising a polymer selected from (a) those of the formulae I
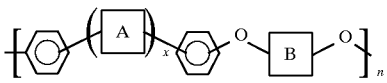
III
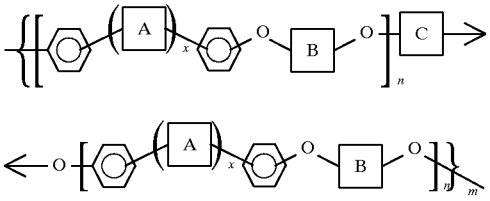
IV
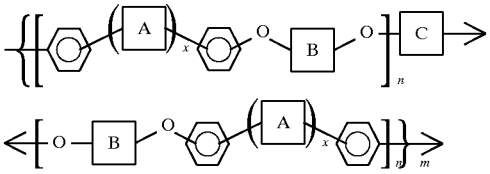
VII
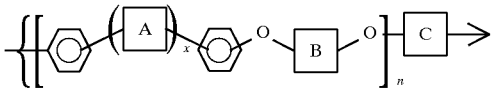
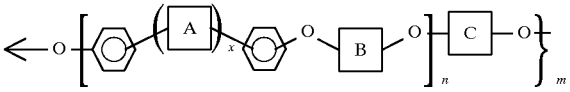
or
VIII
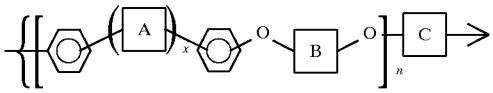
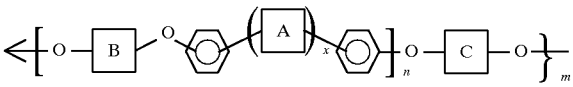
wherein x is an integer of 0 or 1, A is
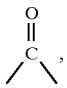
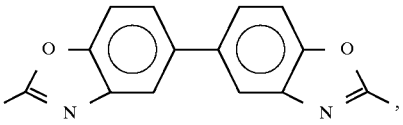
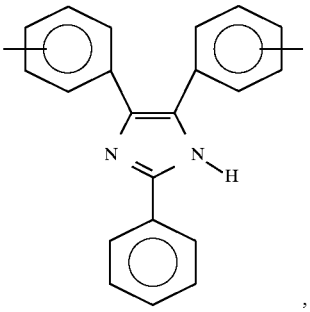
-continued
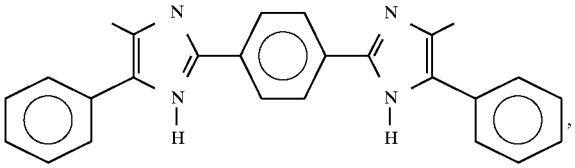
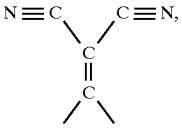
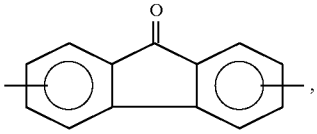
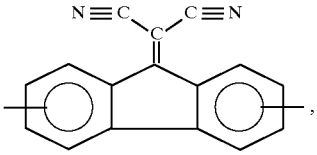
or mixtures thereof, B is
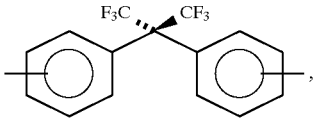
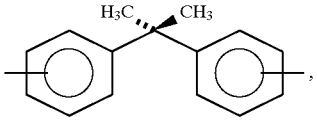
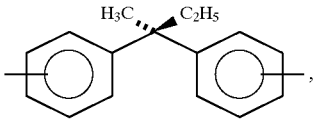
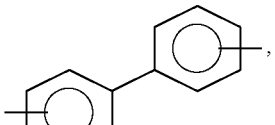
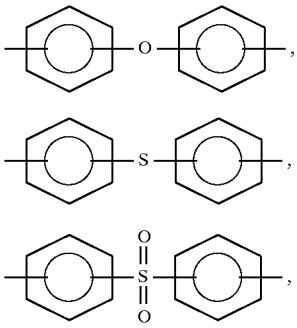

-continued
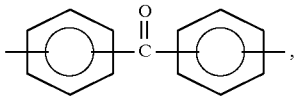
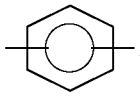
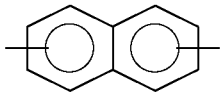
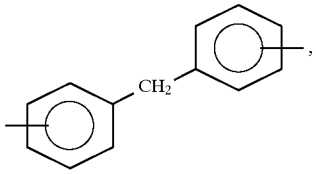
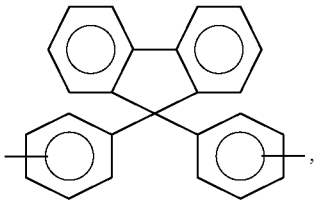
$\text{—}(CH_2)_v\text{—}$,
wherein v is an integer of from 1 to about 20,
$\text{—}(CH_2O)_t\text{—}$
wherein t is an integer of from 1 to about 20,
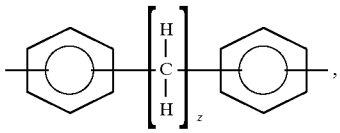
wherein z is an integer of from 2 to about 20,
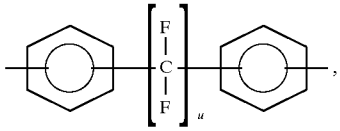
wherein u is an integer of from 1 to about 20,
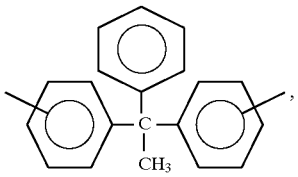
-continued
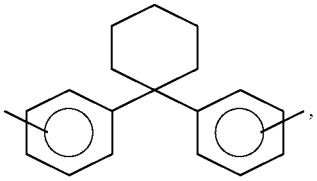
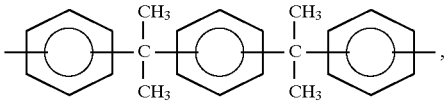
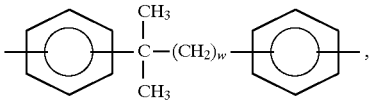
wherein w is an integer of from 1 to about 20,
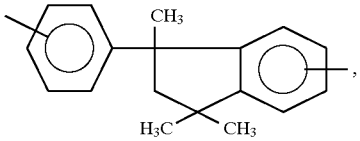
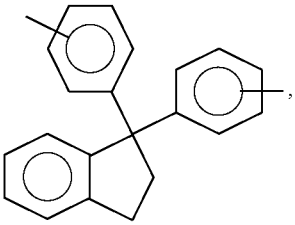
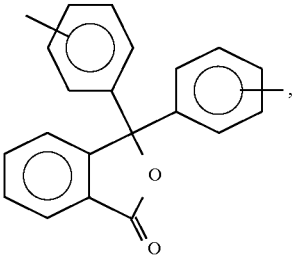
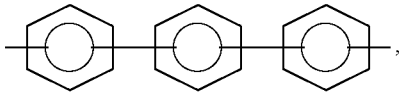
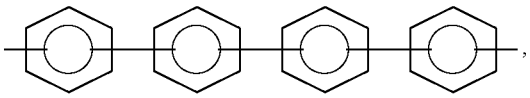
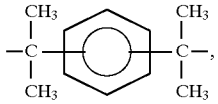
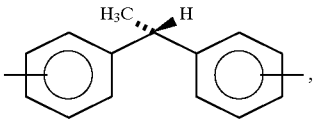

or mixtures thereof, C is
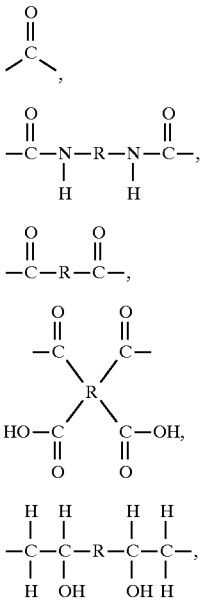
or mixtures thereof, wherein R is an alkyl group, an aryl group, an arylalkyl group, or mixtures thereof, and m and n are integers representing the number of repeating units; (b) those of the formulae
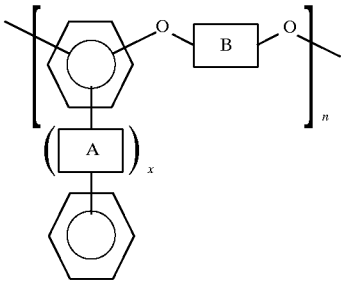
II
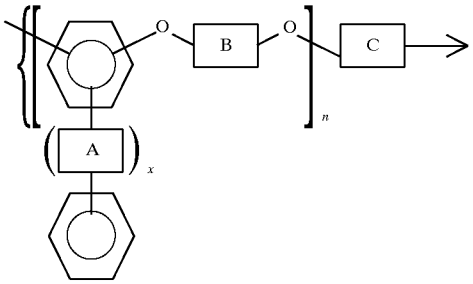
V
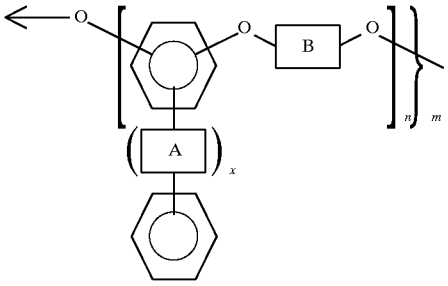
-continued
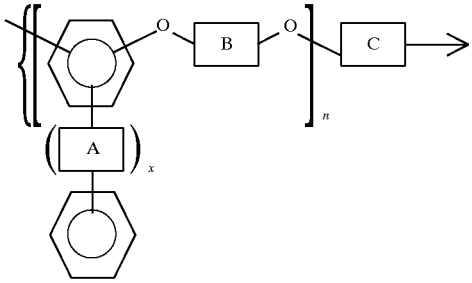
VI
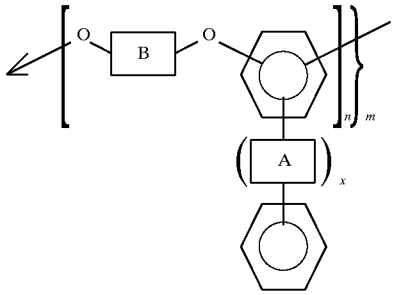
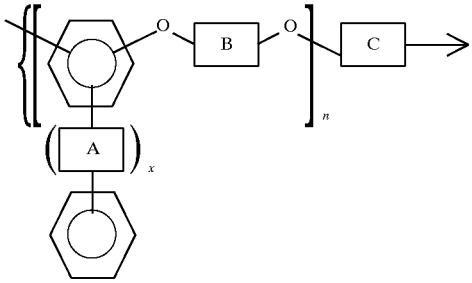
IX
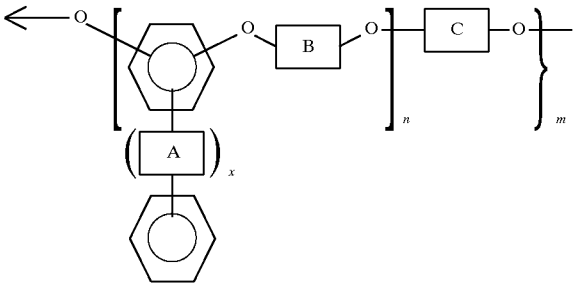
or
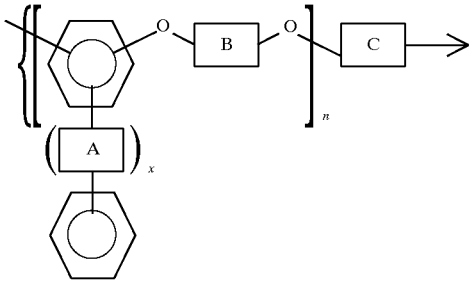
X -continued
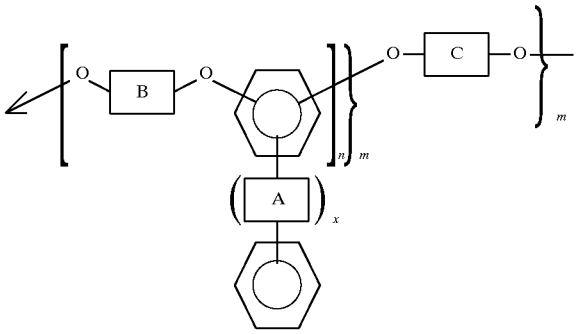
wherein x is an integer of 0 or 1, A is
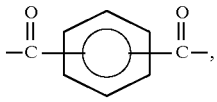
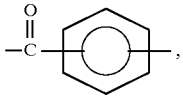
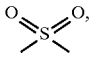
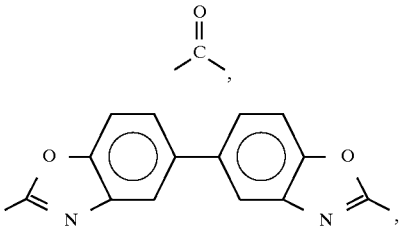
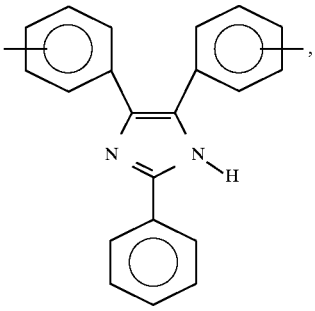
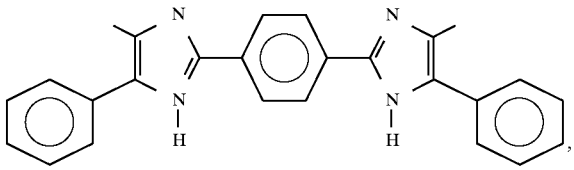
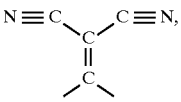
-continued
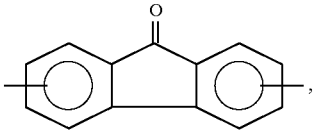
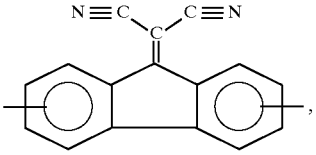
or mixtures thereof, B is
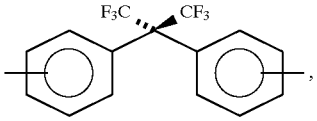
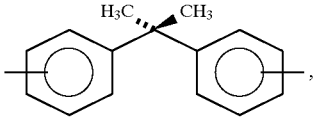
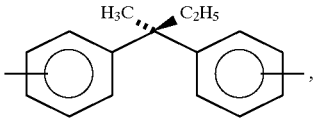
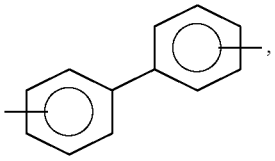
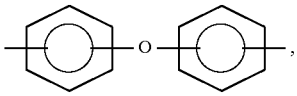
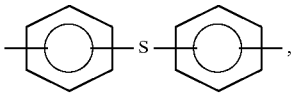
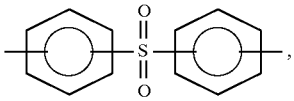
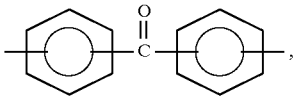
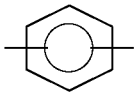
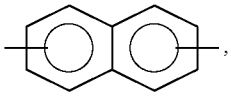

-continued
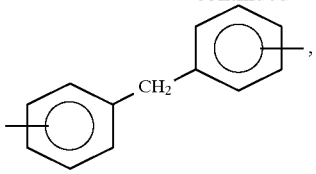
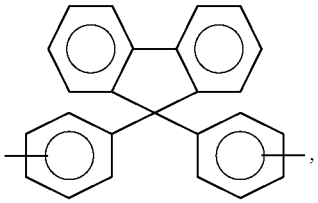
$\leftarrow CH_2 \rightarrow_v$,
wherein v is an integer of from 1 to about 20,
$-(CH_2O)_t-$
wherein t is an integer of from 1 to about 20,
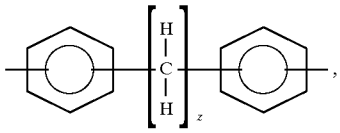
wherein z is an integer of from 2 to about 20,
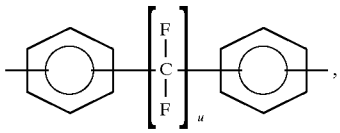
wherein u is an integer of from 1 to about 20,
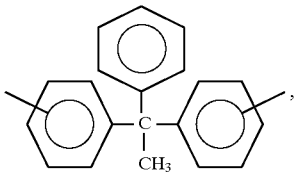
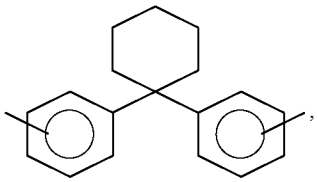
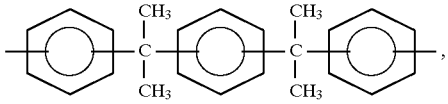
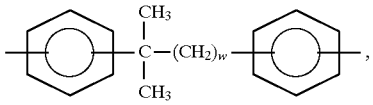
wherein w is an integer of from 1 to about 20,
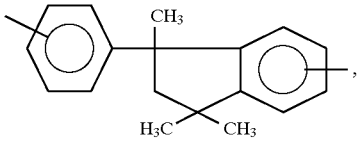
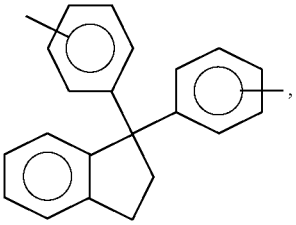
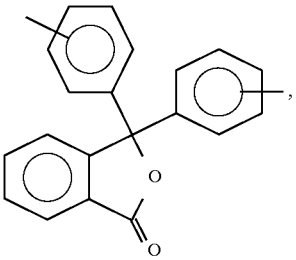
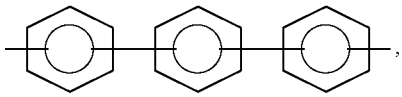
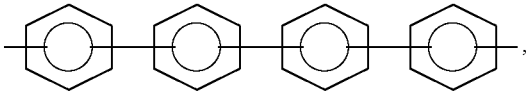
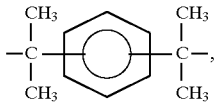
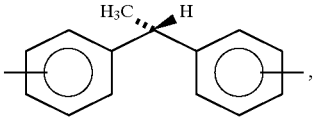
or mixtures thereof, C is
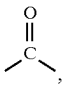
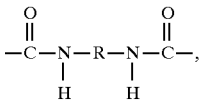
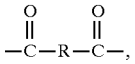
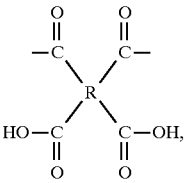

-continued

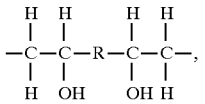

or mixtures thereof, wherein R is an alkyl group, an aryl group, an arylalkyl group, or mixtures thereof, and m and n are integers representing the number of repeating units; (c) those of formulae I, III, IV, VII, or VIII wherein x is an integer of 0 or 1, A is

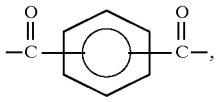

B is

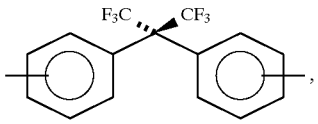

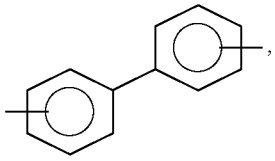

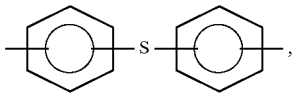

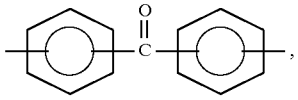

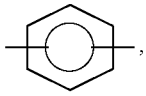

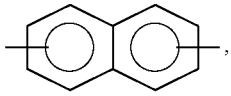

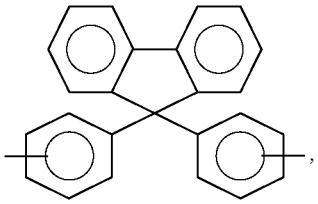

$\text{—}(CH_2)_v\text{—}$, wherein v is an integer of from 1 to about 20, $\text{—}(CH_2O)_t\text{—}$ wherein t is an integer of from 1 to about 20,

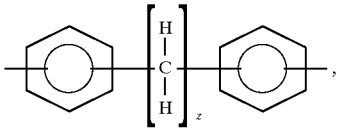

wherein z is an integer of from 2 to about 20,

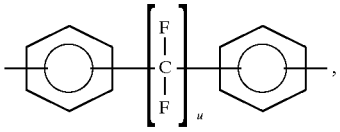

wherein u is an integer of from 1 to about 20,

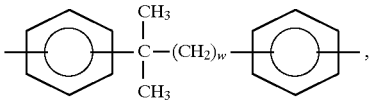

wherein w is an integer of from 1 to about 20,

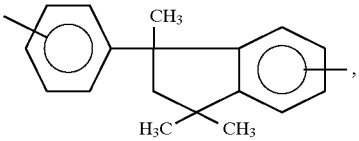

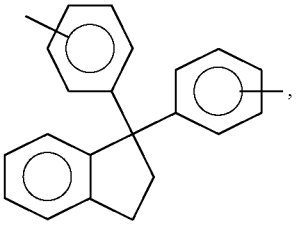

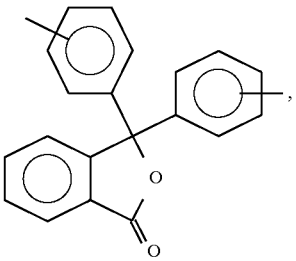

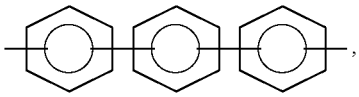

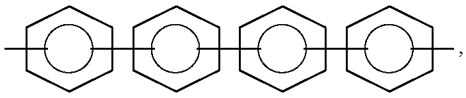

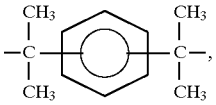

-continued

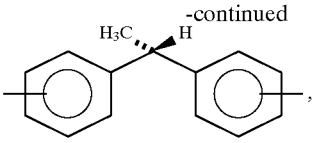

or mixtures thereof, C is

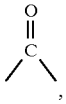

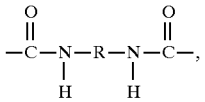

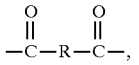

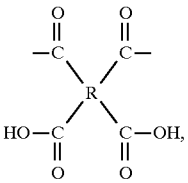

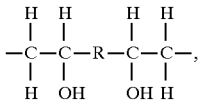

or mixtures thereof, wherein R is an alkyl group, an aryl group, an arylalkyl group, or mixtures thereof, and m and n are integers representing the number of repeating units; (d) those of formulae I, III, IV, VII, and VIII wherein x is an integer of 0 or 1, A is

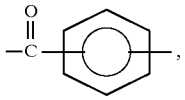

B is

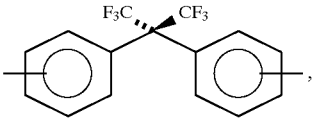

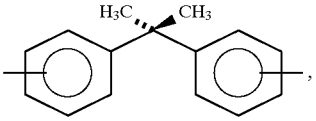

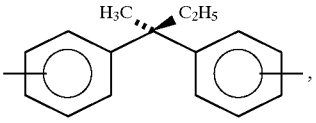

-continued

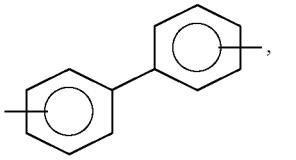

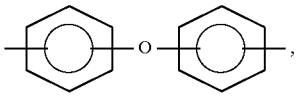

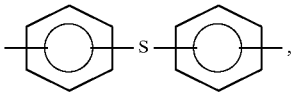

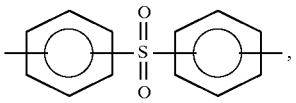

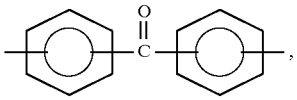

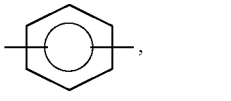

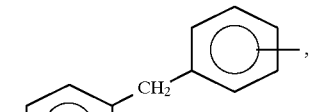

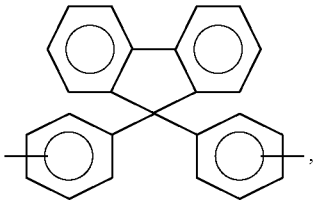

$\left(CH_2\right)_v$, wherein v is an integer of from 1 to about 20, $-(CH_2O)_t-$ wherein t is an integer of from 1 to about 20,

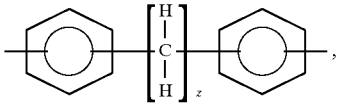

wherein z is an integer of from 2 to about 20,

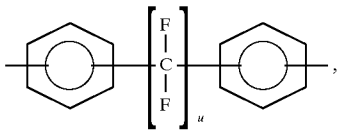

wherein u is an integer of from 1 to about 20,

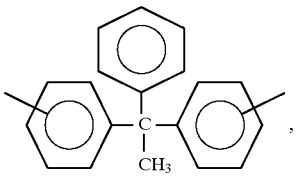

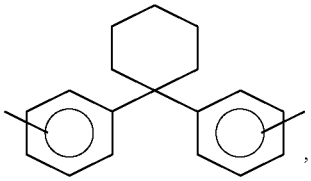

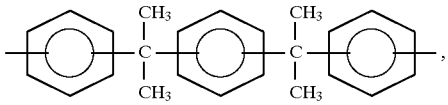

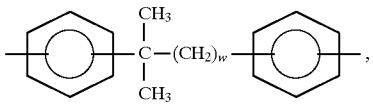

wherein w is an integer of from 1 to about 20,

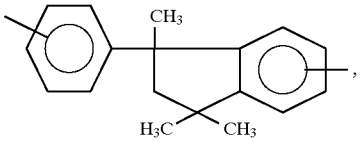

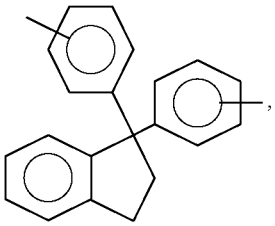

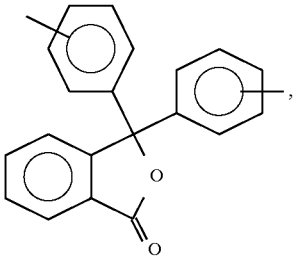

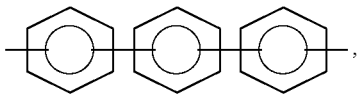

-continued

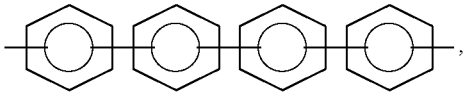

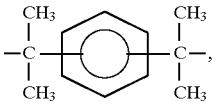

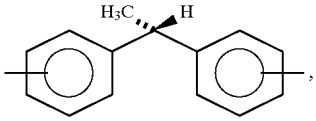

or mixtures thereof, C is

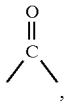

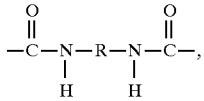

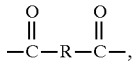

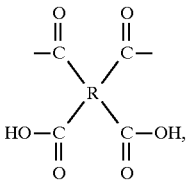

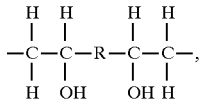

or mixtures thereof, wherein R is an alkyl group, an aryl group, an arylalkyl group, or mixtures thereof, and m and n are integers representing the number of repeating units; or (e) those of formulae I, III, IV, VII, and VIII wherein x is an integer of 0 or 1, A is

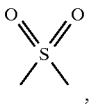

B is

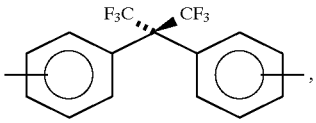

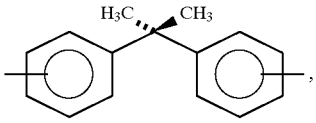

-continued
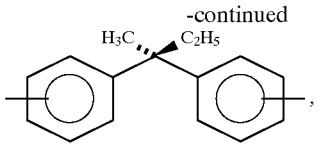
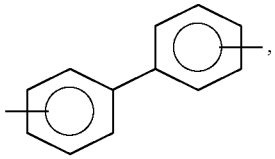
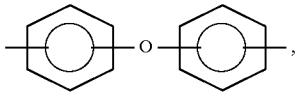
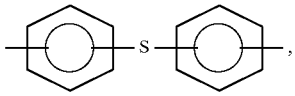
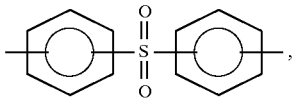
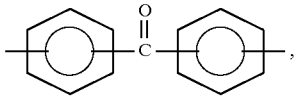
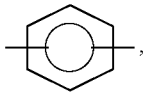
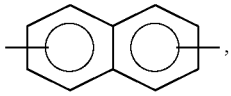
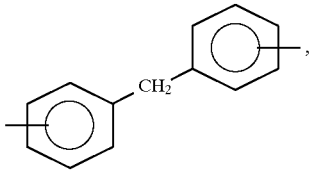
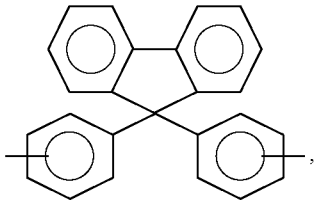
$\text{—}(CH_2)_v\text{—}$,
wherein v is an integer of from 1 to about 20,
$\text{—}(CH_2O)_t\text{—}$
wherein t is an integer of from 1 to about 20,
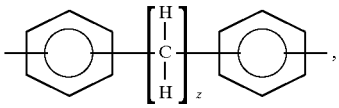
wherein z is an integer of from 2 to about 20,
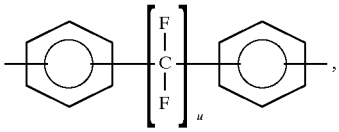
wherein u is an integer of from 1 to about 20,
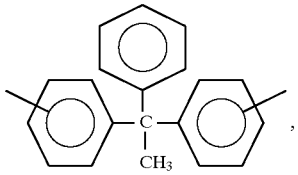
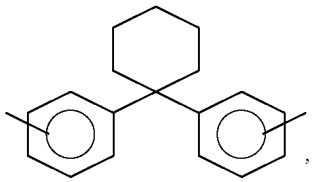
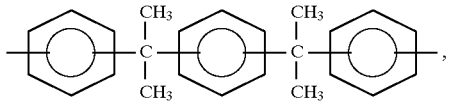
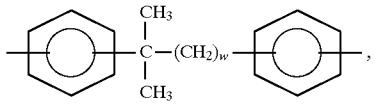
wherein w is an integer of from 1 to about 20,
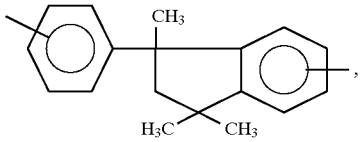
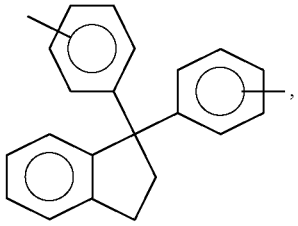

-continued

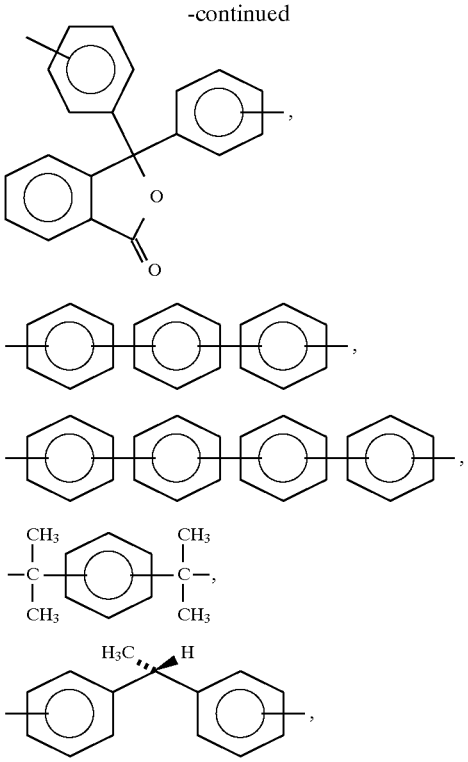

or mixtures thereof, C is

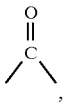

-continued

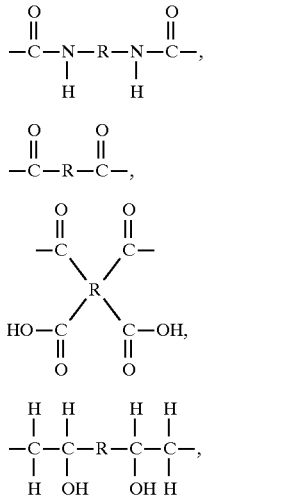

or mixtures thereof, wherein R is an alkyl group, an aryl group, an arylalkyl group, or mixtures thereof, and m and n are integers representing the number of repeating units.

Copending application U.S. Ser. No. (not yet assigned; Attorney Docket No. D/96194Q2, filed concurrently herewith, with the named inventors Timothy J. Fuller, Leon A. Teuscher, Damodar M. Pai, John F. Yanus, Kathleen M. Carmichael, Edward F. Grabowski, and Paul F. Zukoski, the disclosure of which is totally incorporated herein by reference, discloses an imaging member which comprises a conductive substrate, a photogenerating material, a charge transport material, and a polymeric binder comprising (a) a first polymer comprising a polycarbonate, and (b) a second polymer of the formula

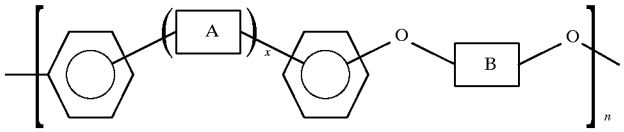

I

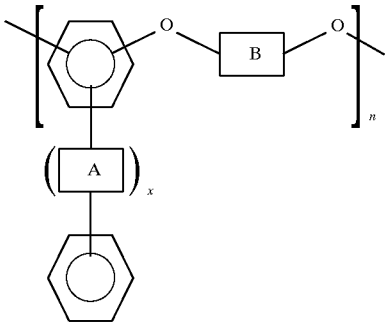

II

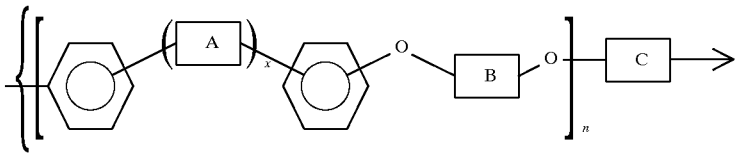

III

-continued
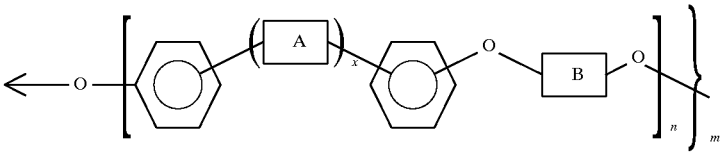
IV
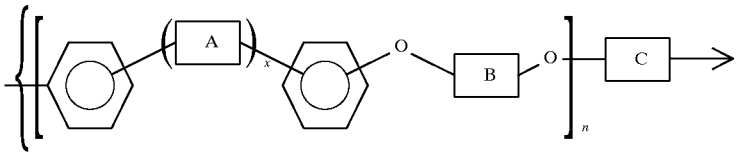
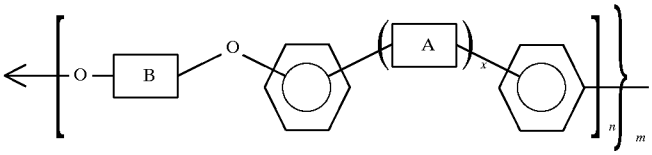
V
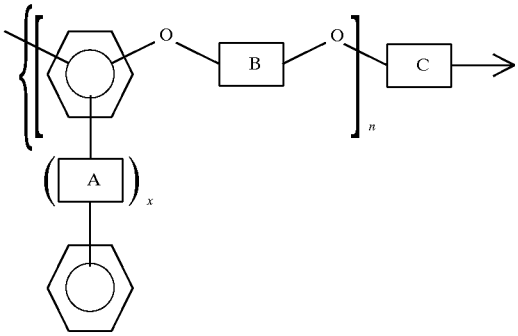
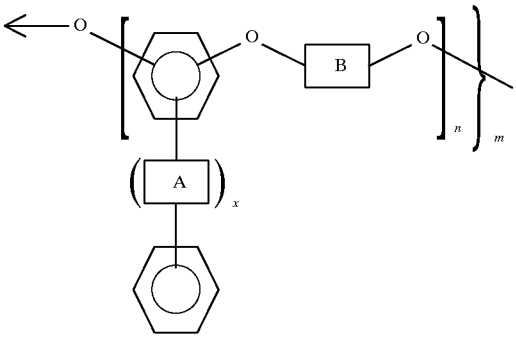
VI
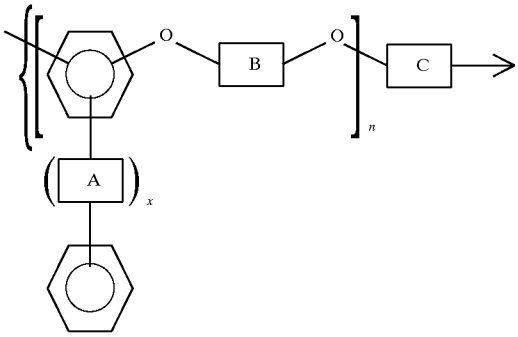

-continued
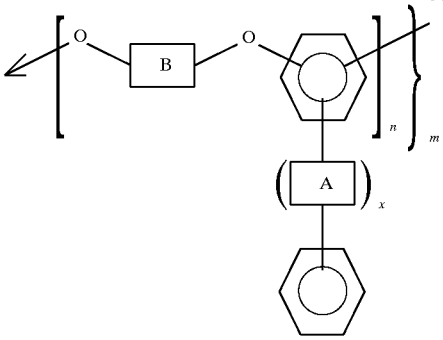
VII
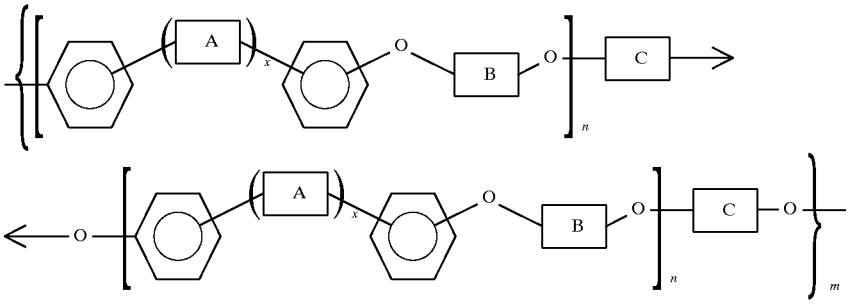
VIII
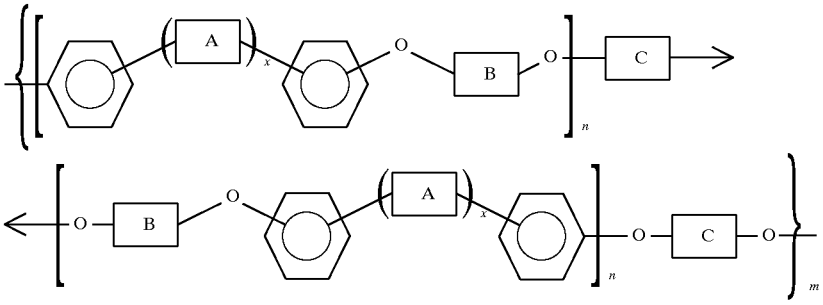
IX
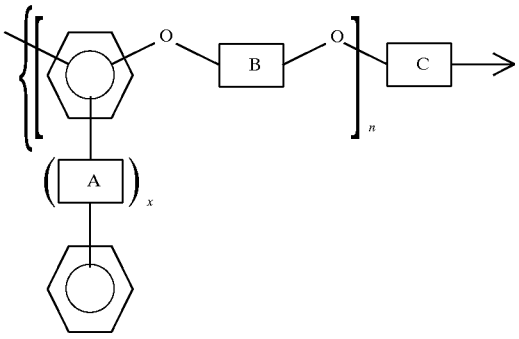
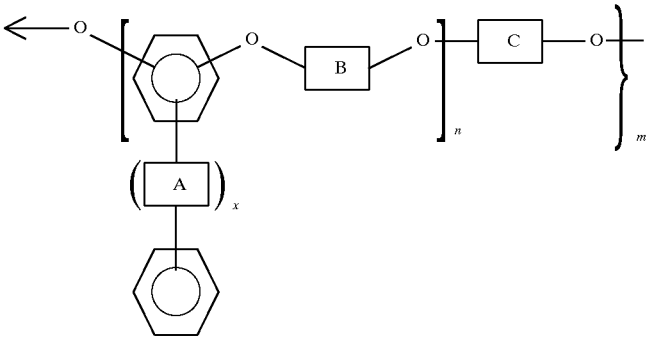
or -continued
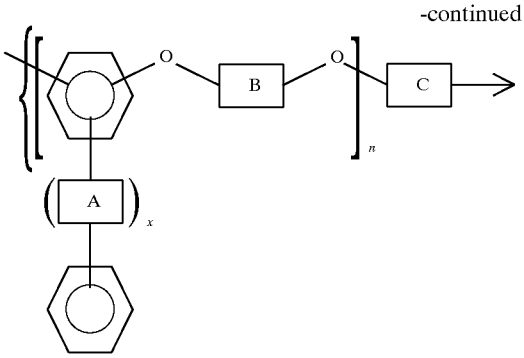
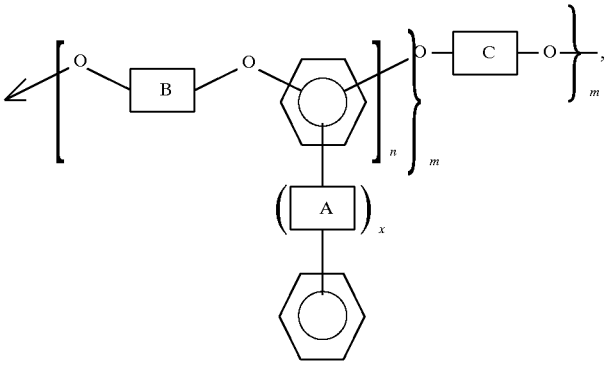
wherein x is an integer of 0 or 1, A is
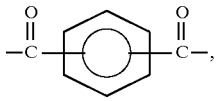
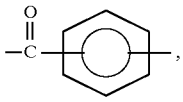
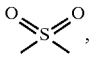
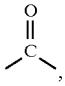
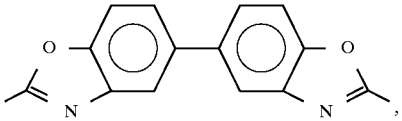
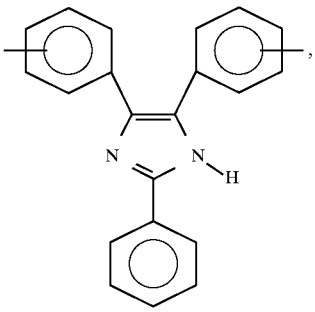
X
-continued
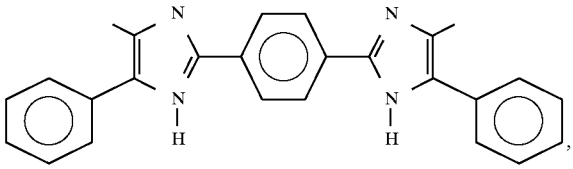
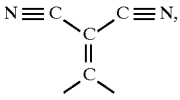
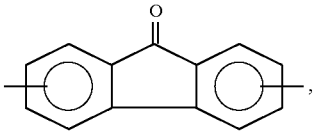
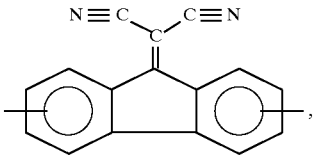
or mixtures thereof, B is
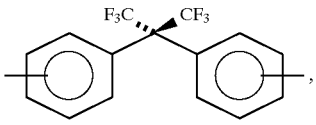

-continued
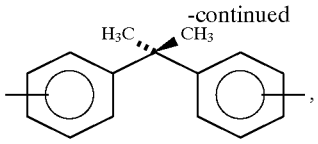
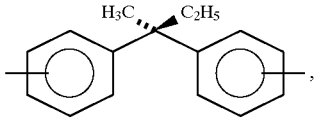
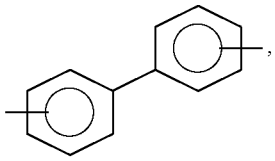
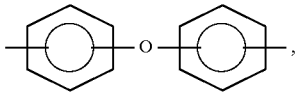
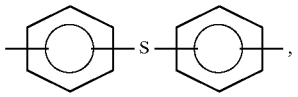
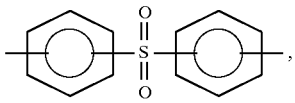
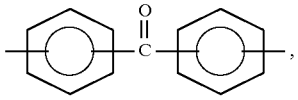
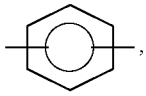
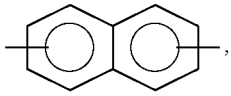
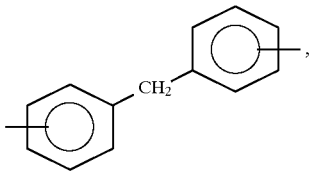
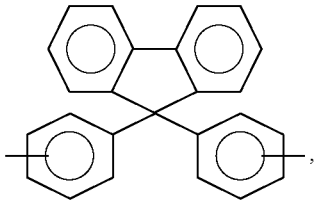
$\text{—}(CH_2)_v\text{—}$,
wherein v is an integer of from 1 to about 20,
$\text{—}(CH_2O)_t\text{—}$
wherein t is an integer of from 1 to about 20,
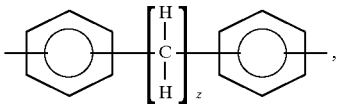
wherein z is an integer of from 2 to about 20,
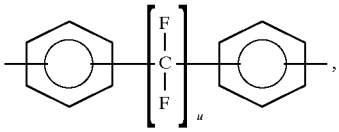
wherein u is an integer of from 1 to about 20,
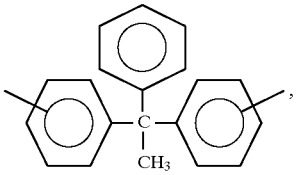
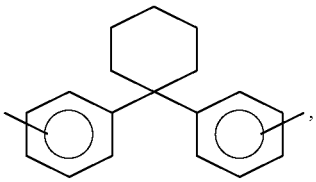
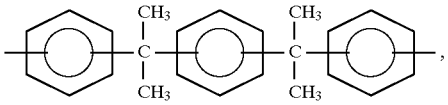
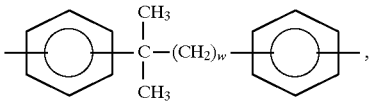
wherein w is an integer of from 1 to about 20,
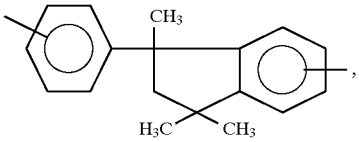
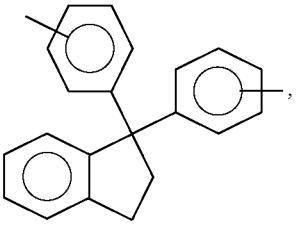

-continued

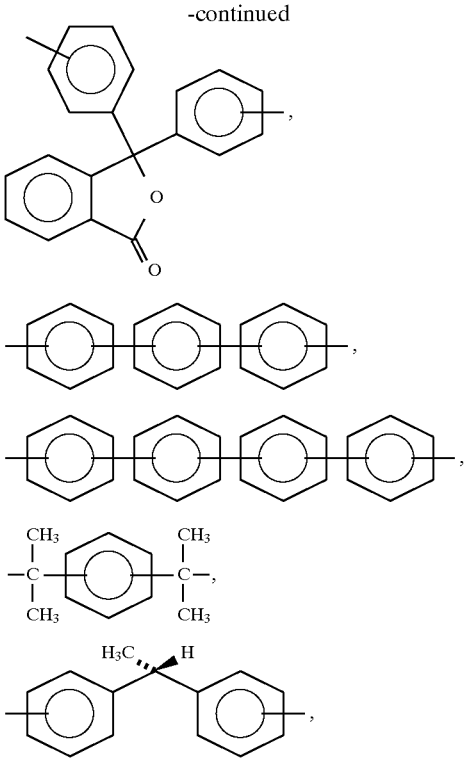

or mixtures thereof, C is

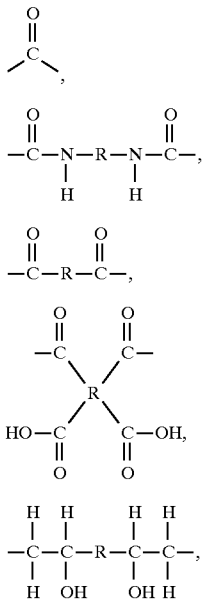

or mixtures thereof, wherein R is an alkyl group, an aryl group, an arylalkyl group, or mixtures thereof, and m and n are integers representing the numbers of repeating units.

Although excellent toner images may be obtained with multilayered belt photoreceptors that are developed with dry developer powder (toner), it has been found that these same photoreceptors may become unstable when employed with liquid development systems. The photoreceptors may suffer from cracking, crazing, crystallization of active compounds, phase separation of charge transporting molecules, and extraction of small molecule charge transport compounds caused by contact with the organic liquid vehicle, typically an isoparaffinic hydrocarbon such as one of the Isopar® materials commonly employed in liquid developers. The damaging results of contact with the hydrocarbon vehicle of the liquid developer can markedly degrade the mechanical integrity and electrical properties of the photoreceptor. More specifically, the organic carrier fluid of a liquid developer can leach out activating small molecules, such as arylamine containing compounds, typically used in charge transport layers. Examples of this class of arylamine materials are N,N'-diphenyl-N,N'-bis(3-methylphenyl)-(1,1'-biphenyl)-4,4'-diamine, bis-(4-diethylamino-2-methylphenyl)-phenylmethane, 2,5-bis-(4'-dimethylaminophenyl)-1,3,4'-oxadiazole, 1-phenyl-3-(4'-dimethylaminostyryl-5-(4"-dimethylaminophenyl)pyrazoline, 1,1-bis-(4-(di-N,N'-p-methylphenyl)-aminophenyl)-cyclohexane, 4-diethylaminobenzaldehyde-1,1-diphenylhydrazone, and the like. The leaching process can result in crystallization of the small molecules, such as the aforementioned arylamine compounds, onto the photoreceptor surface and subsequent migration of the arylamine into the liquid developer. In addition, the developer vehicle, typically a $C_{10}$–$C_{14}$ branched hydrocarbon, can induce the formation of cracks and crazes in the photoreceptor surface. These effects can lead to copy defects and shorter photoreceptor life. The degradation of the photoreceptor manifests as increased background and other printing defects prior to complete physical photoreceptor failure. The leaching out of the activating small molecule also increases the susceptibility of the transport layer to solvent/stress cracking when the belt is parked over a belt support roller during periods of non-use. Some liquid developer vehicles can also promote phase separation of the activating small molecules, such as arylamine compounds, in the transport layers, particularly when high concentrations of the arylamine compounds are present in the transport layer binder. Phase separation of active small molecules also adversely alters the electrical and mechanical properties of a photoreceptor. Similarly, single layer photoreceptors having a single active layer comprising photoconductive particles dispersed in a charge transport film-forming binder also are vulnerable to the same degradation problems encountered by the previously described multilayered type of photoreceptor when exposed to liquid developers. Although flexing is normally not encountered with rigid, cylindrical, multilayered photoreceptors which utilize charge transport layers containing activating small molecules dispersed or dissolved in a polymeric film forming binder, electrical degradation is similarly encountered during development with liquid developers. Sufficient degradation of these photoreceptors by liquid developers can occur in less than two hours as indicated by leaching of the small molecule and cracking of the matrix polymer film. Continuous exposure for a few days severely damages the photoreceptor. Thus, in advanced imaging systems utilizing multilayered photoreceptors exposed to liquid development systems, cracking and crazing have been encountered in critical charge transport layers during belt cycling. Cracks developing in charge transport layers during cycling can be manifested as print-out defects adversely affecting copy quality. Furthermore, cracks in the photoreceptor pick up toner particles which cannot be removed in the cleaning step and may be transferred to the background in subsequent prints. In addition, crack areas are subject to delamination when contacted with blade cleaning devices, thus limiting the options in electrophotographic product design.

For use with liquid developers, photoreceptors employing charge transport polymers have been developed, such as those described in U.S. Pat. No. 4,801,507, U.S. Pat. No. 4,806,644, U.S. Pat. No. 4,818,650, U.S. Pat. No. 4,806,443, and U.S. Pat. No. 5,030,532. While these compositions may meet machine requirements, the synthetic procedure to make these polymers are difficult and in some cases employ toxic substances. The acidic conditions employed in the syntheses also results in generation of free radicals, which in turn can result in material having properties that vary from batch to batch.

While known compositions and processes are suitable for their intended purposes, a need remains for improved electrostatic imaging members. In addition, a need remains for electrostatic imaging members which exhibit reduced or no crystallization when operated in an environment employing liquid ink development. Further, a need remains for electrostatic imaging members exhibiting improved imaging operation during extended image cycling. Additionally, a need remains for charge transport polymers which can be prepared by non-toxic syntheses. There is also a need for charge transport polymers with properties which remain constant from batch to batch. In addition, there is a need for charge transport polymers which exhibit improved wear resistance. Further, there is a need for high performance charge transport polymers which can be synthesized and scaled up in a non-toxic environment and which have reproducible properties from batch to batch.

SUMMARY OF THE INVENTION

It is an object of the present invention to provide improved electrostatic imaging members with the above noted advantages.

It is another object of the present invention to provide electrostatic imaging members which exhibit reduced or no crystallization when operated in an environment employing liquid ink development.

It is yet another object of the present invention to provide electrostatic imaging members exhibiting improved imaging operation during extended image cycling.

It is still another object of the present invention to provide charge transport polymers which can be prepared by non-toxic syntheses.

Another object of the present invention is to provide charge transport polymers with properties which remain constant from batch to batch.

Yet another object of the present invention is to provide charge transport polymers which exhibit improved wear resistance.

Still another object of the present invention is to provide high performance charge transport polymers which can be synthesized and scaled up in a non-toxic environment and which have reproducible properties from batch to batch.

These and other objects of the present invention (or specific embodiments thereof) can be achieved by providing an imaging member which comprises a conductive substrate, a photogenerating material, and a polymer of the formula

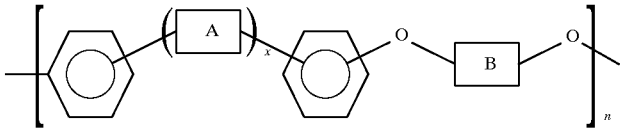

I

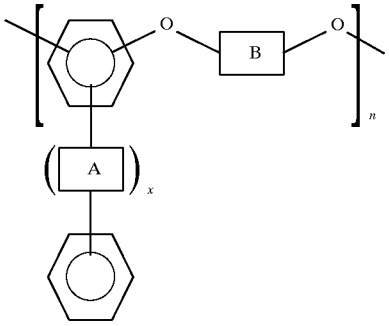

II

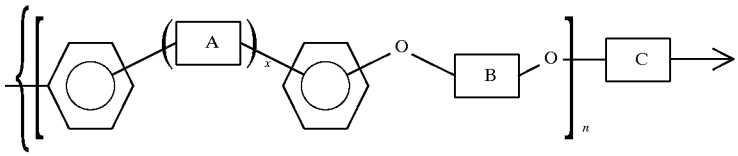

III

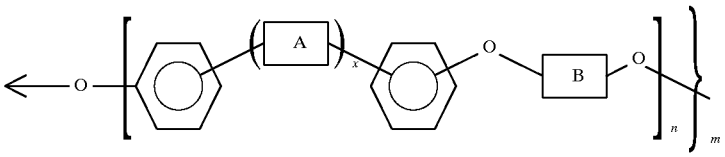

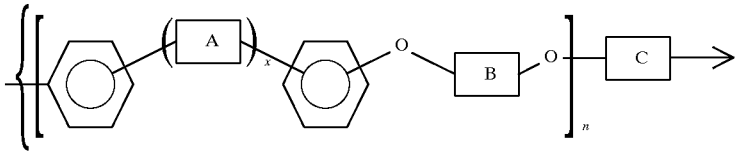

IV

-continued
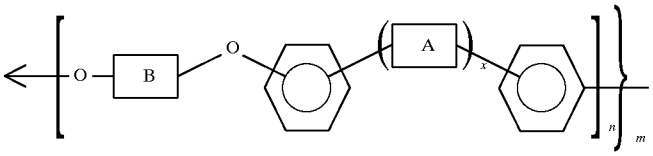
V
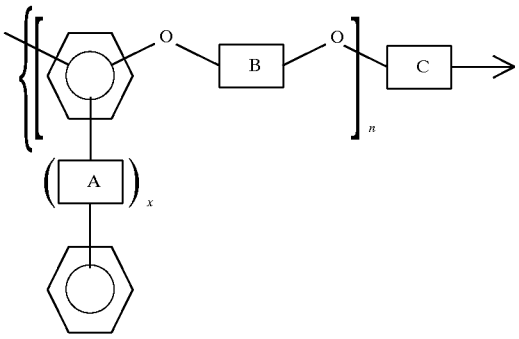
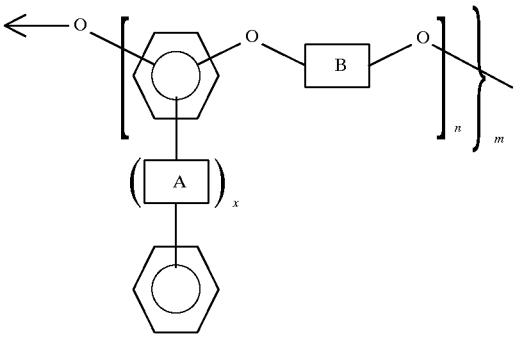
VI
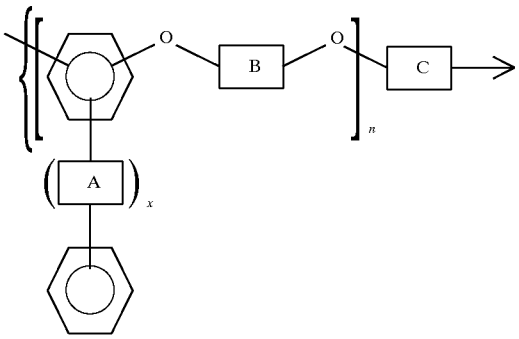
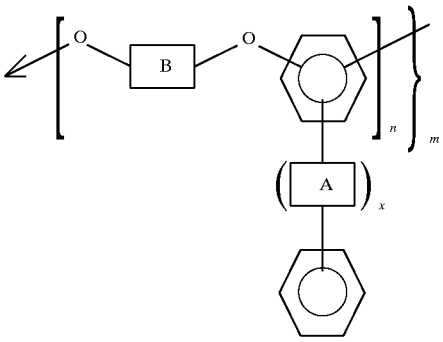
VII
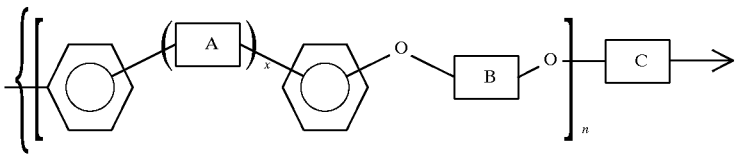

-continued
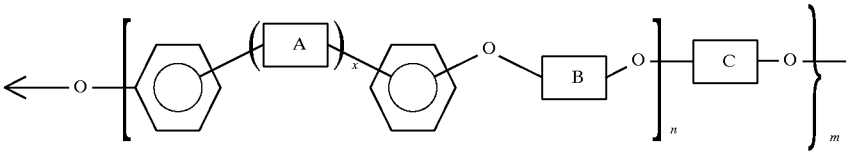
VIII
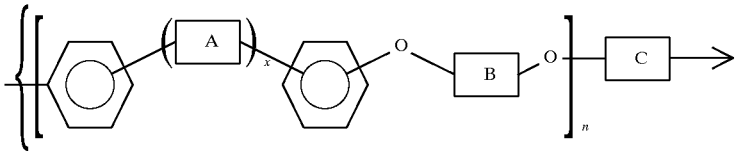
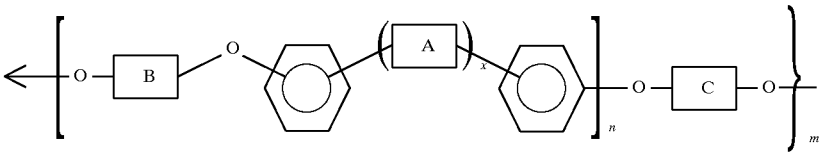
IX
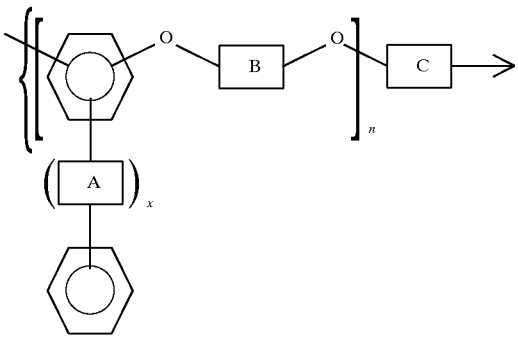
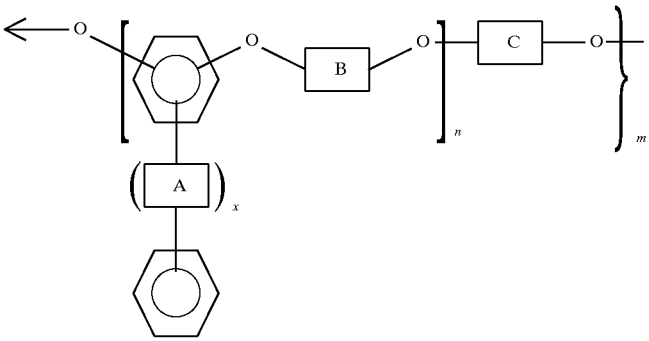
or
X
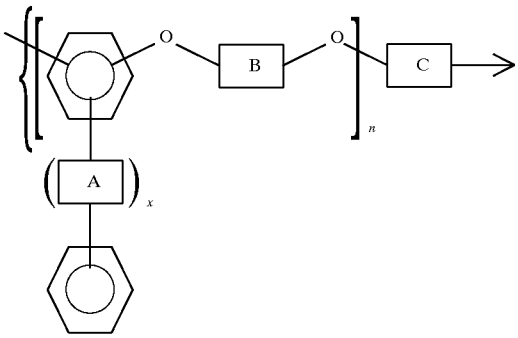

-continued
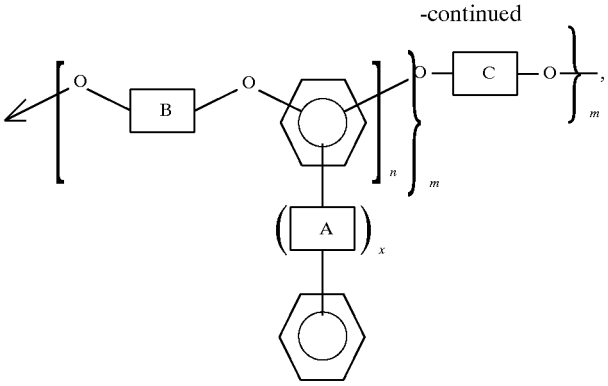
wherein x is an integer of 0 or 1, A is
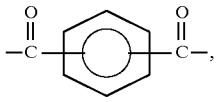
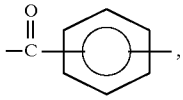
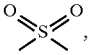
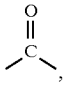
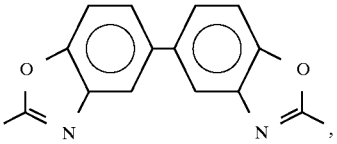
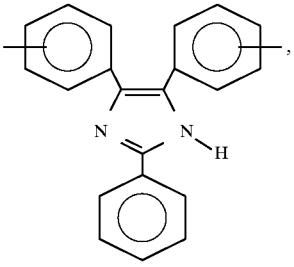
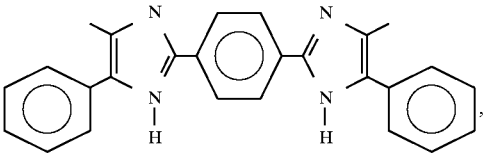
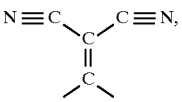
-continued
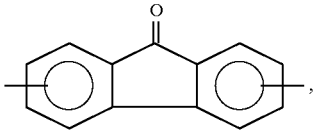
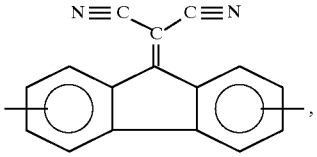
or mixtures thereof, B is
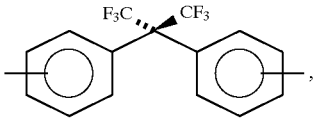
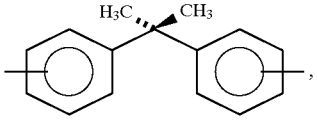
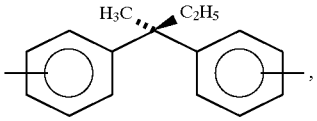
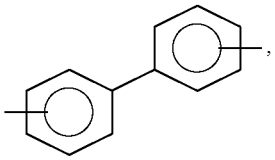
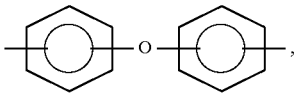
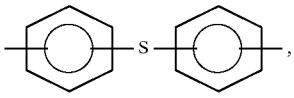

-continued
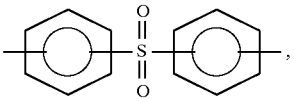
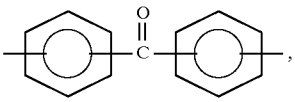
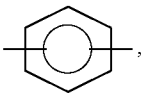
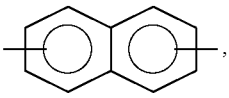
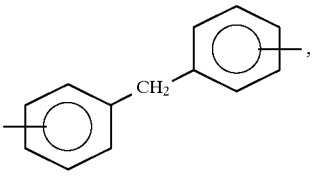
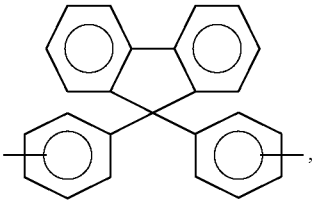
$-(CH_2)_v-$,
wherein v is an integer of from 1 to about 20,
$-(CH_2O)_t-$
wherein t is an integer of from 1 to about 20,
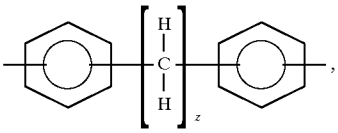
wherein z is an integer of from 2 to about 20,
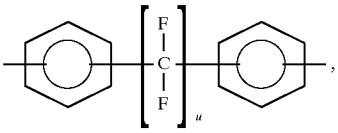
wherein u is an integer of from 1 to about 20,
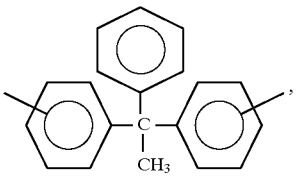
-continued
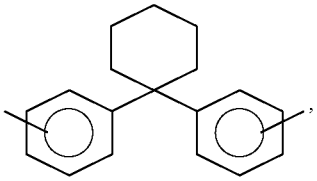
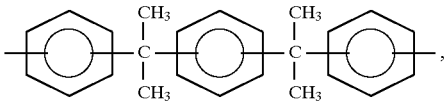
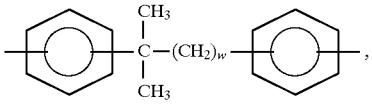
wherein w is an integer of from 1 to about 20,
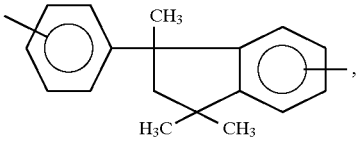
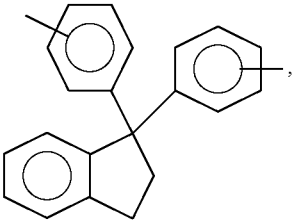
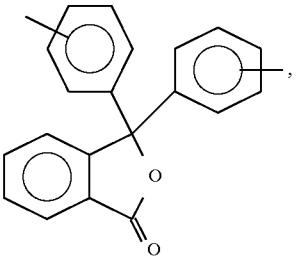
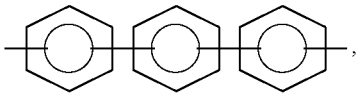
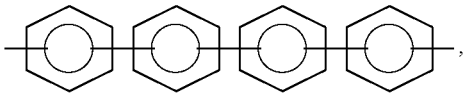
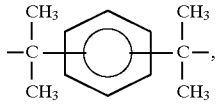
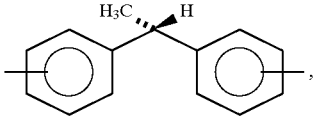
or -continued

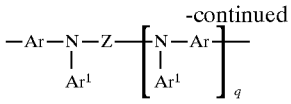

wherein (1) Z is

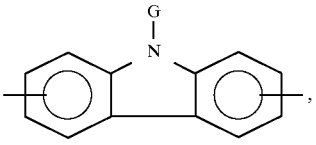

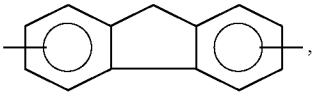

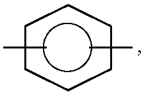

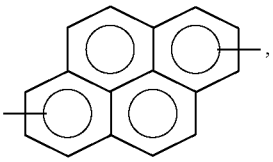

or $-Ar-(X)_p-Ar-$ p is 0 or 1; (2) Ar is

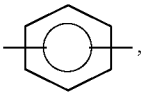

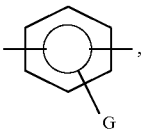

or

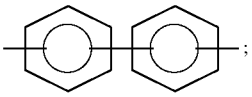

(3) G is an alkyl group selected from alkyl or isoalkyl groups containing from about 2 to about 10 carbon atoms; (4) Ar' is

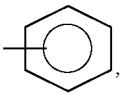

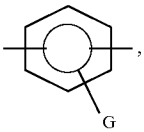

or

-continued

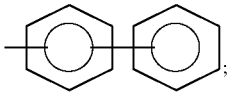

(5) X is

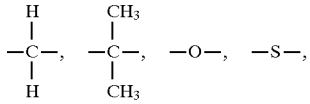

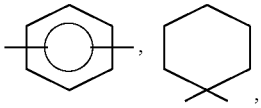

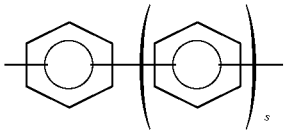

wherein s is 0, 1, or 2,

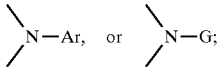

and (6) q is 0 or 1; or mixtures thereof, wherein at least some of the "B" groups are of the formula

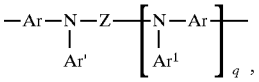

C is

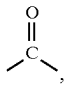

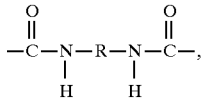

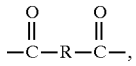

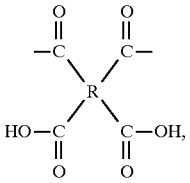

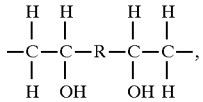

or mixtures thereof, wherein R is an alkyl group, an aryl group, an arylalkyl group, or mixtures thereof, and m and n are integers representing the number of repeating units.

DETAILED DESCRIPTION OF THE INVENTION

Figure 1:
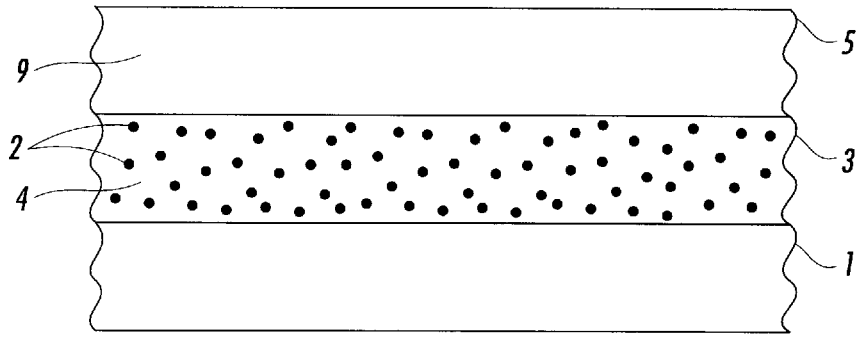
FIGS. 1, 2, 3, and 4 are schematic cross-sectional views of examples of photoconductive imaging members of the present invention.

FIG. 1 illustrates schematically one embodiment of the imaging members of the present invention. Specifically, FIG. 1 shows a photoconductive imaging member comprising a conductive substrate 1, a photogenerating layer 3 comprising a photogenerating compound 2 dispersed in a resinous binder composition 4, and a charge transport layer 5, which comprises a charge transporting polymer 9, to be discussed in further detail hereinbelow.

Figure 2:
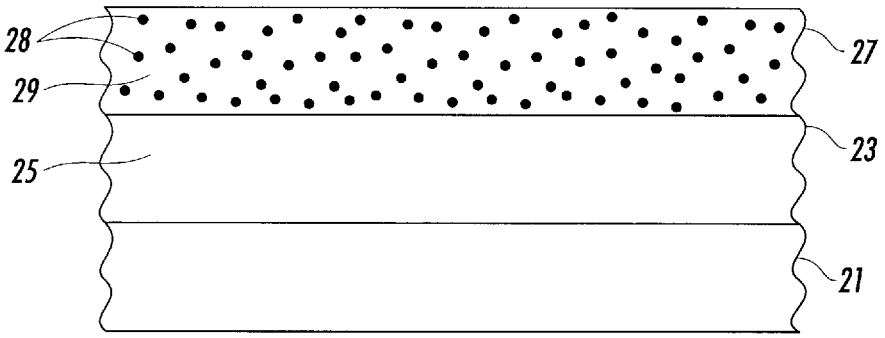

FIG. 2 illustrates schematically essentially the same member as that shown in FIG. 1 with the exception that the charge transport layer is situated between the conductive substrate and the photogenerating layer. More specifically, FIG. 2 illustrates a photoconductive imaging member comprising a conductive substrate 21, a charge transport layer 23 comprising a charge transporting polymer 25, to be discussed in further detail hereinbelow, and a photogenerating layer 27 comprising a photogenerating compound 28 dispersed in a resinous binder composition 29.

Figure 3:
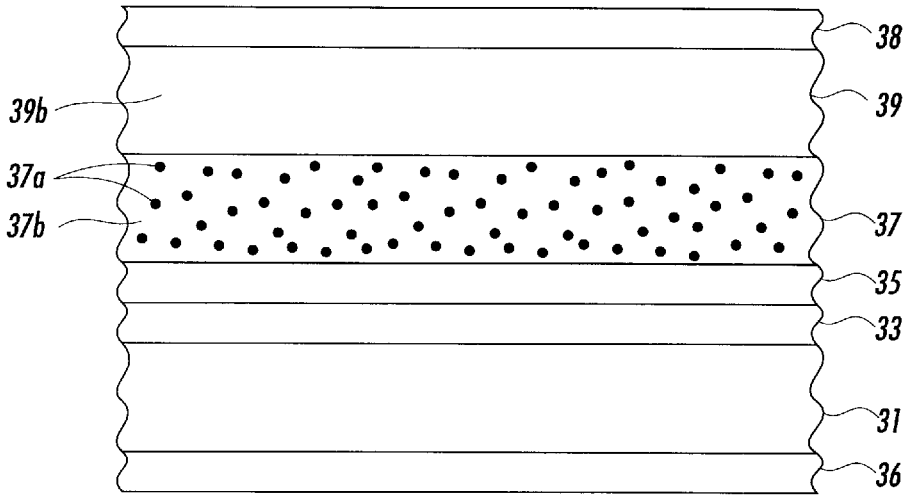

FIG. 3 illustrates schematically a photoconductive imaging member of the present invention comprising a conductive substrate 31, an optional charge blocking metal oxide layer 33, an optional adhesive layer 35, a photogenerating layer 37 comprising a photogenerating compound 37*a* dispersed in a resinous binder composition 37*b*, a charge transport layer 39 comprising a charge transporting polymer 39*b*, discussed in further detail hereinbelow, an optional anticurl backing layer 36, and an optional protective overcoating layer 38.

Figure 4:
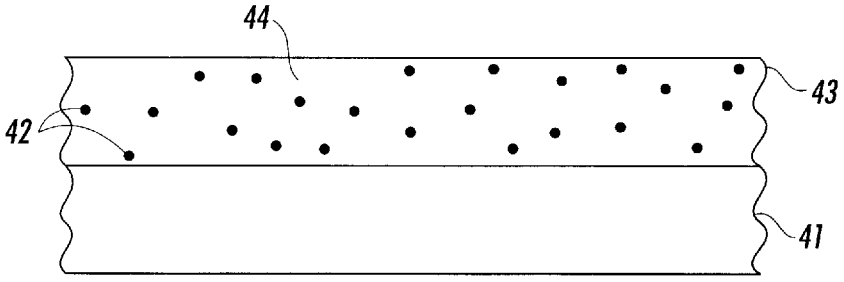

FIG. 4 illustrates schematically a photoconductive imaging member of the present invention comprising a conductive substrate 41 and a photogenerating layer 43 comprising a photogenerating compound 42 dispersed in a resinous binder composition 44. Resinous binder composition 44 comprises a polymer of the specific formulae indicated herein, either alone or in combination with one or more additional binder polymers.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, halfnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as Mylar (available from Du Pont) or Melinex 447 (available from ICI Americas, Inc.), and the like. The conductive layer can be coated onto the base layer by any suitable coating technique, such as vacuum deposition or the like. If desired, the substrate can comprise a metallized plastic, such as titanized or aluminized Mylar, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

The photoconductive imaging member may optionally contain a charge blocking layer situated between the conductive substrate and the photogenerating layer. Generally, electron blocking layers for positively charged photoreceptors allow holes from the imaging surface of the photoreceptor to migrate toward the conductive layer, while hole blocking layers for negatively charged photoreceptors allow electrons from the imaging surface of the photoreceptor to migrate toward the conductive layer. This layer may comprise metal oxides, such as aluminum oxide and the like, or materials such as silanes and nylons, nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $\{H_2N(CH_2)_4\}CH_3Si(OCH_3)_2$, (gamma-aminobutyl) methyl diethoxysilane, and $\{H_2N(CH_2)_3\}CH_3Si(OCH_3)_2$ (gamma-aminopropyl) methyl diethoxysilane, as disclosed in U.S. Pat. Nos. 4,291,110, 4,338,387, 4,286,033 and 4,291,110, the disclosures of each of which are totally incorporated herein by reference, or the like. Additional examples of suitable materials include gelatin (e.g. Gelatin 225, available from Knox Gelatine Inc.), and/or Carboset 515 (B. F. Goodrich Chemical Company) dissolved in water and methanol, polyvinyl alcohol, polyamides, gamma-aminopropyl triethoxysilane, polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures or blends thereof, copolymers thereof, and the like. A preferred blocking layer comprises a reaction product between a hydrolyzed silane and the oxidized surface of a metal ground plane layer. The oxidized surface inherently forms on the outer surface of most metal ground plane layers when exposed to air after deposition. The primary purpose of this layer is to prevent charge injection from the substrate during and after charging. This layer is typically of a thickness of less than 50 Angstroms to about 10 microns, preferably being no more than about 2 microns, and more preferably being no more than about 0.2 microns, although the thickness can be outside these ranges.

The blocking layer may be applied by any suitable conventional technique such as spraying, dip coating, draw bar coating, gravure coating, silk screening, air knife coating, reverse roll coating, vacuum deposition, chemical treatment or the like. For convenience in obtaining thin layers, the blocking layers are preferably applied in the form of a dilute solution, with the solvent being removed after deposition of the coating by conventional techniques such as by vacuum, heating and the like.

In some cases, intermediate adhesive layers between the substrate and subsequently applied layers may be desirable to improve adhesion. If such adhesive layers are utilized, they preferably have a dry thickness of from about 0.1 micron to about 5 microns, although the thickness can be outside of this range. Typical adhesive layers include film-forming polymers such as polyesters, polyvinylbutyrals, polyvinylpyrrolidones, polycarbonates, polyurethanes, polymethylmethacrylates, duPont 49,000 (available from E. I. duPont de Nemours and Company), Vitel PE100 (available from Goodyear Tire & Rubber), and the like as well as mixtures thereof. Since the surface of the substrate can be a charge blocking layer or an adhesive layer, the expression "substrate" as employed herein is intended to include a charge blocking layer with or without an adhesive layer on a charge blocking layer. Typical adhesive layer thicknesses are from about 0.05 micron (500 angstroms) to about 0.3 micron (3,000 angstroms), although the thickness can be outside this range. Conventional techniques for applying an adhesive layer coating mixture to the substrate include spraying, dip coating, roll coating, wire wound rod coating, gravure coating, Bird bar applicator coating, or the like. Drying of the deposited coating may be effected by any suitable conventional technique, such as oven drying, infra red radiation drying, air drying, or the like.

Optionally, an overcoat layer can also be utilized to improve resistance to abrasion. In some cases an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multiphotogenerating layer compositions may be utilized where a photoconductive layer enhances or reduces the properties of the photogenerating layer. Examples of this type of configuration are described in U.S. Pat. No. 4,415,639, the disclosure of which is totally incorporated herein by reference. Further examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, and U.S. Pat. No. 4,299,897, the disclosures of each of which are totally incorporated herein by reference; dyestuff generator layer and oxadiazole, pyrazalone, imidazole, bromopyrene, nitrofluorene and nitronaphthalimide derivative containing charge transport layers members, as disclosed in U.S. Pat. No. 3,895,944, the disclosure of which is totally incorporated herein by reference; generator layer and hydrazone containing charge transport layers members, disclosed in U.S. Pat. No. 4,150,987, the disclosure of which is totally incorporated herein by reference; generator layer and a tri-aryl pyrazoline compound containing charge transport layer members, as disclosed in U.S. Pat. No. 3,837,851, the disclosure of which is totally incorporated herein by reference; and the like.

The photogenerating or photoconductive layer contains any desired or suitable photoconductive material. The photoconductive layer or layers may contain inorganic or organic photoconductive materials. Typical inorganic photoconductive materials include amorphous selenium, trigonal selenium, alloys of selenium with elements such as tellurium, arsenic, and the like, amorphous silicon, cadmium sulfoselenide, cadmium selenide, cadmium sulfide, zinc oxide, titanium dioxide and the like. Inorganic photoconductive materials can, if desired, be dispersed in a film forming polymer binder.

Typical organic photoconductors include various phthalocyanine pigments, such as the X-form of metal free phthalocyanine described in U.S. Pat. No. 3,357,989, the disclosure of which is totally incorporated herein by reference, metal phthalocyanines such as vanadyl phthalocyanine, copper phthalocyanine, and the like, quinacridones, including those available from DuPont as Monastral Red, Monastral Violet and Monastral Red Y, substituted 2,4-diamino-triazines as disclosed in U.S. Pat. No. 3,442,781, the disclosure of which is totally incorporated herein by reference, polynuclear aromatic quinones, Indofast Violet Lake B, Indofast Brilliant Scarlet, Indofast Orange, dibromoanthanthrones such as those available from DuPont as Vat orange 1 and Vat orange 3, squarylium, pyrazolones, polyvinylcarbazole-2,4,7-trinitrofluorenone, anthracene, benzimidazole perylene, polynuclear aromatic quinones available from Allied Chemical Corporation under the tradename Indofast Double Scarlet, Indofast Violet Lake B, Indofast Brilliant Scarlet and Indofast Orange, and the like. Many organic photoconductor materials may also be used as particles dispersed in a resin binder.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers. The charge transporting polymers of the present invention are also suitable for use as binder polymers, either alone or in combination with other materials.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micron and about 0.5 micron to facilitate better coating uniformity.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any other suitable multilayer photoconductors may also be employed in the imaging member of this invention. Some multilayer photoconductors comprise at least two electrically operative layers, a photogenerating or charge generating layer and a charge transport layer. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference.

When a separate charge transport layer is present in the imaging member of the present invention, any suitable and conventional technique may be utilized to mix and thereafter apply the charge transport layer coating to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is from about 5 to about 50 microns, although thicknesses outside this range can also be used. Preferably, the ratio of the thickness of the charge transport layer to the charge generator layer is maintained from about 2:1 to 200:1, and in some instances as great as 400:1.

In the photosensitive imaging members of the present invention, the charge transport layer contains a charge-transporting polymer of the specific formulae indicated herein. In one embodiment, the charge transporting polymer is of the formula

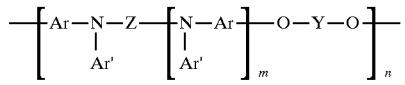

wherein (1) n is an integer representing the number of repeating units, preferably being from about 1 to about 500, and more preferably from about 50 to about 100; (2) Z is

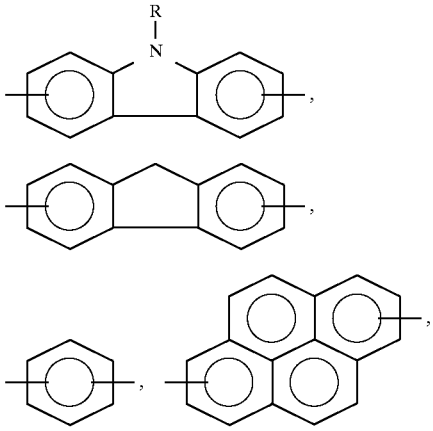
or
$-Ar-(X)_p-Ar-$
wherein p is 0 or 1; (3) Ar is
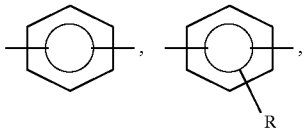
or
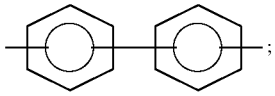
(4) R is an alkyl group selected from alkyl or isoalkyl groups containing from about 2 to about 10 carbon atoms; (5) Ar' is
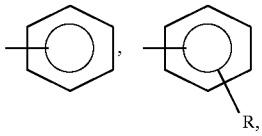
or
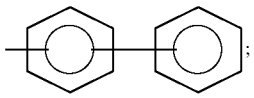
(6) X is
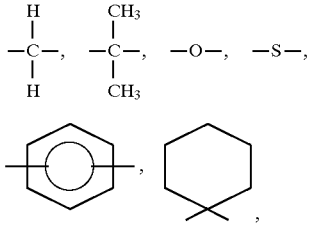
-continued
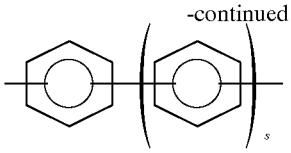
wherein s is 0, 1, or 2,
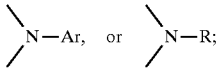
(7) m is 0 or 1; and (8) Y is
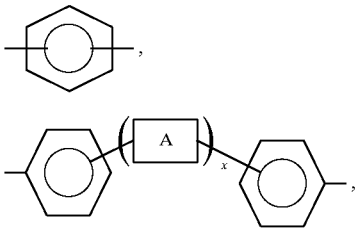
or
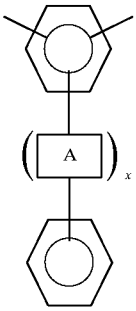
wherein x is 0 or 1 and A is
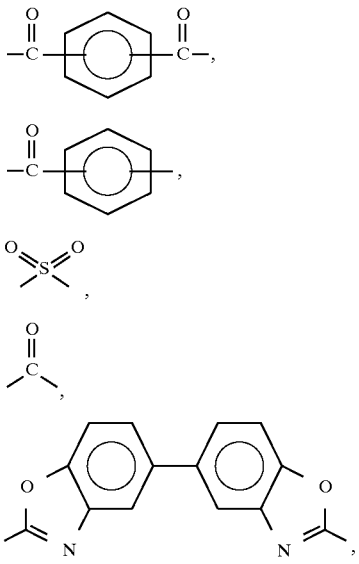

-continued

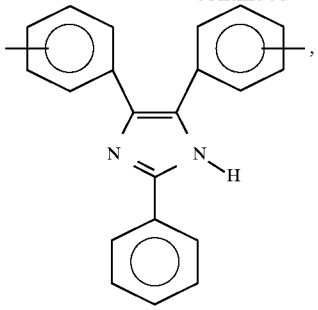

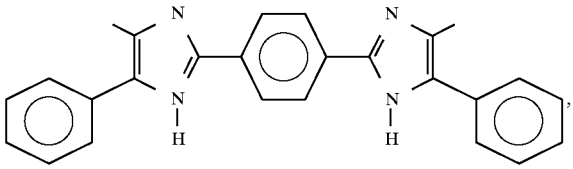

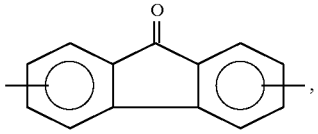

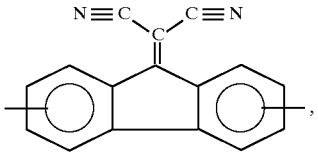

or mixtures thereof. The Ar, Ar', Z, R, X, and Y groups, the "A" group, and/or the phenyl groups attached to the "A" group can also be substituted, with examples of substituents including (but not limited to) alkyl groups, including saturated, unsaturated, and cyclic alkyl groups, preferably with from 1 to about 6 carbon atoms, substituted alkyl groups, including saturated, unsaturated, and cyclic substituted alkyl groups, preferably with from 1 to about 6 carbon atoms, aryl groups, preferably with from 6 to about 24 carbon atoms, substituted aryl groups, preferably with from 6 to about 24 carbon atoms, arylalkyl groups, preferably with from 7 to about 30 carbon atoms, substituted arylalkyl groups, preferably with from 7 to about 30 carbon atoms, alkoxy groups, preferably with from 1 to about 6 carbon atoms, substituted alkoxy groups, preferably with from 1 to about 6 carbon atoms, aryloxy groups, preferably with from 6 to about 24 carbon atoms, substituted aryloxy groups, preferably with from 6 to about 24 carbon atoms, arylalkyloxy groups, preferably with from 7 to about 30 carbon atoms, substituted arylalkyloxy groups, preferably with from 7 to about 30 carbon atoms, hydroxy groups, cyano groups, pyridine groups, pyridinium groups, ether groups, ester groups, amide groups, carbonyl groups, thiocarbonyl groups, sulfate groups, sulfonate groups, sulfide groups, sulfoxide groups, phosphate groups, sulfone groups, acyl groups, and the like, wherein two or more substituents can be joined together to form a ring, wherein the substituents on the substituted alkyl groups, substituted aryl groups, substituted arylalkyl groups, substituted alkoxy groups, substituted aryloxy groups, and substituted arylalkyloxy groups can be (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring. Examples of preferred "Y" groups include

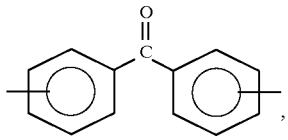

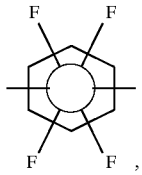

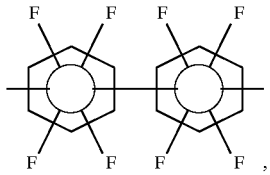

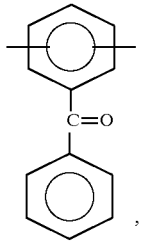

and

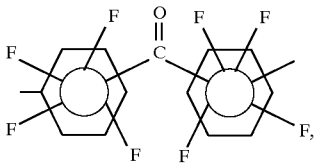

Specific examples of suitable polymer materials include those of the following formulae:

I
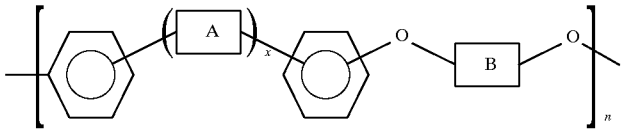
II
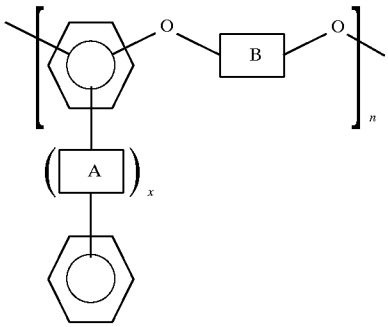
III
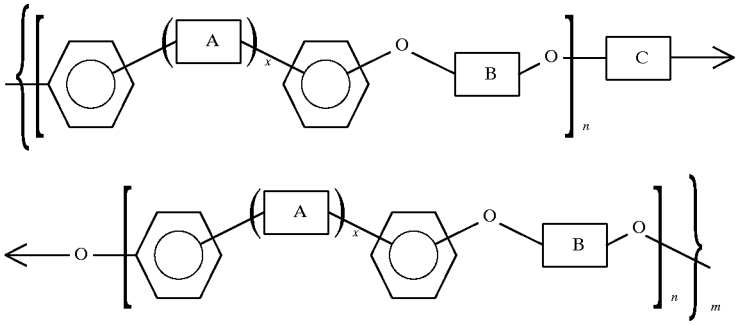
IV
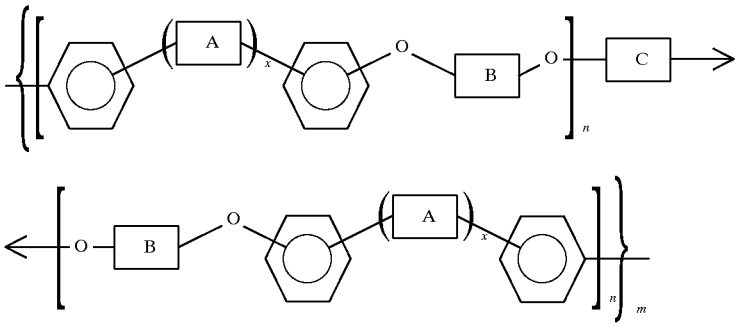
V
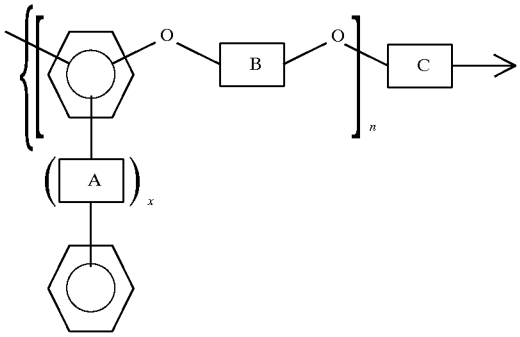

-continued
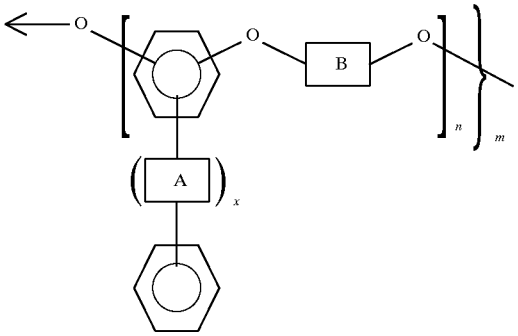
VI
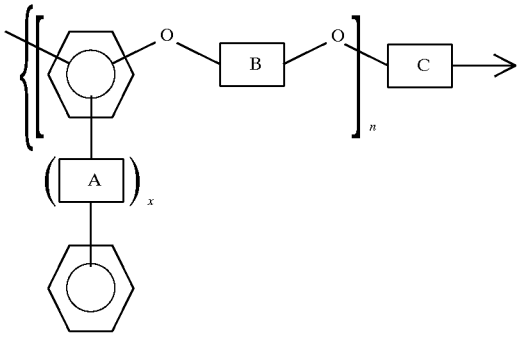
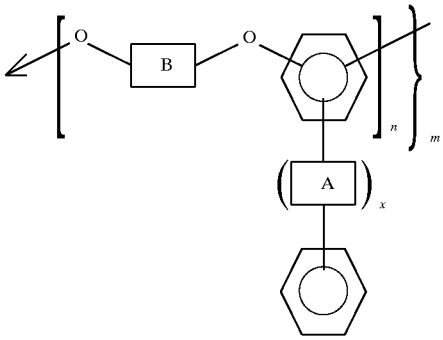
VII
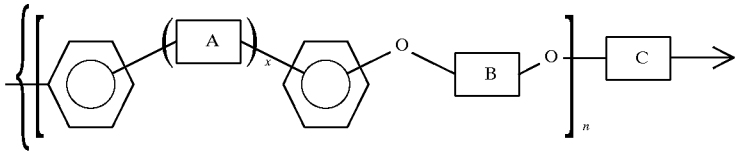
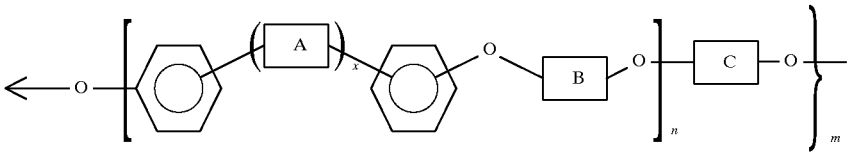
VIII
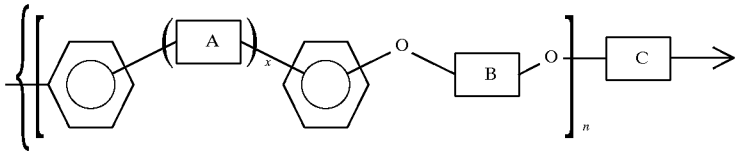
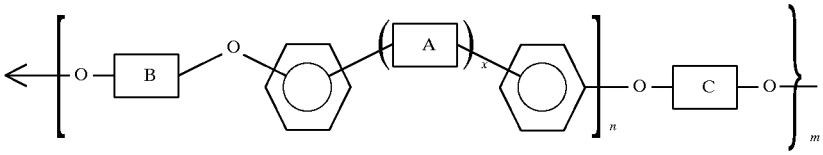

-continued
IX
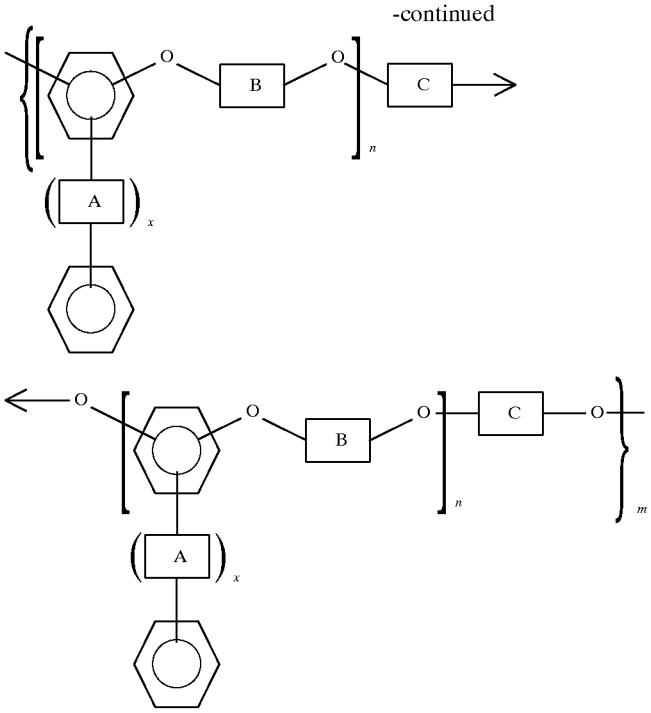
or
X
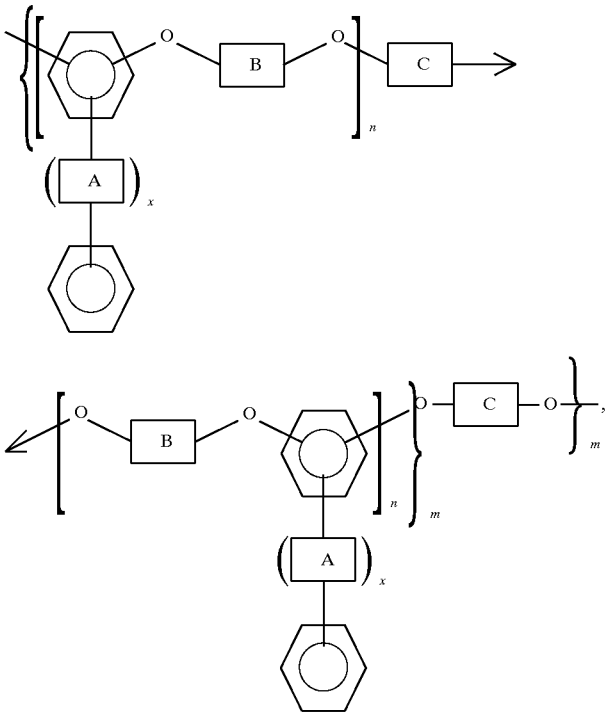
wherein x is an integer of 0 or 1, A is
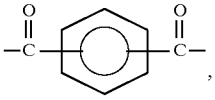
-continued
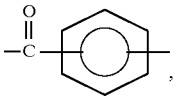
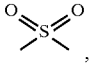

-continued
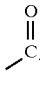
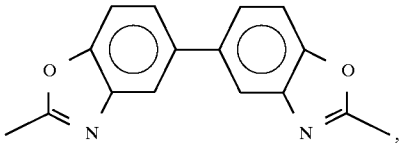
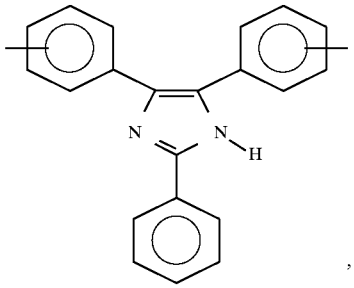
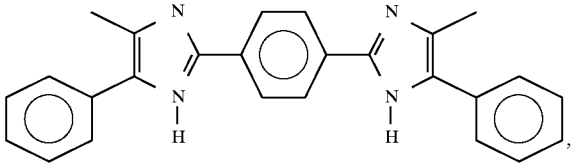
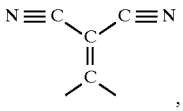
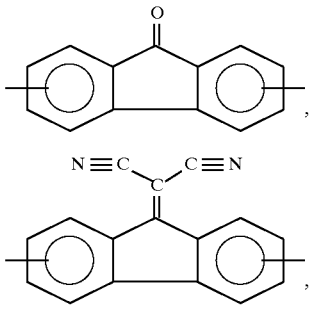
or mixtures thereof, B is
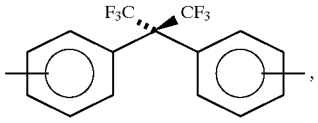
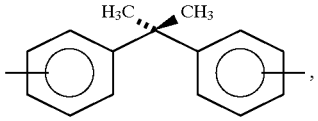
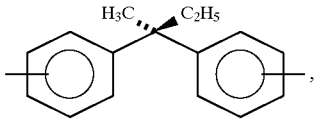
-continued
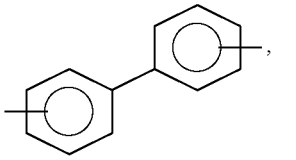
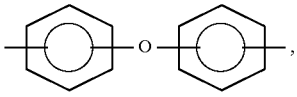
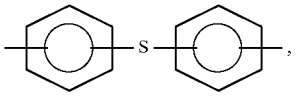
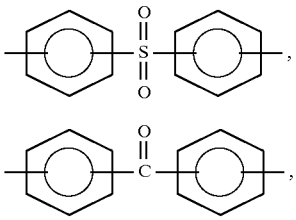
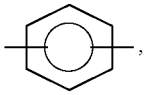
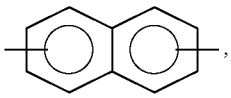
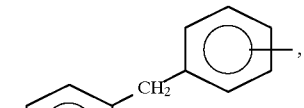
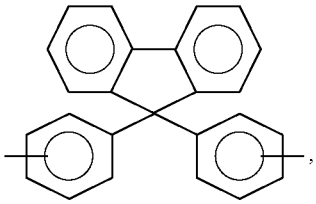
$\text{-}(CH_2)_v\text{-}$,
wherein v is an integer of from 1 to about 20, and preferably from 1 to about 10,
$\text{—}(CH_2O)_t\text{—}$
wherein t is an integer of from 1 to about 20, and preferably from 1 to about 10,
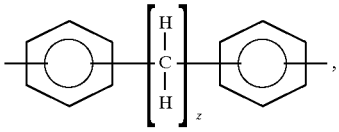
wherein z is an integer of from 2 to about 20, and preferably from 2 to about 10,

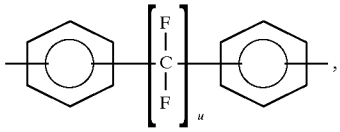
wherein u is an integer of from 1 to about 20, and preferably from 1 to about 10,
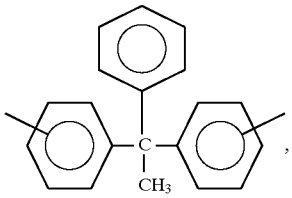
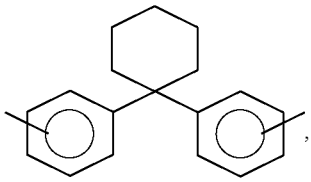
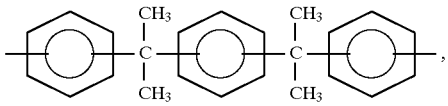
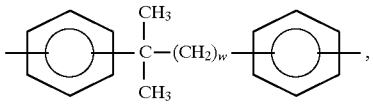
wherein w is an integer of from 1 to about 20, and preferably from 1 to about 10,
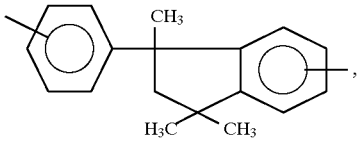
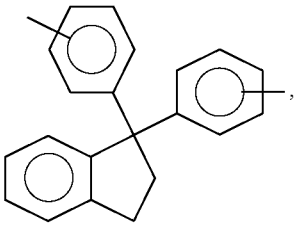
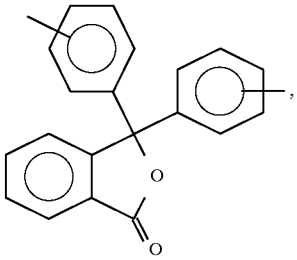
-continued
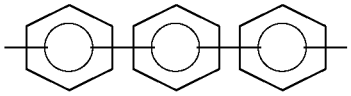
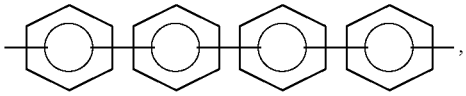
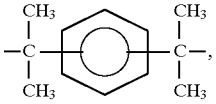
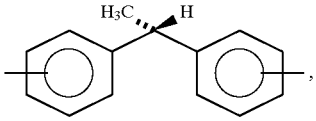
other similar bisphenol derivatives, or
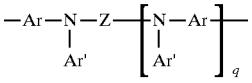
wherein (1) Z is
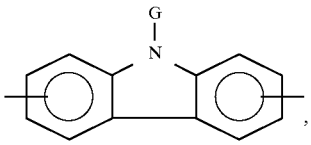
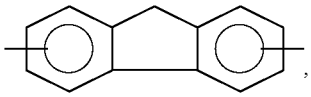
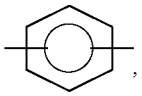
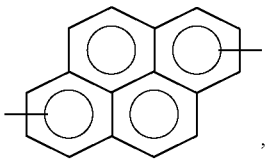
or
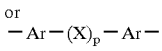
wherein p is 0 or 1; (2) Ar is
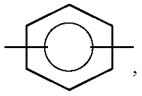
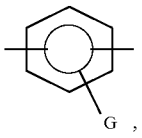
or -continued

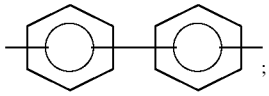

(3) G is an alkyl group selected from alkyl or isoalkyl groups containing from about 2 to about 10 carbon atoms; (4) Ar' is

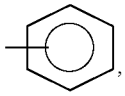

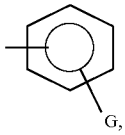

or

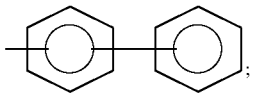

(5) X is

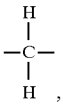

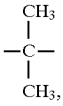

$-O-$, $-S-$,

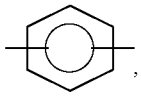

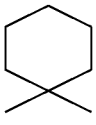

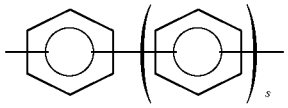

wherein s is 0, 1, or 2,

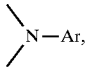

or

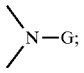

and (6) q is 0 or 1; or mixtures thereof, wherein at least some of the "B" groups are of the formula

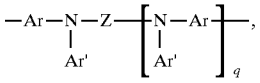

C is

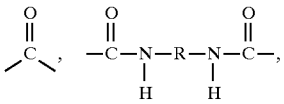

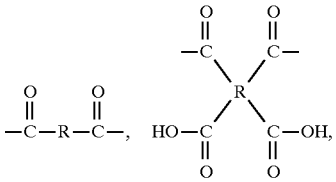

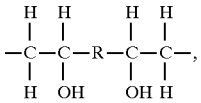

or mixtures thereof, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, and m and n are integers representing the number of repeating units.

In one preferred embodiment, the two phenyl groups around the "A" group are perfluorinated and x is 0, resulting in a polymer of the formula

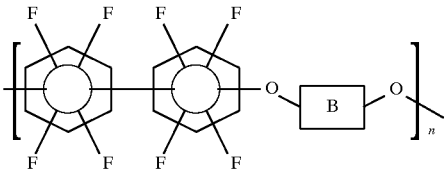

I

-continued
II
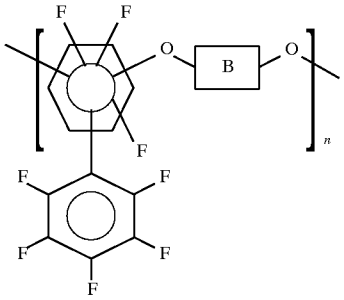
III
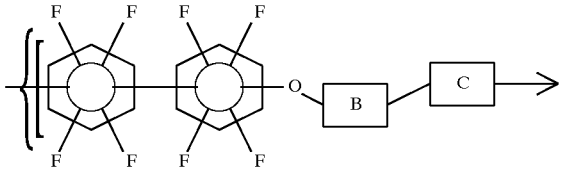
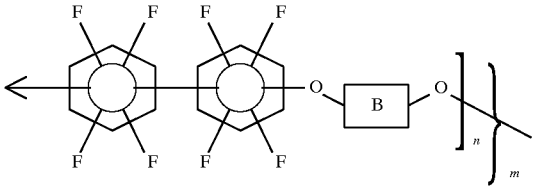
IV
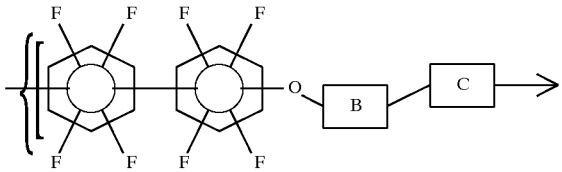
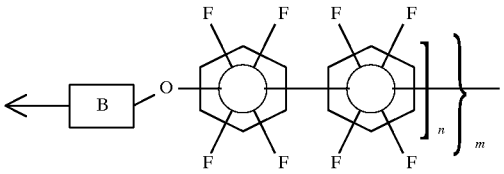
V
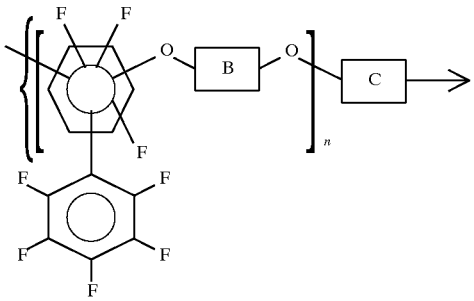
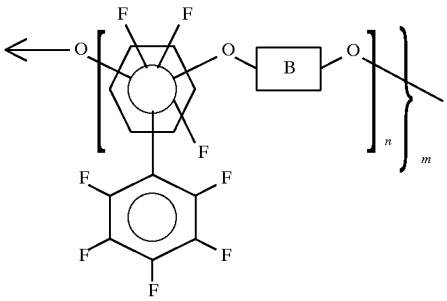

-continued
VI
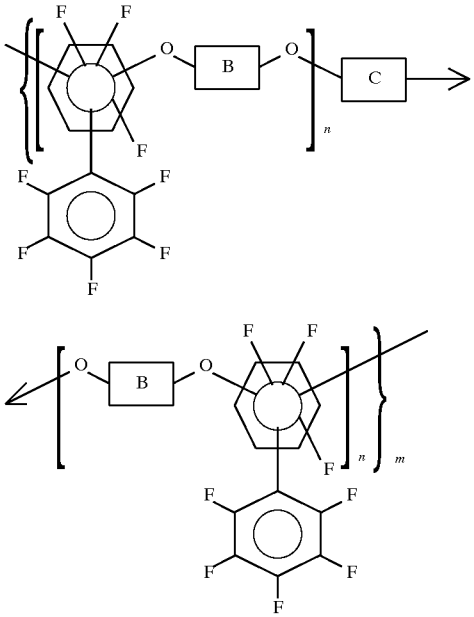
VII
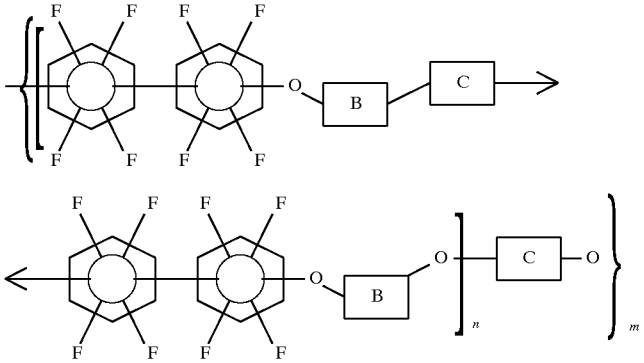
VIII
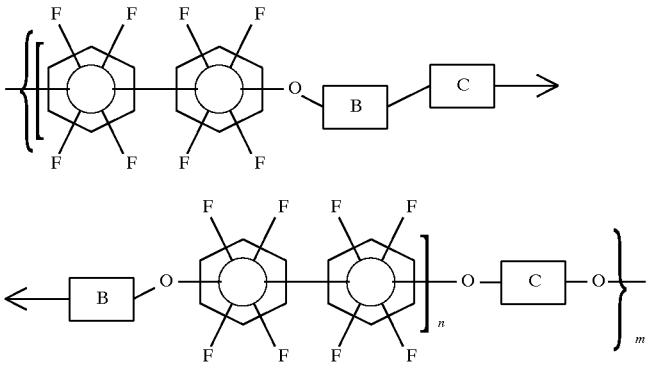
IX
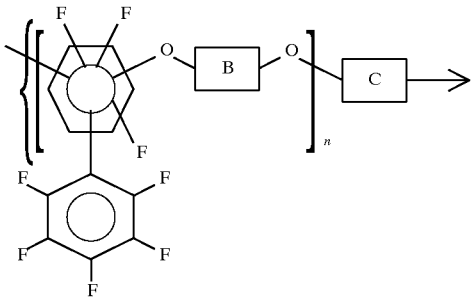

-continued
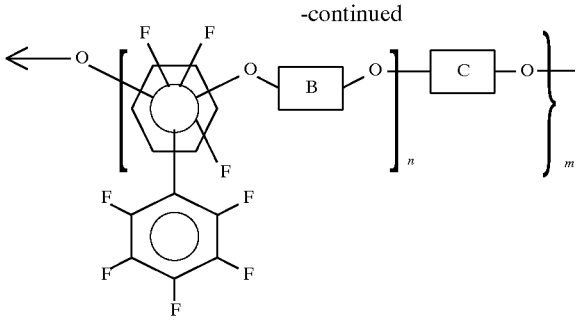
or
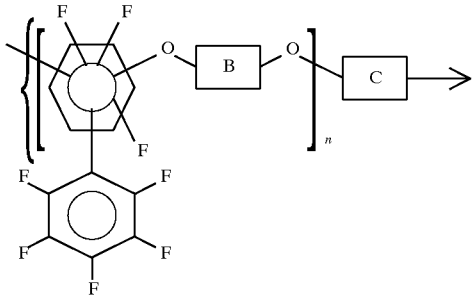
X
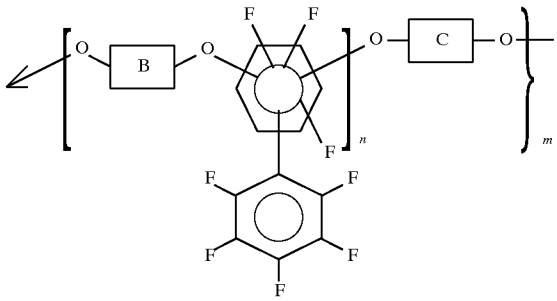
In another preferred embodiment, the two phenyl groups around the "A" group are perfluorinated, x is 1, and A is
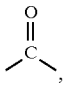
resulting in a polymer of the formula
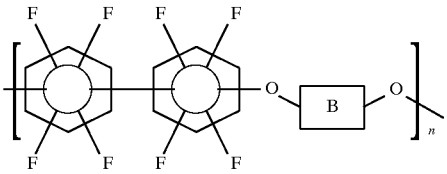
I -continued
II
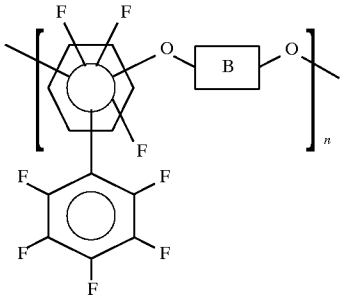
III
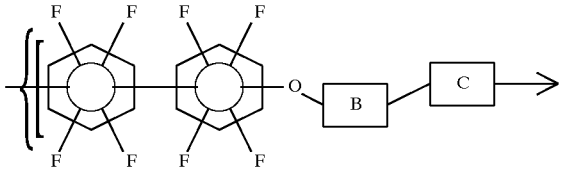
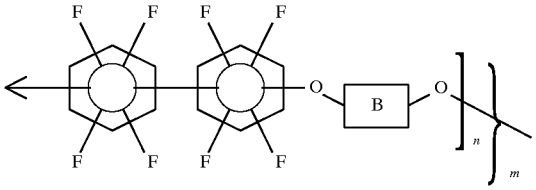
IV
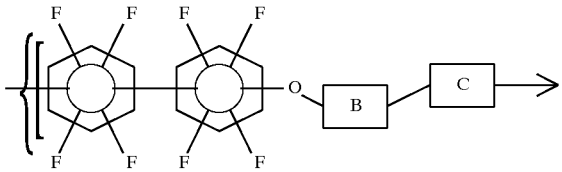
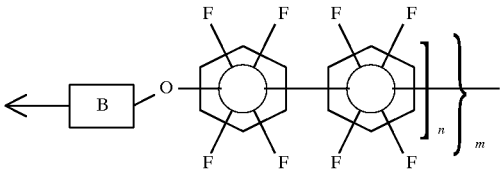
V
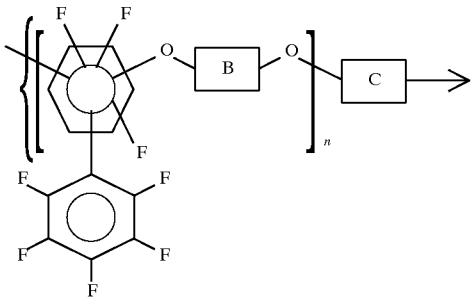
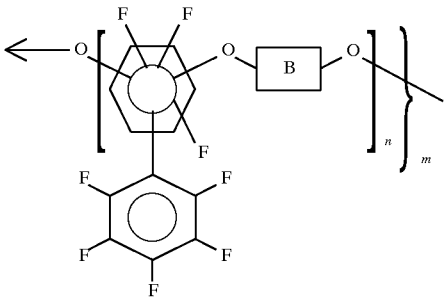

-continued
VI
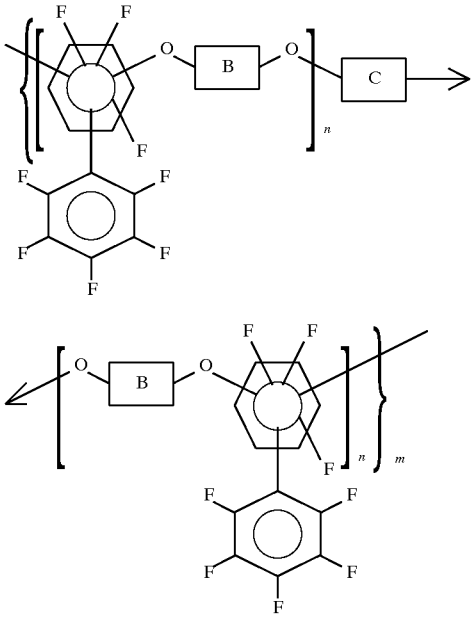
VII
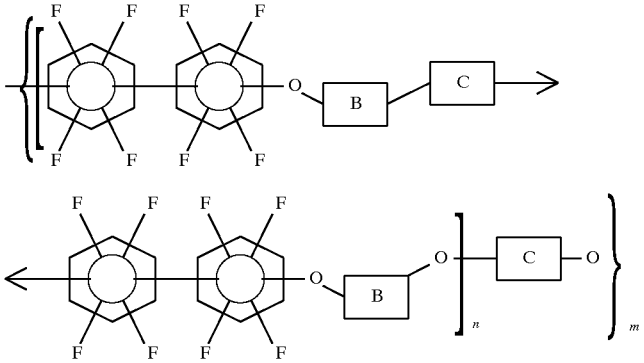
VIII
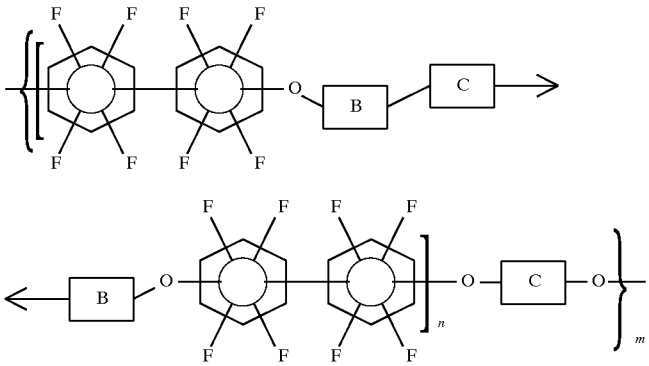
IX
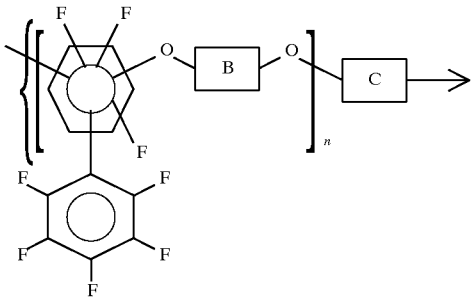

-continued

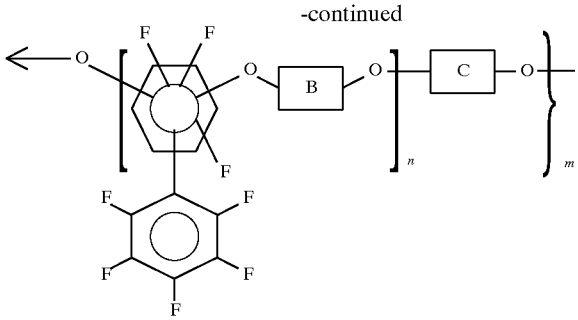

or

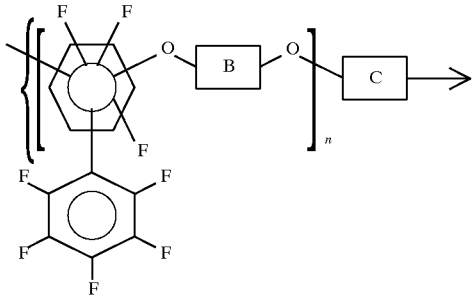

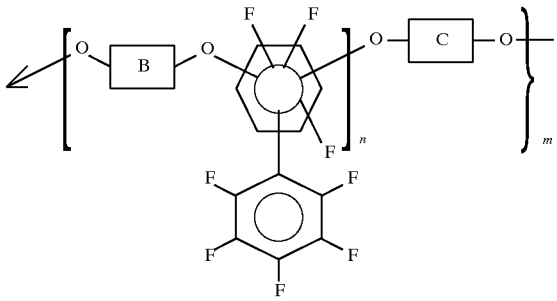

Specific examples of suitable "B" groups include

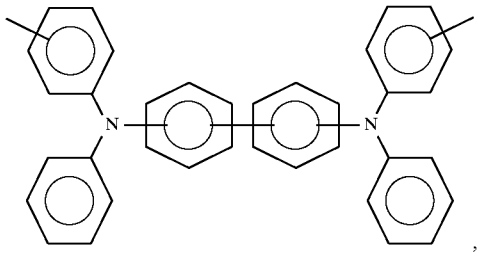

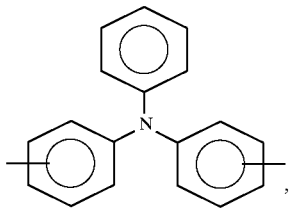

and

-continued

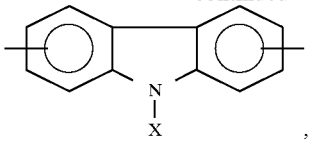

wherein X is an alkyl group (including cyclic alkyl groups and substituted alkyl groups), preferably having from 1 to about 50 carbon atoms, an aryl group (including substituted aryl groups), preferably having from 6 to about 50 carbon atoms, an arylalkyl group (including substituted arylalkyl groups), preferably having from 7 to about 50 carbon atoms, a hydroxy group, or a halogen atom, wherein the substituents on the substituted alkyl groups, substituted aryl groups, and substituted arylalkyl groups can be (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring.

The value of m and n are preferably such that the number average molecular weight of the material is from about 10,000 to about 200,000, more preferably is from about 30,000 to about 200,000, even more preferably is from about 30,000 to about 100,000, and still more preferably is from about 30,000 to about 60,000, although the $_M$ n can be outside these ranges; the weight average molecular weight of the material preferably is from about 20,000 to about 1,000,000, more preferably is from about 20,000 to about 350,000, even more preferably is from about 50,000 to about 350,000, and still more preferably is from about 100,000 to about 250,000, although the $M_w$ can be outside these ranges. The polydispersity ($M_w/M_n$) typically is from about 2 to about 9, and preferably is about 3, although higher or lower polydispersity values may also be used. The phenyl groups and the A, B, and/or C groups may also be substituted. Examples of suitable substituents include (but are not limited to) alkyl groups, including saturated, unsaturated, and cyclic alkyl groups, preferably with from 1 to about 6 carbon atoms, substituted alkyl groups, including saturated, unsaturated, and cyclic substituted alkyl groups, preferably with from 1 to about 6 carbon atoms, aryl groups, preferably with from 6 to about 24 carbon atoms, substituted aryl groups, preferably with from 6 to about 24 carbon atoms, arylalkyl groups, preferably with from 7 to about 30 carbon atoms, substituted arylalkyl groups, preferably with from 7 to about 30 carbon atoms, alkoxy groups, preferably with from 1 to about 6 carbon atoms, substituted alkoxy groups, preferably with from 1 to about 6 carbon atoms, aryloxy groups, preferably with from 6 to about 24 carbon atoms, substituted aryloxy groups, preferably with from 6 to about 24 carbon atoms, arylalkyloxy groups, preferably with from 7 to about 30 carbon atoms, substituted arylalkyloxy groups, preferably with from 7 to about 30 carbon atoms, hydroxy groups, cyano groups, pyridine groups, pyridinium groups, ether groups, ester groups, amide groups, carbonyl groups, thiocarbonyl groups, sulfate groups, sulfonate groups, sulfide groups, sulfoxide groups, phosphate groups, sulfone groups, acyl groups, and the like, wherein two or more substituents can be joined together to form a ring, wherein the substituents on the substituted alkyl groups, substituted aryl groups, substituted arylalkyl groups, substituted alkoxy groups, substituted aryloxy groups, and substituted arylalkyloxy groups can be (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring. The polymers preferably have a glass transition temperature of from about 50° to about 300° C., and more preferably from about 150° to about 260° C., although the $T_g$ can be outside these ranges. Processes for the preparation of similar polymeric materials (that do not contain the specific charge-transporting "B" groups but which are prepared by similar processes) are known, and disclosed in, for example, P. M. Hergenrother et al., "Poly (arylene ethers)", *Polymer,* Vol. 29, 358 (1988); S. J. Havens et al., "Ethynyl-Terminated Polyarylates: Synthesis and Characterization,"*Journal of Polymer Science, Polymer Chemistry Edition,* Vol. 22, 3011 (1984); B. J. Jensen and P. M. Hergenrother, "High Performance Polymers," Vol. 1, No. 1) page 31 (1989); "Synthesis and characterization of New Fluorescent Poly(arylene ethers)," S. Matsuo, N. Yakoh, S. Chino, M. Mitani, and S. Tagami, *Journal of Polymer Science: Part A: Polymer Chemistry,* 32, 1071 (1994); "Synthesis of a Novel Naphthalene-Based Poly(arylene ether ketone) with High Solubility and Thermal Stability," Mami Ohno, Toshikazu Takata, and Takeshi Endo, *Macromolecules,* 27, 3447 (1994); G. Hougham, G. Tesoro, and J. Shaw, *Polym. Mater. Sci. Eng.,* 61, 369 (1989); "Synthesis and Characterization of New Aromatic Poly (ether ketones)," F. W. Mercer, M. T. Mckenzie, G. Merlino, and M. M. Fone, *J. of Applied Polymer Science,* 56, 1397 (1995); K. E. Dukes, M. D. Forbes, A. S. Jeevarajan, A. M. Belu, J. M. DeDimone, R. W. Linton, and V. V. Sheares, *Macromolecules,* 29, 3081 (1996); H. C. Zhang, T. L. Chen, Y. G. Yuan, Chinese Patent CN 85108751 (1991); "Static and laser light scattering study of novel thermoplastics. 1. Phenolphthalein poly(aryl ether ketone)," C. Wu, S. Bo, M. Siddiq, G. Yang and T. Chen, *Macromolecules,* 29, 2989 (1996); the disclosures of each of which are totally incorporated herein by reference.

While not required, it may be advantageous with respect to the ultimate properties of the polymer if the polymer is end-functionalized with a specifically selected group. In some instances, the terminal groups on the polymer can be selected by the stoichiometry of the polymer synthesis. For example, when a polymer similar to those of the present invention is prepared by the reaction of 4,4'-dichlorobenzophenone and bis-phenol A in the presence of potassium carbonate in N,N-dimethylacetamide, if the bis-phenol A is present in about 7.5 to 8 mole percent excess, the resulting polymer generally is bis-phenol A-terminated (wherein the bis-phenol A moiety may or may not have one or more hydroxy groups thereon). In contrast, if the 4,4'-dichlorobenzophenone is present in about 7.5 to 8 mole percent excess, the reaction time is approximately half that required for the bis-phenol A excess reaction, the resulting polymer generally is benzophenone-terminated (wherein the benzophenone moiety may or may not have one or more chlorine atoms thereon). Similarly, when a polymer similar to those of the present invention is prepared by the reaction of 4,4'-difluorobenzophenone with either 9,9'-bis(4-hydroxyphenyl)fluorene or bis-phenol A in the presence of potassium carbonate in N,N-dimethylacetamide, if the 4,4'-difluorobenzophenone reactant is present in excess, the resulting polymer generally has benzophenone terminal groups (which may or may not have one or more fluorine atoms thereon). The well-known Carothers equation can be employed to calculate the stoichiometric offset required to obtain the desired molecular weight. (See, for example, William H. Carothers, "An Introduction to the General Theory of Condensation Polymers," *Chem. Rev.,* 8, 353 (1931) and *J. Amer. Chem. Soc.,* 51, 2548 (1929); see also P. J. Flory, *Principles of Polymer Chemistry,* Cornell University Press, Ithaca, N.Y. (1953); the disclosures of each of which are totally incorporated herein by reference.) More generally speaking, during the preparation of polymers such as those of the formula

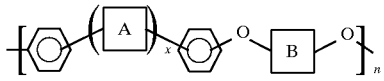

and the other formulae of the present invention, the stoichiometry of the polymer synthesis reaction can be adjusted so that the end groups of the polymer are derived from the "A" groups or derived from the "B" groups. Specific functional groups can also be present on these terminal "A" groups or "B" groups, such as hydroxy groups which are attached to the aromatic ring on an "A" or "B" group to form a phenolic moiety, halogen atoms which are attached to the "A" or "B" group, or the like.

Polymers with end groups derived from the "A" group, such as benzophenone groups or halogenated benzophenone groups, may be preferred for some applications because both the syntheses and some of the reactions of these materials to place substituents thereon may be easier to control and may yield better results with respect to, for example, cost, molecular weight, molecular weight range, and polydispersity ($M_w/M_n$) compared to polymers with end groups derived from the "B" group.

Terminal hydroxy or halide groups on the polymer can also be further reacted. For example, a polymer with halide terminal groups can be reacted in the presence of potassium carbonate with phenol to replace the -F terminal groups with -ϕ groups. Similarly, a polymer with hydroxy terminal groups can be reacted with a quaternary ammonium salt of the formula $NR_1R_2R_3R_4$, wherein $R_1$, $R_2$, $R_3$, and $R_4$ each, independently of the others, are alkyl groups, preferably with from 1 to about 50 carbon atoms, aryl groups, preferably with from 6 to about 50 carbon atoms, arylalkyl groups, preferably with from 7 to about 50 carbon atoms, or substituted alkyl, aryl, or arylalkyl groups, in the presence of a base such as sodium hydroxide in water and methylene chloride at temperatures typically from about 20° to about 60° C., to replace the hydroxy groups with the corresponding alkoxy groups.

In addition, oligomers can be reacted with coupling agents to generate polymers of the formulae indicated herein. The general reaction scheme, illustrated below wherein polymers of formula I are coupled to form polymers of formula III or IV, is as follows:

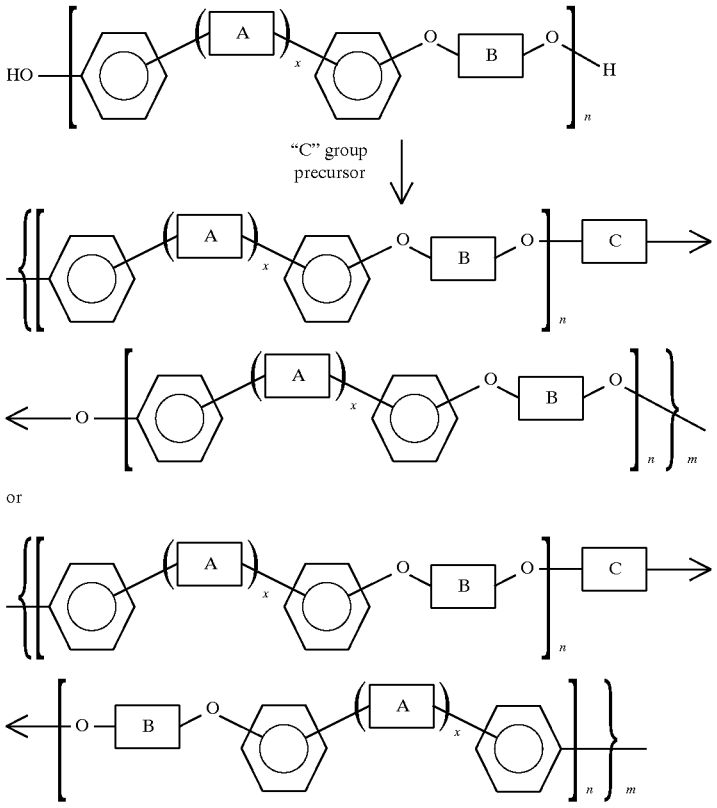

wherein m is an integer of at least 1 and represents the number of repeating units. The value of m is such that the resulting coupled polymer can be dissolved into a solvent and coated onto an imaging member. Preferably, m is such that the weight average molecular weight of the polymer is under about 300,000, and more preferably under about 150,000.

Examples of suitable "C" groups include those based on polycarbonates, wherein "C" is

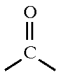

and the polymer thus contains a

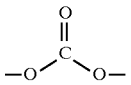

linkage, those based on polyurethanes and polyisocyanates, wherein "C" is of the general formula

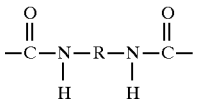

and the polymer thus contains a

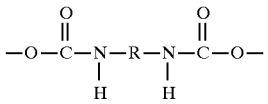

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on polyesters, wherein "C" is of the general formula

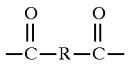

the polymer thus contains a

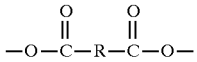

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on dianhydrides, wherein "C" is of the general formula

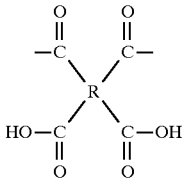

and the polymer thus contains a

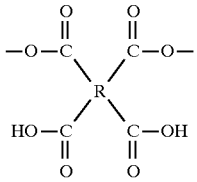

linkage, wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, those based on diepoxies, wherein "C" is of the general formula

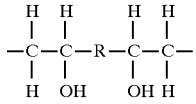

and the polymer thus contains a

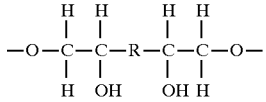

wherein R is an alkyl group, including cyclic and substituted alkyl groups and polymeric groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof, and the like. For all of the above "R" groups, examples of suitable substituents include (but are not limited to) alkoxy groups, preferably with from 1 to about 6 carbon atoms, aryloxy groups, preferably with from 6 to about 24 carbon atoms, arylalkyloxy groups, preferably with from 7 to about 30 carbon atoms, hydroxy groups, halogen atoms, ammonium groups, cyano groups, pyridine groups, pyridinium groups, nitrile groups, mercapto groups, nitroso groups, nitro groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, sulfone groups, phosphine groups, phosphonium groups, phosphate groups, acyl groups, and the like, wherein two or more substituents can be joined together to form a ring.

For example, a hydroxy-terminated oligomer can be reacted with phosgene or the equivalent thereof (such as lithium hydride and diphenyl carbonate, or

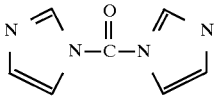

or

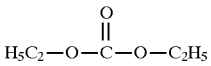

or

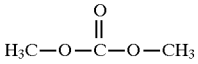

or the like) to couple the oligomers with polycarbonate groups, illustrated below wherein polymers of formula I are coupled to form polymers of formula III or IV as follows:

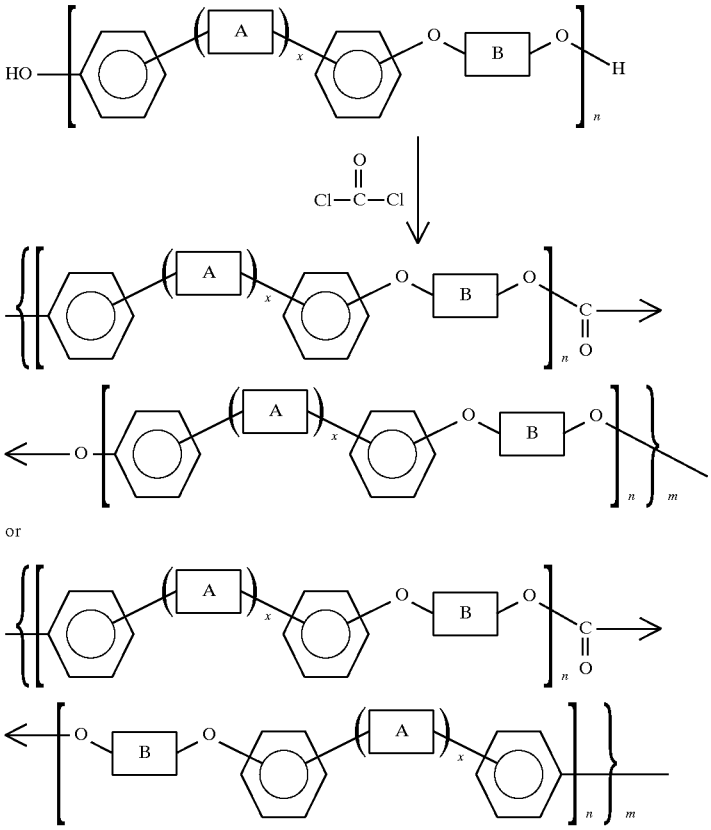

Conditions for this condensation reaction with a polymer of the specific formulae indicated herein are similar for those employed for the reaction of bis-phenol A with phosgene, as disclosed in, for example, W. R. Sorenson and T. W. Campbell, *Preparative Methods of Polymer Chemistry,* 2nd Edition, John Wiley & Sons (New York 1961, 1968), the disclosure of which is totally incorporated herein by reference, at, for example, pages 122, 123, 140, and 141.

In another example, a hydroxy-terminated oligomer can be reacted with a diisocyanate (one molar equivalent of isocyanate group per molar equivalent of hydroxy group) to couple the oligomers with isocyanate groups, illustrated below wherein polymers of formula I are coupled to form polymers of formula III or IV as follows:

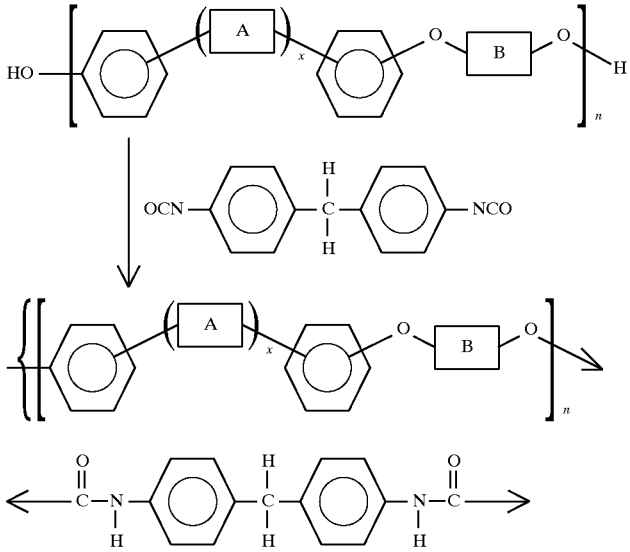

-continued

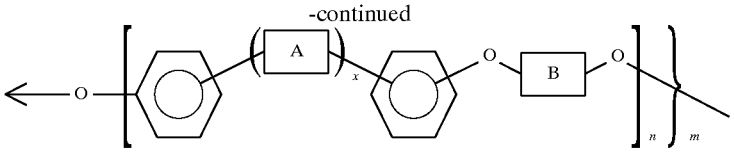

or

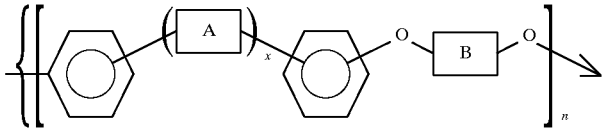

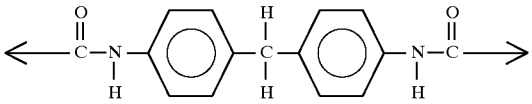

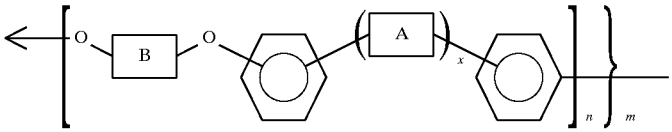

Other specific examples of suitable diisocyanate reactants (typically of the general formula

O=C=N—R—N=C=O wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof) include toluene diisocyanate, of the formula

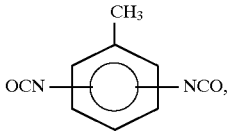

trimethylol propane toluene diisocyanate adducts, such as CB-75, commercially available from Mobay Chemical Co., Pittsburgh, Pa., of the formula

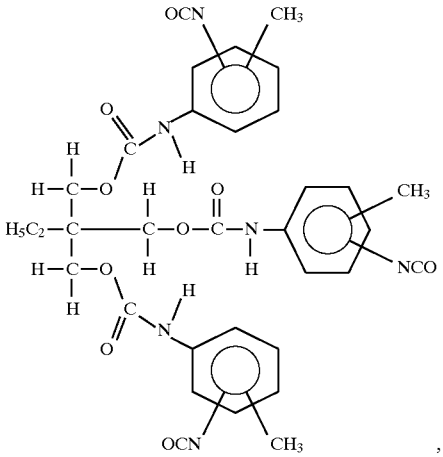

pentaerythritol toluene diisocyanate adducts, such as that of the formula

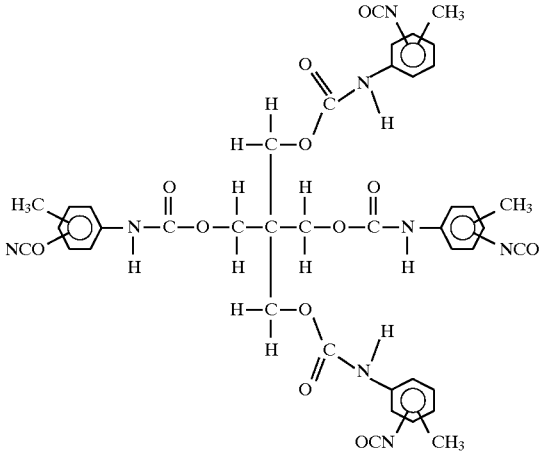

commercially available from Hoechst-Celanese Corp., and the like. The di-isocyanate (1 equivalent of isocyanate groups) can be mixed with the hydroxy terminated oligomer (1 equivalent of hydroxy groups) in methylene chloride solution at 25° C., followed by coating the reaction mixture as rapidly as possible. The films chain-extend on standing. The films are then dried by heating to 90° C. to remove the solvent. Above this temperature, thermally reversing of the reaction may occur.

In another example, a hydroxy-terminated oligomer can be reacted with a diester, diacid chloride, or dianhydride (one molar equivalent of ester, acid chloride, or anhydride group per molar equivalent of hydroxy group) to couple the oligomers with ester, acid chloride, or anhydride groups, illustrated below wherein polymers of formula I are coupled to form polymers of formula III or IV as follows:

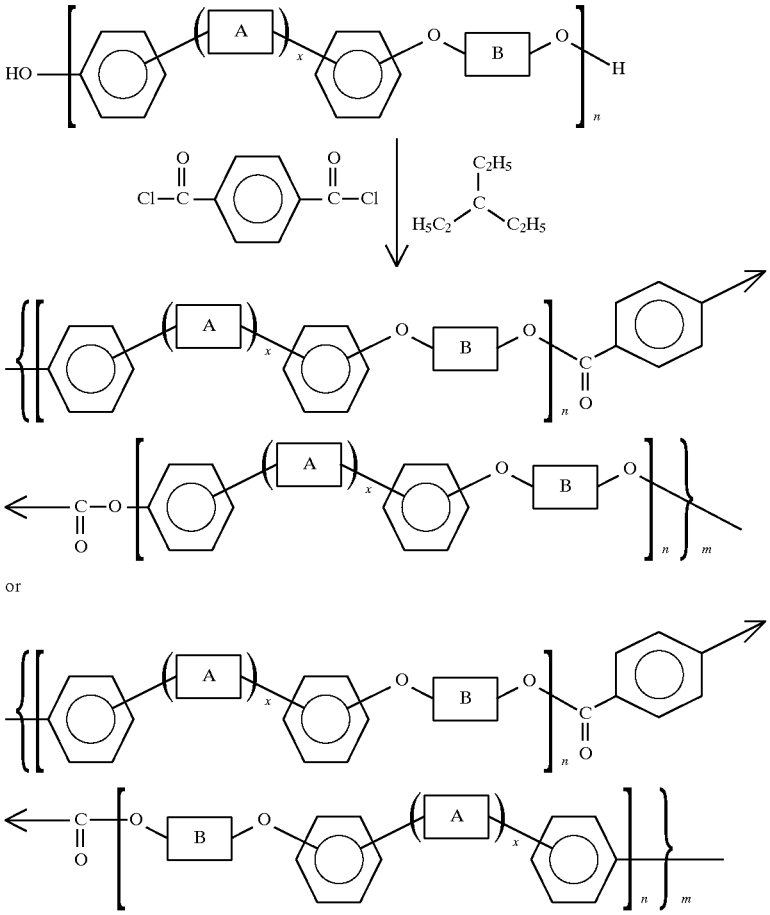

Typical diester and diacid chloride reactants are of the general formulae

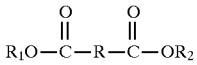

and

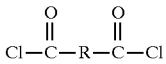

wherein R, $R_1$, and $R_2$ are each, independently from the others, alkyl groups, including cyclic and substituted alkyl groups, preferably with from 1 to about 30 carbon atoms, aryl groups, including substituted aryl groups, preferably with from 6 to about 30 carbon atoms, or arylalkyl groups, including substituted arylalkyl groups, preferably with from 7 to about 30 carbon atoms, or mixtures thereof. Typical dianhydride reactants are of the general formula

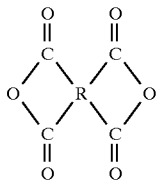

wherein R is an alkyl group, including cyclic and substituted alkyl groups, preferably with from 1 to about 30 carbon atoms, an aryl group, including substituted aryl groups, preferably with from 6 to about 30 carbon atoms, or an arylalkyl group, including substituted arylalkyl groups, preferably with from 7 to about 30 carbon atoms, or mixtures thereof. The hydroxy-terminated oligomer films are heated with the diester, diacid chloride, or dianhydride (phthalic acid diester or di-anhydride, for example) up to 150° C. for about 30 minutes to chain-extend the polymer.

In another example, a hydroxy-terminated oligomer can be reacted with a diepoxy compound or a dianhydride to couple the oligomers with epoxy group derivatives, illustrated below wherein polymers of formula I are coupled to form polymers of formula III or IV as follows:

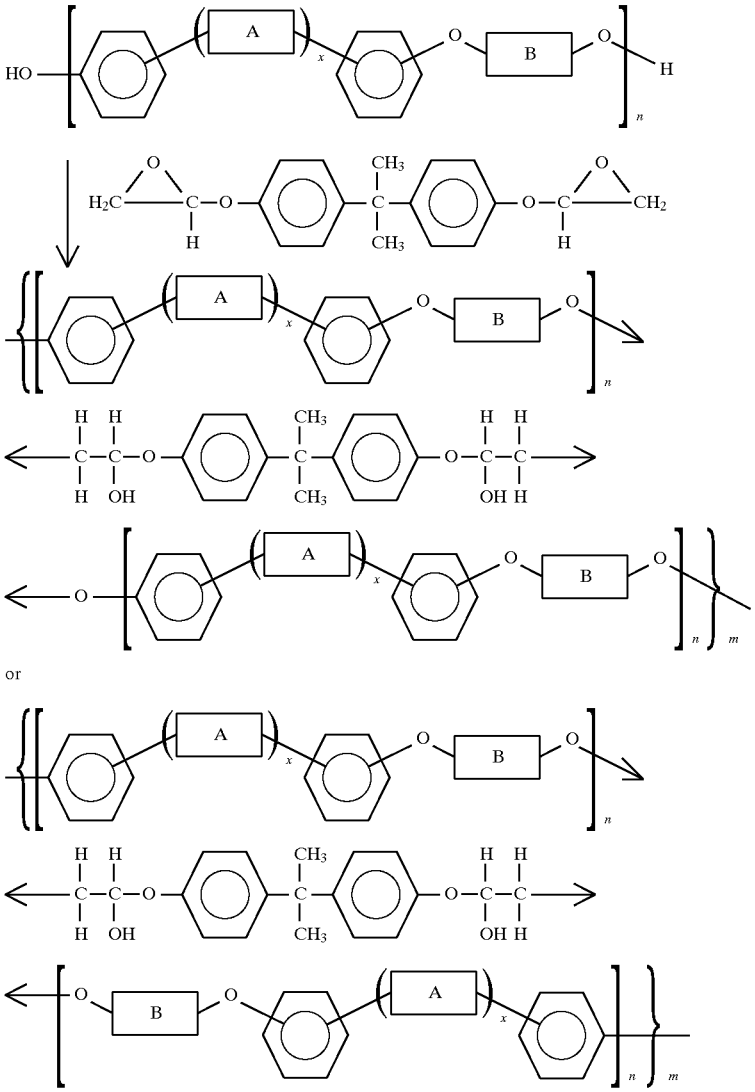

Typical diepoxy reactants are of the general formula

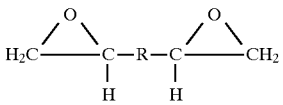

wherein R, $R_1$, and $R_2$ are each, independently from the others, alkyl groups, including cyclic and substituted alkyl groups, preferably with from 1 to about 30 carbon atoms, aryl groups, including substituted aryl groups, preferably with from 6 to about 30 carbon atoms, or arylalkyl groups, including substituted arylalkyl groups, preferably with from 7 to about 30 carbon atoms, or mixtures thereof. R can also be polymeric, and the resulting diepoxy can be a monomer or a polymer. Specific suitable diepoxy reactants include those where R is

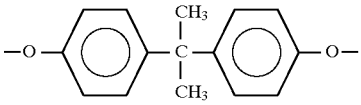

such as EPON® 828 resin, commercially available from Shell Oil Co., Houston, Tex., those where R is

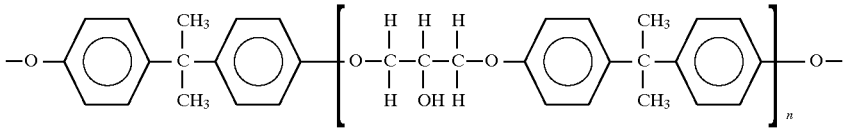

wherein n represents the number of repeat monomer units and typically is from about 1 to about 26, such as the other resins in the EPON® series, those where R is

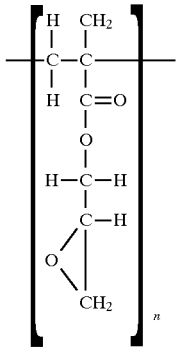

wherein n represents the number of repeat monomer units and typically is from about 1 to about 26, commercially available from Aldrich Chemical Co., Milwaukee, Wis., and the like. The hydroxy terminated oligomer films are heated with the epoxy resin (EPON 828) and a dianhydride or triethylamine (10 weight percent) to chain-extend the polymer at 135° C. for 30 minutes.

Polymers of the general formula

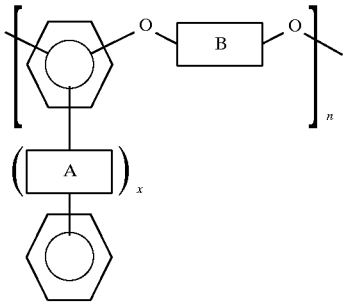

can also be coupled by these methods, and polymers of formulae IV, V, VI, VII, VIII, IX, and X can also be prepared by these methods.

A charge transport molecule is incorporated into the polymer chain. The resulting polymer exhibits charge transport characteristics in addition to being a suitable binder material. In one specific example, a charge transport molecule is incorporated into a polymer chain, said charge transport molecule being of the formula

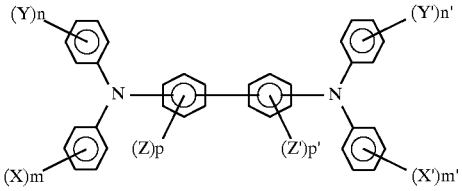

wherein X, X', Y, Y', Z, and Z' are each, independently of the others, alkyl groups (including linear, branched, cyclic, saturated, and unsaturated alkyl groups), either substituted or unsubstituted, preferably having from 1 to about 20 carbon atoms, aryl groups, either substituted or unsubstituted preferably having from 6 to about 24 carbon atoms, arylalkyl groups, either substituted or unsubstituted, preferably having from 7 to about 30 carbon atoms, hydroxy groups, or halogen atoms (such as fluorine, chlorine, bromine, or iodine), m, m', n, n', p, and p' are each, independently of the others, integers of 0, 1, 2, 3, 4, or 5, and wherein at least one of m, m', n, n', p, or p' is equal to or greater than 1. Examples of suitable substituents on the substituted alkyl, aryl, and arylalkyl groups include (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring. These functional groups should not interfere with hole transport mechanisms. The material can be prepared by any desired or suitable process. For example, a low molecular weight oligomer can be synthesized by the reaction of di-m-hydroxytolyl-diphenylbiphenyldiamine and the desired "A" group monomer precursor (such as, for example, difluorobenzophenone or the like) with potassium carbonate, optionally followed by coupling of the oligomers by any desired method, such as reaction with phosgene or with 1,6-diisocyanatohexane. One example of a suitable oligomer-forming reaction is as follows:

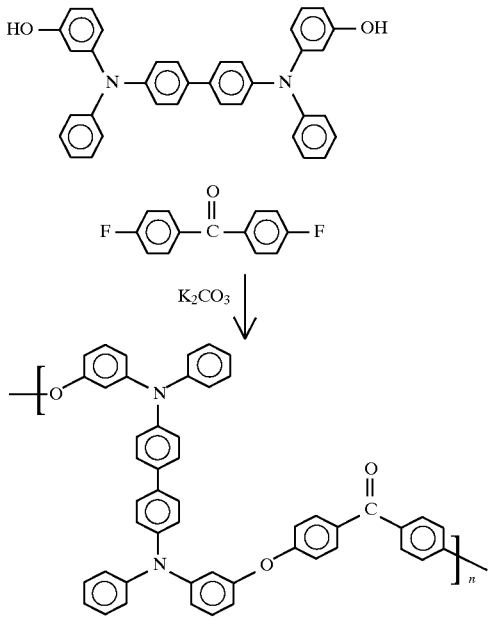

wherein the resulting oligomer has carbonyl "A" groups and ditolyldiphenylbiphenyldiamine "B" groups. Subsequent reaction with a "C" group precursor couples the oligomers into polymers, as illustrated below for the phosgene coupling:

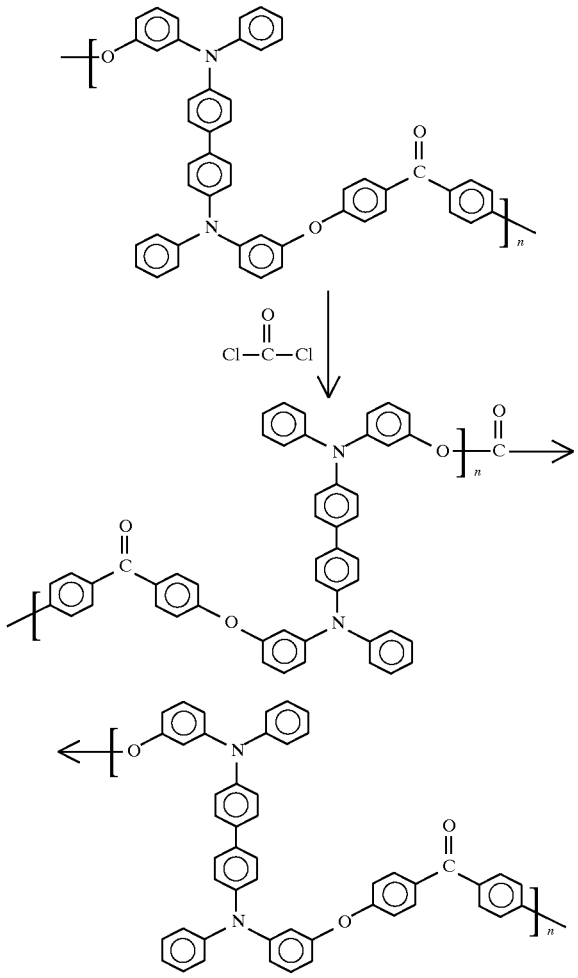

Other charge transport molecules which can be incorporated into the polymer chain by similar methods include triarylamines, such as those of the formula

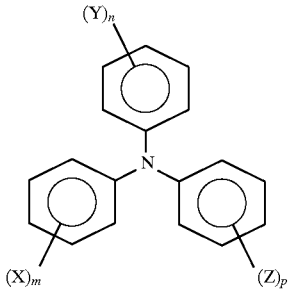

wherein X, Y, and Z are each, independently of the others, alkyl groups (including linear, branched, cyclic, saturated, and unsaturated alkyl groups), either substituted or unsubstituted, preferably having from 1 to about 50 carbon atoms and more preferably from 1 to about 20 carbon atoms, aryl groups, either substituted or unsubstituted, preferably having from 6 to about 24 carbon atoms, arylalkyl groups, either substituted or unsubstituted, preferably having from 7 to about 30 carbon atoms, hydroxy groups, or halogen atoms (such as fluorine, chlorine, bromine, or iodine), m, n, and p are each, independently of the others, integers of 0, 1, 2, 3, 4, or 5, and the like, as disclosed in, for example, U.S. Pat. No. 3,240,597 and U.S. Pat. No. 3,180,730, the disclosures of each of which are totally incorporated herein by reference. Examples of suitable substituents on the substituted alkyl, aryl, and arylalkyl groups include (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring.

Other charge transport molecules which can be incorporated into the polymer chain include carbazoles, such as those of the formula

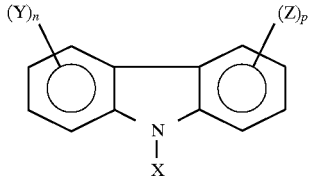

wherein X, Y, and Z are each, independently of the others, alkyl groups (including linear, branched, cyclic, saturated, and unsaturated alkyl groups), either substituted or unsubstituted, preferably having from 1 to about 50 carbon atoms and more preferably from 1 to about 20 carbon atoms, aryl groups, either substituted or unsubstituted, preferably having from 6 to about 24 carbon atoms, arylalkyl groups, either substituted or unsubstituted, preferably having from 7 to about 30 carbon atoms, hydroxy groups, or halogen atoms (such as fluorine, chlorine, bromine, or iodine), n and p are each, independently of the others, integers of 0, 1, 2, 3, or 4, and the like, as disclosed in, for example, U.S. Pat. No. 3,598,582 (Herrick), the disclosure of which is totally incorporated herein by reference. Examples of suitable substituents on the substituted alkyl, aryl, and arylalkyl groups include (but are not limited to) hydroxy groups, ammonium groups, cyano groups, pyridine groups, pyridinium groups, ether groups, aldehyde groups, ketone groups, ester groups, amide groups, carboxylic acid groups, carbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, mixtures thereof, and the like, wherein two or more substituents can be joined together to form a ring.

Other layers, such as conventional electrically conductive ground strip along one edge of the belt in contact with the conductive layer, blocking layer, adhesive layer or charge generating layer to facilitate connection of the electrically conductive layer of the photoreceptor to ground or to an electrical bias, may also be included. Ground strips are well known and usually comprise conductive particles dispersed in a film forming binder.

Optionally, an overcoat layer may also be utilized to improve resistance to abrasion. In some cases an anti-curl back coating may be applied to the surface of the substrate opposite to that bearing the photoconductive layer to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. The total forces are substantially balanced when the belt has no noticeable tendency to curl after all the layers are dried. For example, for an electrophotographic imaging member in which the bulk of the coating thickness on the photoreceptor side of the imaging member is a transport layer containing predominantly polycarbonate resin and having a thickness of about 24 microns on a Mylar substrate having a thickness of about 76 microns, sufficient balance of forces can be achieved with a 13.5 micrometers thick anti-curl layer containing about 99 percent by weight polycarbonate resin, about 1 percent by weight polyester and between about 5 and about 20 percent of coupling agent treated crystalline particles. An example of an anti-curl backing layer is described in U.S. Pat. No. 4,654,284 the disclosure of which is totally incorporated herein by reference. A thickness between about 70 and about 160 microns is a satisfactory range for flexible photoreceptors.

The present invention also encompasses a method of generating images with the photoconductive imaging members disclosed herein. The method comprises the steps of generating an electrostatic latent image on a photoconductive imaging member of the present invention, developing the latent image, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased charging roll. The fixing step may be performed by means of any suitable method, such as radiant flash fusing, heat fusing, pressure fusing, vapor fusing, and the like. Any material used in xerographic copiers and printers may be used as a substrate, such as paper, transparency material, or the like.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A molecule of the formula

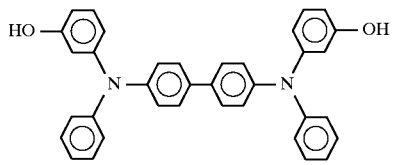

was prepared as follows.

A. Preparation of m-methoxy acetanilide:

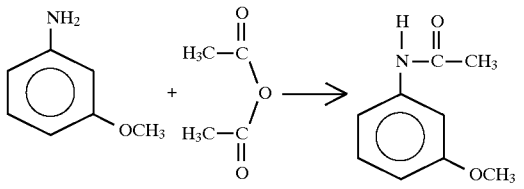

Into a 5-liter, 3-necked round bottom flask equipped with a mechanical stirrer, argon inlet equipped with a thermometer, and condenser were added 1006 grams of m-anisidine (obtained from Aldrich Chemical Co., Milwaukee, Wis.), 777.5 milliliters of glacial acetic acid, and 8 grams of zinc dust while argon was introduced into the flask. The contents of the flask were heated to 70° C., followed by removal of the heating mantle and replacement of the condenser with an addition funnel containing 777.5 milliliters of acetic anhydride. The acetic anhydride was added over 40 minutes at a rate so as to maintain a mild reflux. When addition of the acetic anhydride was complete, the addition funnel was removed and replaced with the condenser, followed by replacement of the heating mantle and heating the flask contents to reflux at a temperature of 126° C. Reflux was maintained for an additional 3 hours.

Thereafter, a 4 liter beaker was charged with 2.5 liters of deionized water and stirred intermittently as about one half (approximately 1,250 milliliters) of the contents of the round bottom flask was poured slowly into the water. The initial pour rate was slow, until the stirred water mixture formed compact solid granules. Once these seed crystals were formed, the rate of addition was increased. The resulting water slurry was filtered through a 3 liter fritted glass (coarse) funnel using a water aspirator, followed by discarding of the filtrate. The 4 liter beaker was then recharged with 2.5 liters of deionized water and the remaining contents of the round bottom flask were added to the beaker to precipitate the product, followed by pouring the contents of the beaker onto the previously filtered product (m-methoxy acetanilide). The solid collected in the filter was then washed with 1 liter of deionized water.

The crude m-methoxy acetanilide was added to a 2 gallon pail and 4 liters of deionized water (including that water necessary to wash the sides of the funnel free of the product) were transferred to the pail. The water/acetanilide mixture was then stirred and allowed to sit for 15 minutes, followed by filtration of the contents of the pail and washing of the residue with 1 liter of deionized water. The wash procedure was repeated except that the water/acetanilide mixture was allowed to sit for 30 minutes, followed by filtration and washing with 1 liter of deionized water. The fritted glass funnel containing the m-methoxy acetanilide was left connected to the water aspirator for an additional 2 hours to remove excess water.

The fritted glass funnel containing the m-methoxy acetanilide was then placed in a drying oven with aluminum foil under the funnel to catch any acetanilide which might fall from the funnel. A water aspirator was used to effect a vacuum and a drying temperature of 50° C. for 3 days was maintained. The dried m-methoxy acetanilide was then removed from the oven. The ash-gray granular solid product, which had a distinctly acetic acid odor, was placed in a polyethylene bottle. MP: 80° C.; yield: 1095 grams (81%).

B. Preparation of m-methoxy diphenylamine:

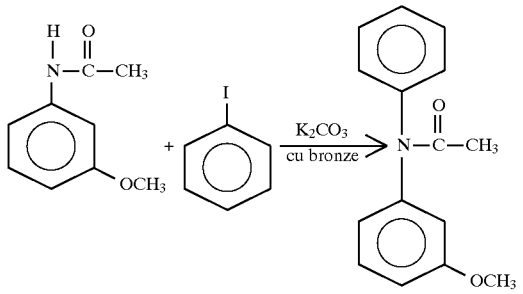

Into a 5-liter, 3-necked round bottom flask equipped with a mechanical stirrer, argon inlet equipped with a thermometer, and condenser (Dean-Stark trap) were added 990 grams of m-methoxy acetanilide, 1599.4 grams of iodobenzene (obtained from Aldrich Chemical Co., Milwaukee, Wis.), and 330 grams of copper bronze (obtained from Fisons Corp.) while argon was introduced into the flask. The contents of the flask were then heated to 70° C. With stirring, 1573 grams of potassium carbonate (Aldrich Chemical Co.) were added to the reaction flask. The reaction mixture was then heated to 180° C. The Dean-Stark trap was emptied twice during the first 6 hours of reaction. The iodobenzene from the trap was recycled back into the reaction flask. The reaction was maintained at 180° C. overnight. At a reaction time of 22 hours, the HPLC reading (flow rate: 0.5 ml/min) indicated percentages of 23 percent acetanilide (355 sec), 75 percent product (370 sec), and 13 percent iodobenzene (471 sec). The temperature was then raised to 200° C. and allowed to react an additional 6 hours, after which the HPLC reading indicated percentages of 5 percent acetanilide, 87 percent product, and 8 percent iodobenzene. The heat source was turned off and, one hour later, the mechanical stirrer was turned off, followed by allowing the reaction mixture to sit overnight. Thereafter, 1,500 milliliters of ethanol (absolute-denatured with 2-propanol) was added and the flask was heated slowly to reflux. The reaction flask contents were then filtered through a 12.5 centimeter porcelain filter using glass fiber filter pads into a 4 liter filter flask. The solids remaining in the flask were washed with two 400 milliliter portions of hot ethanol. The volume of the filtrate was then reduced.

C. Hydrolysis of m-methoxy diphenylamine:

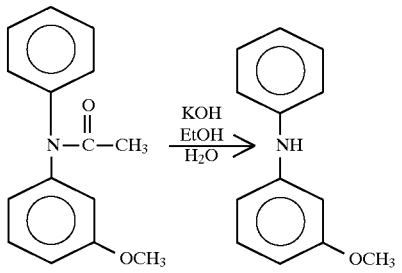

The m-methoxy diphenylamine filtrate prepared in step B was placed into a 4 liter Erlenmeyer flask containing a 3 inch magnetic stir bar. The flask was heated and stirring was initiated, followed by addition of 596 grams of potassium hydroxide flake (obtained from J. T. Baker Chemical Co.) and 532 milliliters of deionized water. Heating was continued at slow reflux for 3 hours. The hot solution was then poured into a 4 liter filter flask through a 12.5 centimeter porcelain filter funnel with fiber glass filter pads. The flask was then rinsed with ethanol, followed by stirring of the dark solution with a magnetic stirrer and addition of 1 liter of deionized water. The flask contents were allowed to stir overnight at room temperature. The amine product crystallized overnight, and the crystals were filtered using a 2 liter fritted glass filter funnel. The tan solid was washed with 500 milliliters of a 50/50 mixture of ethanol and deionized water, followed by washing with 500 milliliters of deionized water, and then further followed by washing with 500 milliliters of a 50/50 mixture of ethanol and deionized water. An aspirator was used to draw off excess liquid.

The solid thus obtained was placed in a single necked 2 liter round bottom flask while heating to melt the amine, thereby reducing volume. The amine was then cooled and allowed to solidify, followed by decanting of excess water, addition of an egg-shaped stir bar, and distillation. The distillation apparatus was heated under aspirator vacuum to remove a forerun of ethanol, water, and iodobenzene. When the reflux temperature reached 120° C., a mechanical vacuum pump was substituted for aspirator vacuum. The distillate was collected up to 160° C. at 5 millimeters as a forerun. The remaining following distillate was collected as product. Because of the relatively high melting point (80°–81° C.), a steam condenser was used. The product was collected as a pale yellow liquid which solidified as a colorless solid upon cooling. Yield: 70%.

D. Preparation of m-dimethoxy tolyl-diphenylbiphenyldiamine:

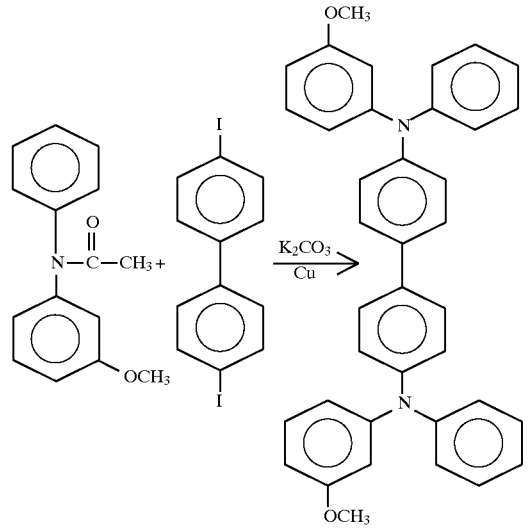

Into a 5-liter, 3-necked round bottom flask equipped with a mechanical stirrer, argon inlet equipped with a thermometer, and condenser were added 500 milliliters of Isopar® L isoparaffinic hydrocarbon (obtained from Noco, Tonawanda, N.Y.), 500 grams of m-methoxy diphenylamine, 404 grams of 4,4'-diiodobiphenyl, and 200 grams of copper bronze (obtained from Fisons Corp., Loughborough Leics, England) while argon was flowing through the apparatus at a rate of 25 milliliters per minute. The reaction vessel was then heated to 70° C., after which 552 grams of anhydrous potassium carbonate was added with stirring. The reaction vessel was then maintained at a temperature of from about 180° to about 200° C. for 24 hours. After 2 hours, a HPLC sample reading indicated percentages of 30 percent diiodobiphenyl (418 sec), 40 percent intermediate (480 sec), and 30 percent product (526 sec). After 24 hours, a HPLC sample reading indicated 0 percent diiodobiphenyl, 5 percent intermediate, and 95 percent product. The reaction mixture was then allowed to cool to 80° C., followed by addition of 1 liter of 2-propanol and stirring for 15 minutes. The reaction mixture was then allowed to sit overnight at room temperature. Thereafter, the 2-propanol layer was decanted and set aside for recovery of excess methoxy diphenylamine. Toluene (1 liter) was then added to the reaction mixture and heated to reflux. Residual 2-propanol was allowed to escape the reaction flask until the reflux vapor temperature exceeded 95° C. The hot solution was then filtered through a 15.0 centimeter porcelain filter funnel equipped with fiber glass filter pads. The filtrate was collected in a 2-liter filter flask. Several washings with toluene were carried out until the filtrate was colorless. The filtrate was a light brown color. The volume of the filtrate was reduced to about 1 liter with a rotary evaporator. Purification was then carried out by placing about 1 cup of glass wool into the bottom of a chromatography column 5 centimeters in diameter and 150 centimeters long and adding 1.5 liters of toluene to the column. A funnel was then placed on the top of the column and 1.5 kilograms of Woelm neutral alumina was added therethrough. Toluene was eluted until the liquid reached the alumina bed. Subsequently, the 1-liter toluene solution of the product was added to the column, followed by elution with toluene. Progress of the product through the column was slow (about 4 hours) and was monitored with a long wavelength UV lamp. About 5 liters of eluent was collected and toluene was removed with a rotary evaporator. To the remaining yellowish viscous oil was added 1 liter of Isopar® L and an egg shaped stir bar. The flask was placed in a heating mantle, rested on a magnetic stir plate, and heated with stirring to 150° C. The contents of the flask were blanketed with argon during this heating step at a rate of 25 milliliters per minute, and toluene vapors were permitted to escape. After 1 hour, 50 grams of Woelm neutral alumina were added to the flask and stirring was continued overnight. Subsequently, the dark alumina was filtered from the pale yellow Isopar® L solution using a 2 liter filter flask and a preheated 9.0 centimeter porcelain filter funnel. The product precipitated as a yellowish oil as the flask cooled. The resulting viscous oil was then dissolved in 1 liter of diethyl ether and allowed to stir with a magnetic stirrer overnight. The resulting fine precipitate was collected in a 600 milliliter fritted glass funnel (medium) and dried in a vacuum oven at 40° C. Yield: 70–90%; MP: 120°–125° C.

E. Preparation of m-dihydroxy tolyl-diphenylbiphenyidiamine:

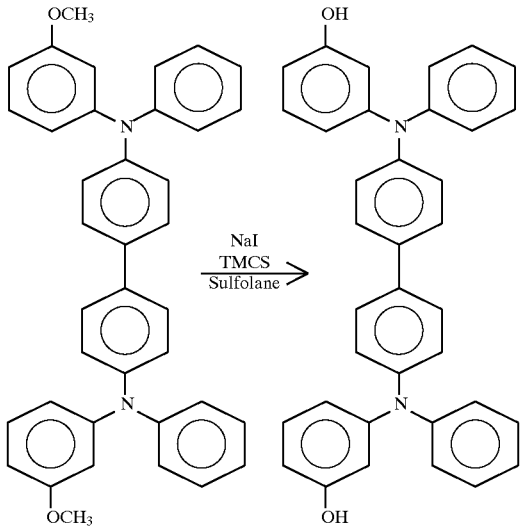

Into a -liter, 3-necked round bottom flask equipped with a mechanical stirrer, argon inlet equipped with a thermometer, and condenser were added 137.5 grams of m-dimethoxy TBD, 223.5 grams of anhydrous sodium iodide, and 500 milliliters of warm sulfolane while argon flowed through the system at a rate of 25 milliliters per minute. The contents were heated with stirring and with the condenser removed to 120° C., followed by maintaining the contents at 120° C. for 15 minutes. The contents were then allowed to cool to 70° C. The condenser and an addition funnel assembled with a Claisen adapter were added to the apparatus and the addition funnel was charged with 190.5 milliliters of trimethyl chlorosilane and sealed with a glass stopper. The trimethyl chlorosilane was added dropwise over 30 minutes, with the heating mantle on the round bottom flask adjusted to maintain a slow reflux at 60° to 65° C. Reaction was timed from the start of the addition. A 1 hour HPLC sample was taken to determine the initial water content, and indicated that the percentage of dimethoxy TBD was between 50 and 80 percent. 1 milliliter of deionized water was then added and the reaction was allowed to proceed for 6 hours. A second HPLC sample measurement indicated 50 percent diphenol (280 sec), 40 percent intermediate (365 sec), and 10 percent dimethoxy TBD (535 sec), with any side products appearing at 335 sec. Subsequently, 1 milliliter of deionized water was added and the mixture was allowed to stir overnight at 65°–75° C. Thereafter, a third HPLC sample measurement indicated 90 percent diphenol, 10 percent intermediate, and 0 percent dimethoxy TBD. One milliliter of deionized water and 37.5 grams of anhydrous sodium iodide were then added to the mixture. After 4 hours, the reaction was complete with no intermediate detectable.

The contents of the reaction vessel were poured into a 3 liter Erlenmeyer flask containing 1,500 milliliters of deionized water. The product precipitated as a viscous oil. The water was decanted and the residue was dissolved in 500 milliliters of acetone heated on a steam bath. The reddish solution was then diluted with 2 liters of deionized water. The second precipitate was more rigid than the first. The water layer was cloudy because of the presence of suspended product, and the flask was heated to about 50° C. to clarify the water layer. Thereafter, the flask was cooled to room temperature and the water layer was decanted. The residue was then dissolved in 800 milliliters of toluene, followed by addition of anhydrous magnesium sulfate to adsorb retained water. The solution was filtered through a porcelain filter with filter paper and the toluene was removed with a rotary evaporator.

The remaining residue was dissolved in 500 milliliters of pyridine and transferred to a 2 liter 3 necked round bottom flask equipped with an argon inlet and a mechanical stirrer. The assembly was purged with argon and the flask was cooled in an ice bath, followed by addition of 58.5 grams of acetyl chloride dropwise with a pressure equalizing addition funnel. An immediate precipitate formed. The mixture was allowed to stir overnight. Thereafter, the reddish mixture was poured into an Erlenmeyer flask containing 2 liters of deionized water. The water layer was decanted off and the oily residue was dissolved in 500 milliliters of acetone, followed by addition of 2 liters of deionized water. The cloudy water layer was clarified by warming in a water bath. The flask was then cooled to room temperature and the water layer was decanted. The red residue was dissolved in 500 milliliters of toluene, followed by addition of anhydrous magnesium sulfate to remove retained water.

A chromatography column was prepared by placing about ½ cup of glass wool in the base of a column 3 centimeters in diameter and 100 centimeters long. The column was filled with toluene. A funnel was then placed on the top of the column and 300 grams of Florisil (60–100 mesh) was added. Sufficient elutant was removed via stopcock to lower the solvent level to the adsorbent layer. Subsequently, the toluene solution was added to the column. After the solution had entered the column, It was eluted with toluene. Progress of the product through the column was monitored with a long wavelength UV lamp. The eluent (about 2 liters) was collected and toluene was removed with a rotary evaporator. The viscous product in the collection flask was connected to a vacuum pump to remove the last traces of toluene. The vacuum dried acetate product was then removed from the flask, dried in a vacuum oven overnight, and weight. Yield: 80%.

The acetate product thus prepared (60.4 grams) was placed in a 1 liter 3-necked round bottom flask equipped with a mechanical stirrer and an argon inlet. The flask was purged with argon, followed by addition of 150 milliliters of tetrahydrofuran and stirring until the acetate dissolved. Thereafter, the mixture was diluted with 100 milliliters of ethanol. The flask was then cooled in an ice bath. Using a pressure equalizing addition funnel, a solution of 11.4 grams of potassium hydroxide flakes in 70 milliliters of deionized water was then added dropwise. After the addition, the orange-red solution was allowed to stir for 1 hour. Using a pressure equalizing funnel, a solution of 12.4 grams of glacial acetic acid in 70 milliliters of deionized water was then added dropwise. After the acid addition, 400 milliliters of deionized water was added to the flask. The resulting solid precipitate was collected on a fritted glass funnel, washed with deionized water, and dried in vacuo. The resulting dried diphenol was dissolved in 300 milliliters of diethyl ether. The reddish purple solution was stirred with a magnetic stirrer and purged with argon. Thereafter, 20 grams of Florisil was added and the solution was stirred for 2 hours. The resulting colorless solution was filtered off and the ether was removed with a rotary evaporator. To the pale yellow diphenol oil was then added 200 milliliters of acetone. After dissolution, the pale yellow solution was diluted with 300 milliliters of heptane. The acetone was slowly removed via a rotary evaporator to yield a white powder suspended in heptane. the diphenol product was filtered and dried in vacuo. Yield: 80%; MP: 113°–117° C.

EXAMPLE II

A polyarylene ether ketone of the formula

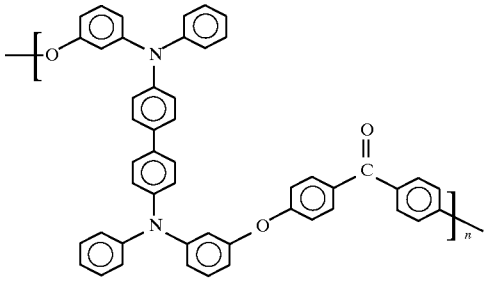

wherein n is about 128 (hereinafter referred to as poly(4-FPK-DHTBD)) was prepared as follows. A 500-milliliter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich 11,549-5, Aldrich Chemical Co., Milwaukee, Wis., 4.26 grams), m-dihydroxy tolyldiphenylbiphenyldiamine (DHTBD, 10 grams), potassium carbonate (6.6 grams), anhydrous N,N-dimethylacetamide (30 milliliters), and toluene (5.2 milliliters) were added to the flask and heated to 175° C. (oil bath temperature) while the volatile toluene component was collected and removed. After 4 hours of heating at 175° C. with continuous stirring, the reaction mixture was allowed to cool to 25° C. The reaction mixture was stirred with 250 grams of methylene chloride, filtered to remove potassium carbonate and precipitated into methanol (1 gallons). The precipitate was collected by filtration, washed with 2.5 gallons of water, and then washed with 1 gallon of methanol. The polymer (poly (4-FPK-DHTBD)) was isolated in 80 percent yield after filtration and drying in vacuo. GPC analysis was as follows: $M_n$ 90,000, $M_w$ 235,000. As a result of the stoichiometries used in the reaction, it is believed that this polymer had end groups derived from DHTBD groups. The polymer dissolved in methylene chloride at 10 percent solids was added to methanol (1 gallon) using a Waring blender to reprecipitate the polymer. The polymer was then isolated by filtration and vacuum dried. This material was used as the transport layer in photoreceptors and evaluated as described in Example VII.

EXAMPLE III

A polyarylene ether of the formula

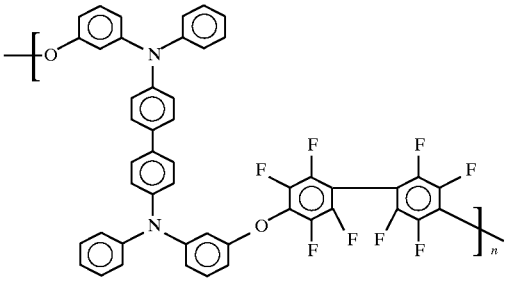

wherein n is about 120 (hereinafter referred to as poly(4-DFBP-DHTBD)) was prepared as follows. A 500-milliliter, 3-neck round-bottom flask equipped with a Dean-Stark (Barrett) trap, condenser, mechanical stirrer, argon inlet, and stopper was situated in a silicone oil bath. 4,4'-Decafluorobiphenyl (Aldrich D22-7, Aldrich Chemical Co., Milwaukee, Wis., 5 grams), m-dihydroxy tolyl-diphenylbiphenyldiamine (DHTBD, 5.2 grams), potassium carbonate (12.3 grams), and anhydrous N,N-dimethylacetamide (75 milliliters) were added to the flask and heated at 150° C. (oil bath temperature) for 4 hours with continuous stirring. The reaction mixture was then allowed to cool to 25° C. The reaction mixture was stirred with 250 grams of tetrahydrofuran, filtered to remove potassium carbonate, concentrated using a rotary evaporator, and then precipitated into methanol (1 gallons). The precipitate was collected by filtration, washed with 2.5 gallons of water, and then washed with 1 gallon of methanol. The polymer (poly (4-FPK-DHTBD)) was isolated in 80 percent yield after filtration and drying in vacuo. As a result of the stoichiometries used in the reaction, it is believed that this polymer had end groups derived from DHTBD groups. The polymer dissolved in tetrahydrofuran at 10 percent solids was added to methanol (1 gallon) using a Waring blender to reprecipitate the polymer. The polymer was then isolated by filtration and vacuum dried. This material was used as the transport layer in photoreceptors and evaluated as described in Example VII.

EXAMPLE IV

Binder Generator Layer Preparation

Several generator layers containing hydroxygallium phthalocyanine pigment particles were prepared by forming coatings using conventional coating techniques on a substrate comprising a vacuum deposited titanium layer on a polyethylene terephthalate film (Melinex®, obtained from ICI). The first coating was a siloxane barrier layer formed from hydrolyzed gamma-aminopropyltriethoxysilane having a thickness of 0.005 micron (50 Angstroms). This film was coated as follows: 3-aminopropyltriethoxysilane (obtained from PCR Research Chemicals, Florida) was mixed in ethanol in a 1:50 volume ratio. A film of the resulting solution was applied to the substrate in a wet thickness of 0.5 mil by a multiple clearance film applicator. The barrier layer was then allowed to dry for 5 minutes at room temperature, followed by curing for 10 minutes at 110° C. in a forced air oven. The second coating was an adhesive layer of polyester resin (49,000, obtained from E. I. duPont de Nemours and Co.) having a thickness of 0.005 micron (50 Angstroms) and was coated as follows: 0.5 grams of 49,000 polyester resin was dissolved in 70 grams of tetrahydrofuran and 29.5 grams of cyclohexanone. A film of the resulting solution was coated onto the barrier layer by a 0.5 mil bar and cured in a forced air oven for 10 minutes. The adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a $M_w$ of 11,900. This photogenerating coating composition was prepared by dissolving 1.5 grams of the block copolymer of styrene/4-vinyl pyridine in 42 milliliters of toluene. To this solution was added 1.33 grams of hydroxygallium phthalocyanine and 300 grams of ⅛ inch diameter stainless steel shot. This mixture was then placed on a roll mill for 20 hours. The resulting slurry was thereafter applied to the adhesive layer with a Bird bar applicator to form a layer having a wet thickness of 0.25 mil. This photogenerating layer was dried at 135° C. for 5 minutes in a forced air oven to form a layer having a dry thickness of 0.4 micron.

EXAMPLE V

Makrolone® Control Transport Layer Preparation

A charge transport layer was coated onto the hydroxygallium phthalocyanine generator layer of an imaging member prepared as described in Example IV. The transport layer was formed by using a Bird coating applicator to apply a solution containing one gram of N,N'-diphenyl-N,N'-bis(3-methyl-phenyl)-(1,1'-biphenyl)-4,4'-diamine (TBD) and one gram of polycarbonate resin (poly(4,4'-isopropylidene-diphenylene carbonate (available as Makrolon® from Farbenfabricken Bayer A. G.)) dissolved in 11.5 grams of methylene chloride solvent. The N,N'-diphenyl-N,N'-bis(3-methyl-phenyl)-(1,1'-biphenyl)-4,4'-diamine is an electrically active aromatic diamine charge transport small molecule, and the polycarbonate resin is an electrically inactive film-forming binder. The coated device was dried at 80° C. for half an hour in a forced air oven to form a dry 25 micron thick charge transport layer.

EXAMPLE VI(a)

Charge Transport Layer Preparation With Example II Polymer

A charge transport layer was coated onto the hydroxygallium phthalocyanine generator layer of an imaging member prepared as described in Example V. The transport layer was formed by using a Bird coating applicator to apply a solution of two grams of the polymer of Example II in 11.22 grams of methylene chloride. The coated device was dried at 80° C. for 0.5 hour in a forced air oven to form a dry 25 micron thick charge transport layer. By the same process, a device was made with the polymer of Example III.

EXAMPLE VI(b)

Charge Transport Layer Preparation With Example II Polymer+TBD

A charge transport layer was coated onto the hydroxygallium phthalocyanine generator layer of an imaging member prepared as described in Example V. The transport layer was formed by using a Bird coating applicator to apply a solution of 1.2 grams of the polymer of Example II and 1.2 grams of N,N'-diphenyl-N,N'-bis(3-methyl-phenyl)-(1,1'-biphenyl-4,4'-diamine (TBD) in 13.5 grams of methylene chloride. The coated device was dried at 80° C. for 0.5 hour in a forced air oven to form a dry 25 micron thick charge transport layer.

By the same process, a device was made with the polymer of Example III and N,N'-diphenyl-N,N'-bis(3-methyl-phenyl)-(1,1'-biphenyl)-4,4'-diamine (TBD).

EXAMPLE VI(c)

Charge Transport Layer Preparation With Example II Polymer+TBD

A charge transport layer was coated onto the hydroxygallium phthalocyanine generator layer of an imaging member prepared as described in Example V. The transport layer was formed by using a Bird coating applicator to apply a solution of 1.2 grams of the polymer of Example II and 1.2 grams of N,N'-diphenyl-N,N'-bis(3-methyl-phenyl)-(1,1'-biphenyl)-4,4'-diamine (TBD) in 13.5 grams of tetrahydrofuran. The coated device was dried at 80° C. for 0.5 hour in a forced air oven to form a dry 25 micron thick charge transport layer.

EXAMPLE VII

Imaging members prepared as described in Example VI and containing the polymers of Examples II and III were tested in two different test fixtures. In the first test fixture, called the flat plate scanner, the imaging members were mounted on a flat plate scanner which comprised a thick aluminum plate capable of traversing under a corotron and a voltage measuring probe, which comprised a wire loop through which the film could be measured and exposed. The wire loop probe was connected to a voltmeter and a chart recorder. The imaging members of Example VI (a), (b), and (c) containing the polymer of Example II were measured on the flat plate test fixture, and the results are shown in the table below. $V_0$ is the potential soon after charging, $V_{ddp}$ is the potential a second later, and $V_r$ is the residual potential after light exposure of 15 ergs/cm$^2$.

| Imaging Member | Amount polymer (grams) | Amount TBD (grams) | Solvent | Charge Transport Layer Thickness (microns) | $V_0$ (volts) | $V_{ddp}$ (volts) | $V_r$ (volts) |
|---|---|---|---|---|---|---|---|
| A | 2 | 0 | $CH_2Cl_2$ (11.3 g) | 36.6 | 800 | 723 | 300 |
| B | 2 | 0 | $CH_2Cl_2$ (13 g) | 28 | 840 | 767 | 250 |
| C | 2 | 0 | THF (8.72 g) | 37.2 | 1420 | 1370 | 600 |
| D | 1.2 | 1.2 | $CH_2Cl_2$ (13.5 g) | 34 | 1320 | 1213 | 0 |
| E | 1.2 | 1.2 | THF (13.5 g) | 22 | 800 | 757 | 0 |

In the second test fixture, the imaging members were mounted on a cylindrical aluminum drum which was rotated on a shaft. The films were charged by a corotron mounted along the circumference of the drum. The surface potentials were measured as a function of time by several capacitively coupled probes placed at different locations around the shaft. The probes were calibrated by applying known potentials to the drum substrate. The films on the drum were then exposed and erased by light sources located at appropriate positions around the drum. The measurement consisted of charging the photoconductor devices in a constant current or voltage mode. As the drum rotated, the initial charging potential was measured by probe 1. Further rotation led to the exposure station, where the photoconductor devices were exposed to monochromatic radiation of known intensity. The surface potential after exposure was measured by probes 2 and 3. The devices were finally exposed to an erase lamp of appropriate intensity and any residual potential was measured by probe 4. The process was repeated with the magnitude of the exposure automatically changed during the next cycle. A photo-induced discharge characteristics curve was obtained by plotting the potentials at probes 2 and 3 as a function of exposure. The initial slope of the discharge curve is termed S in units of (volts×cm$^2$/ergs) and the residual potential after the erase step is termed Vr. The devices were cycled continuously for 10,000 cycles of charge, expose and erase steps to determine the cyclic stability. Charge trapping in the transport layer results in a build up of residual potential known as cycle-up. The imaging members of Example VI (a) and (b) containing the polymer of Example III were tested on the drum scanner test fixture, and the results are shown in the table below. S represents the initial slope of the Photo-Induced Discharge Characteristics (PIDC) and is a measure of the sensitivity of the device. Cycle-up is the increase in residual potential in 10,000 cycles of continuous operation. The negative numbers of the residual cycle-up resulted from an increase in sensitivity of the pigment in the generator layer as the device was cycled.

| Imaging Member | S volts ·cm$^2$/ergs | PIDC, $V_r$ | 1 sec Dark Decay (volt/sec) | Cyclic Characteristics (10K Cycle-up) |
|---|---|---|---|---|
| Ex. VI(a) | 110.6 | 189.4 | 84.8 | 108.1 |
| Ex. VI(b) | 108.9 | 6.3 | 38.3 | 7.6 |

EXAMPLE VIII

Resistance of the polymers of Examples II and III to isoparaffinic hydrocarbons (typically used as liquid vehicles in liquid developers) was tested as follows. The imaging members were soaked in Isopar® isoparaffinic hydrocarbon and subsequently visually inspected for phase separation and cracking. The imaging members prepared as described in Example VI (a) containing the polymers of Examples II and III remained intact after several hours of exposure to Isopar®, whereas the transport layer of the imaging member of Example V containing a transport layer of N,N'-diphenyl-N,N'-bis(3-methyl-phenyl)-(1,1'-biphenyl)-4,4'-diamine (TBD) in Makrolon® polycarbonate resin exhibited phase separation, turned white (indicating TBD crystallization), exhibited cracking, and ultimately delaminated subsequent to exposure to Isopar®.

EXAMPLE IX

A polyarylene ether sulfone of the formula

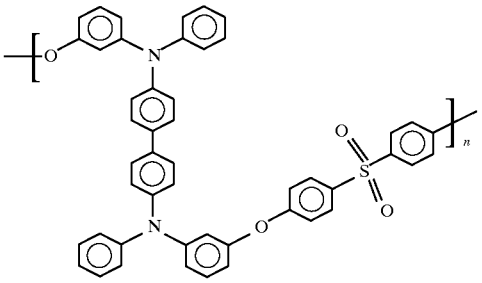

wherein n is about 72 was prepared as follows. A 500-milliliter, 3-neck round-bottom flask equipped with a Dean-Stark (Barrett) trap, condenser, mechanical stirrer, argon inlet, and stopper was situated in an oil bath. 4,4'-Difluorophenylsulfone (obtained from Aldrich Chemical Co., Milwaukee, Wis., 4.92 grams), m-dihydroxy tolyldiphenylbiphenyldiamine (DHTBD, 10 grams), potassium carbonate (7 grams), N,N-dimethylacetamide (50 milliliters), and toluene (15 milliliters) were added to the flask and heated to 175° C. (oil bath temperature) while the volatile toluene component was collected and removed. After 4 hours of heating at 175° C. with continuous stirring, the reaction mixture was allowed to cool to 25° C. The reaction mixture added to methanol (1 gallon) using a Waring blender. The precipitate was collected by filtration and vacuum dried. Thereafter, the polymer was added to methylene chloride, reprecipitated into methanol, filtered, and vacuum dried to yield 10 grams of polymer having a weight average molecular weight of 130,000 and a number average molecular weight of 52,500 as determined by gel permeation chromatography.

The polymer thus prepared (1.2 grams) was admixed with methylene chloride (13.5 grams) and was coated with a 4 mil Bird applicator as a 15.4 micron thick layer onto the hydroxygallium phthalocyanine generator layer of an imaging member prepared as described in Example V. Subsequent to drying, the resulting imaging member exhibited the following characteristics: $V_0$=600 Volts; $V_{1sec.\ dark\ decay}$=40 Volts; $V_r$=240 Volts.

The polymer thus prepared (1.2 grams) was admixed with tetrahydrofuran (13.5 grams) and was coated with a 4 mil Bird applicator as a 13.5 micron thick layer onto the hydroxygallium phthalocyanine generator layer of an imaging member prepared as described in Example V. Subsequent to drying, the resulting imaging member exhibited the following characteristics: $V_0$=1,100 Volts; $V_{1sec.\ dark\ decay}$= 340 Volts; $V_r$=280 Volts.

A solution was prepared by admixing 1.2 grams of the polymer, 1.2 grams of N,N'-diphenyl-N,N'-bis(3-methylphenyl)-(1,1'-biphenyl)-4,4'-diamine, and 13.5 grams of methylene chloride and was coated with a 4 mil Bird applicator as a 31.9 micron thick layer onto the hydroxygallium phthalocyanine generator layer of an imaging member prepared as described in Example V. Subsequent to drying, the resulting imaging member exhibited the following characteristics: $V_0$=1,110 Volts; $V_{1sec.\ dark\ decay}$=50 Volts; $V_r$=50 Volts.

The polymer synthesis was repeated with the exception that 4,4'-dichlorophenylsulfone (5.55 grams) was used instead of 4,4'-difluorophenylsulfone. The yield of polymer was 6 grams, with a weight average molecular weight of 12,000 and a number average molecular weight of 5,000.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member which comprises a conductive substrate, a photogenerating material, and a polymer of the formula

I

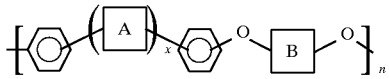

II

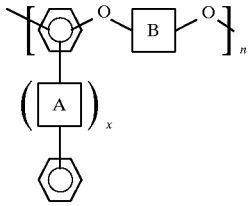

III

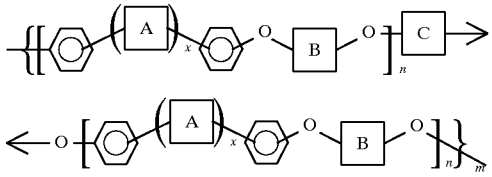

IV

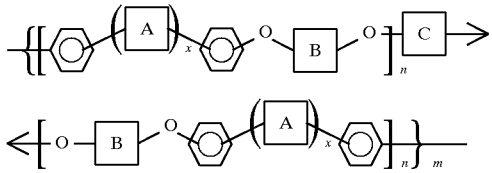

V

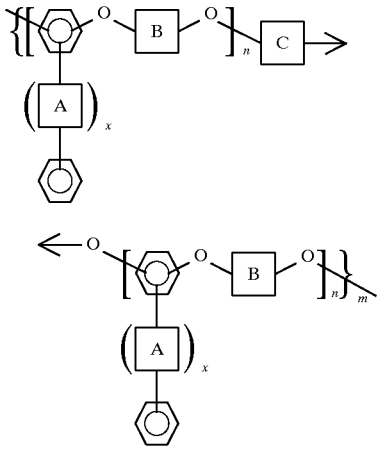

-continued
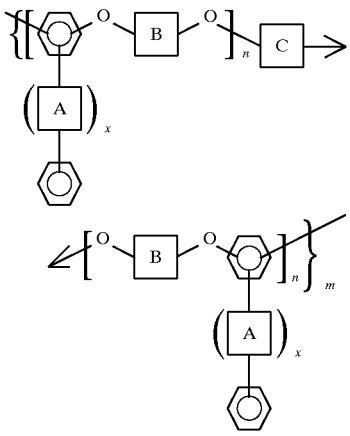
VI
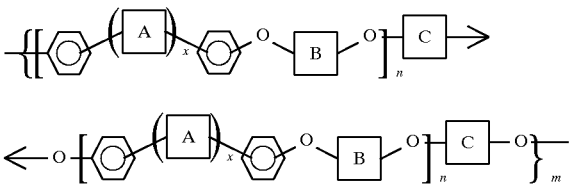
VII
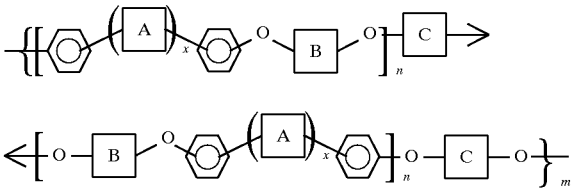
VIII
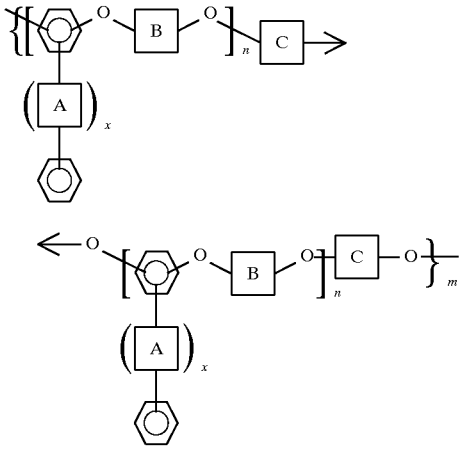
IX
or
-continued
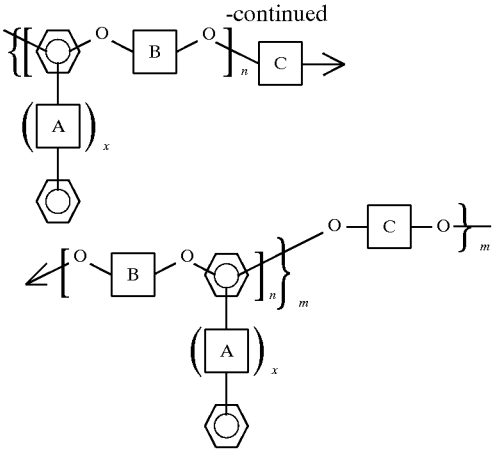
X
wherein x is an integer of 0 or 1, A is
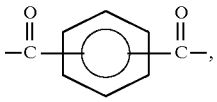
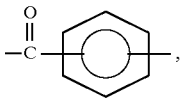
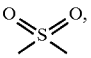
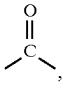
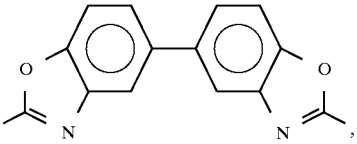
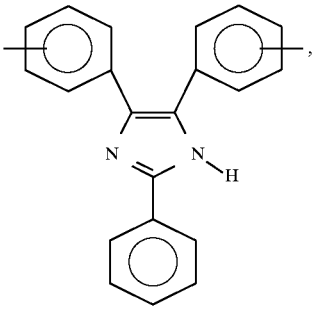
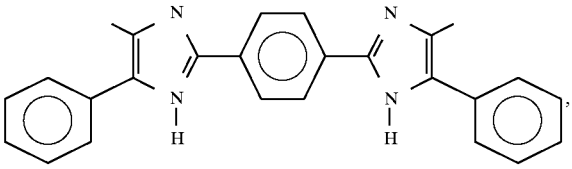
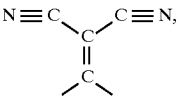

-continued
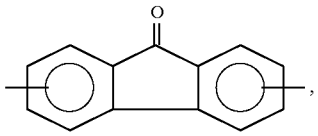
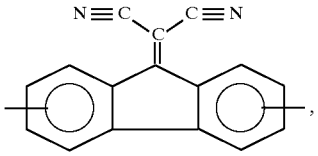
or mixtures thereof, B is
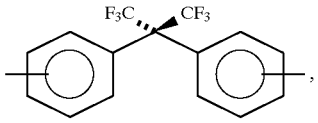
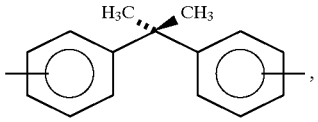
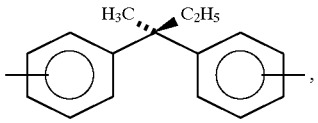
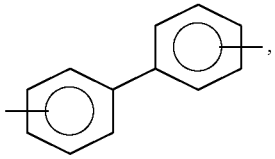
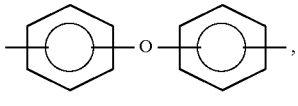
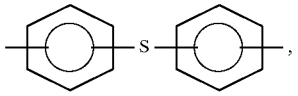
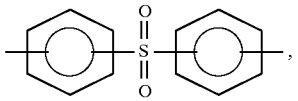
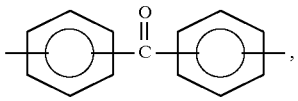
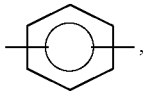
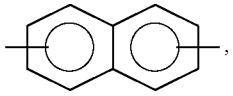
-continued
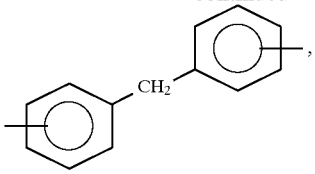
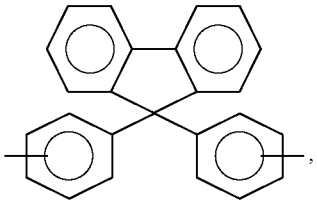
$-(CH_2)_v-$,
wherein v is an integer of from 1 to about 20,
$-(CH_2O)_t-$
wherein t is an integer of from 1 to about 20,
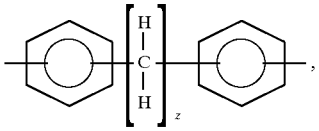
wherein z is an integer of from 2 to about 20,
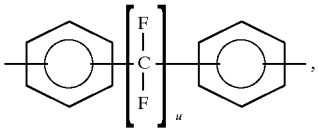
wherein u is an integer of from 1 to about 20,
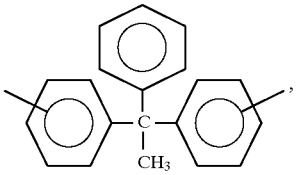
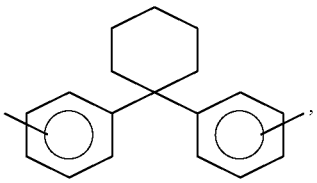
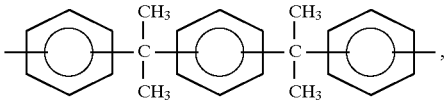
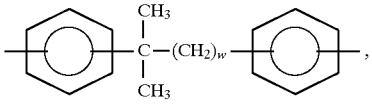

wherein w is an integer of from 1 to about 20,
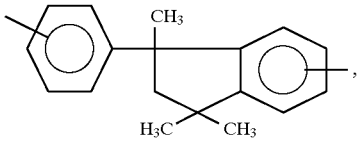
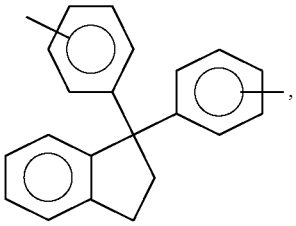
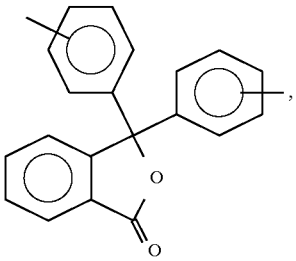
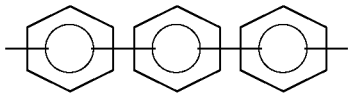
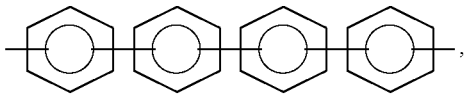
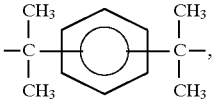
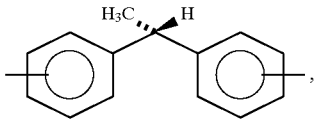
or
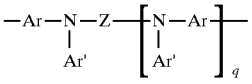
wherein (1) Z is
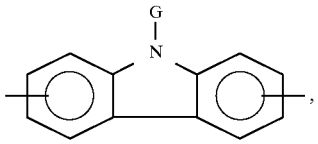
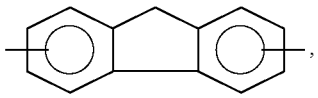
-continued
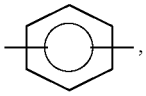
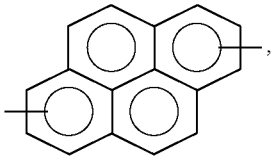
or
$-Ar-(X)_p-Ar-$
wherein p is 0 or 1; (2) Ar is
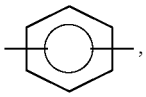
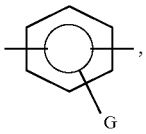
or
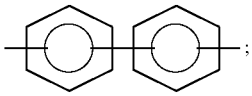
(3) G is an alkyl group selected from alkyl or isoalkyl groups containing from about 2 to about 10 carbon atoms; (4) Ar' is
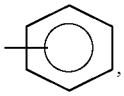
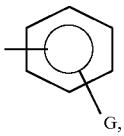
or
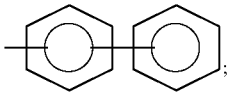
(5) X is
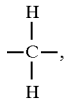
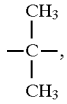
$-O-$,
$-S-$, -continued

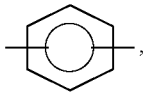

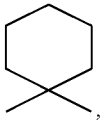

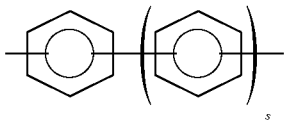

wherein s is 0, 1, or 2,

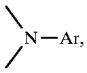

or

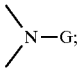

and (6) q is 0 or 1; or mixtures thereof, wherein at least some of the "B" groups are of the formula

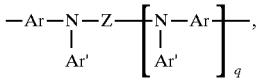

C is

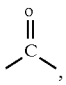

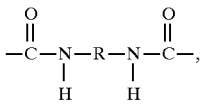

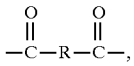

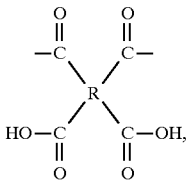

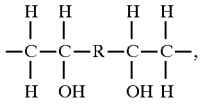

or mixtures thereof, wherein R is an alkyl group, an aryl group, an arylalkyl group, or mixtures thereof, and m and n are integers representing the number of repeating units, wherein the polymer has a weight average molecular weight of from about 20,000 to about 1,000,000.

2. An imaging member which comprises a conductive substrate, a photogenerating material, and a polymer of the formula

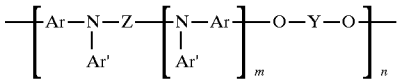

wherein (1) n is an integer representing the number of repeating units; (2) Z is

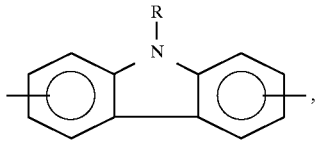

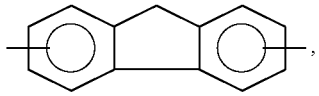

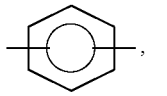

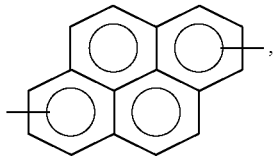

or

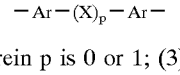

wherein p is 0 or 1; (3) Ar is

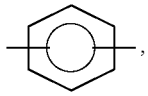

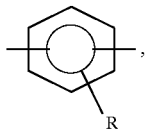

or

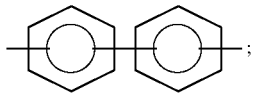

(4) R is an alkyl group selected from alkyl or isoalkyl groups containing from about 2 to about 10 carbon atoms; (5) Ar' is

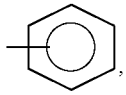

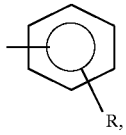

-continued
or
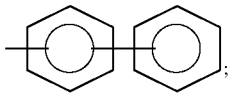
(6) X is
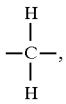
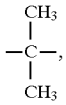
$-O-$,
$-S-$,
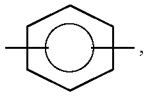
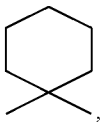
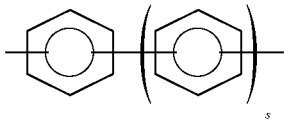
wherein s is 0, 1, or 2,
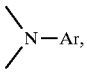
or
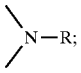
(7) m is 0 or 1; and (8) Y is
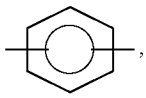
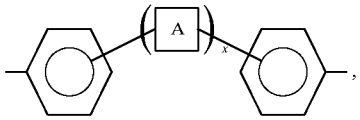
or
-continued
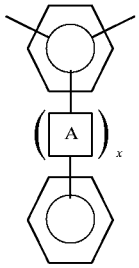
wherein x is 0 or 1 and A is
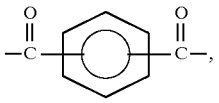
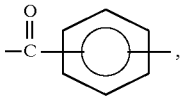
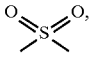
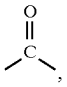
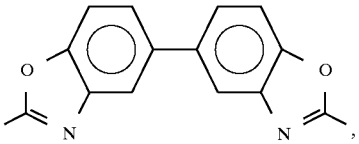
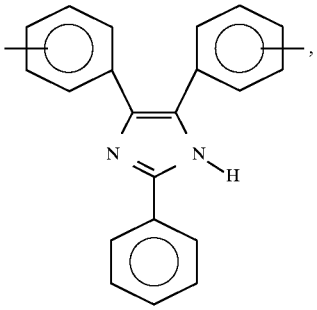
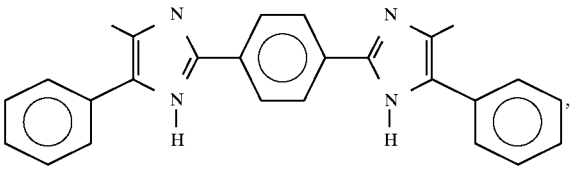
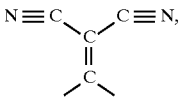
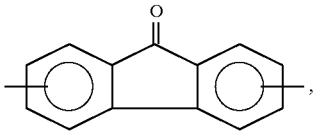

-continued

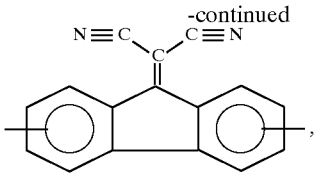

or mixtures thereof, wherein the polymer has a weight average molecular weight of from about 20,000 to about 1,000,000.

3. An imaging member according to claim 1 wherein the polymer has a glass transition temperature of from about 50° to about 300° C.

4. An imaging member according to claim 1 wherein the polymer has a weight average molecular weight of from about 20,000 to about 350,000.

5. An imaging member according to claim 1 wherein the polymer has a number average molecular weight of from about 10,000 to about 100,000.

6. An imaging member according to claim 1 comprising (a) a photogenerating layer containing the photogenerating material and (b) a charge transport layer containing the polymer.

7. An imaging member according to claim 1 wherein the imaging member comprises a photogenerating layer comprising the photogenerating material and the polymer.

8. An imaging member according to claim 1 wherein the polymer is

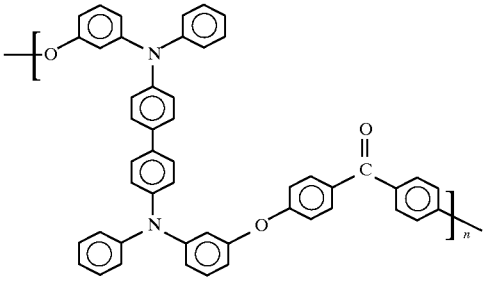

wherein n is an integer representing the number of repeating monomer units.

9. An imaging member according to claim 1 wherein the polymer is

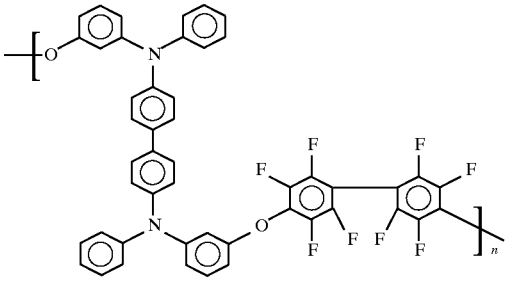

wherein n is an integer representing the number of repeating monomer units.

10. An imaging member according to claim 1 wherein the polymer is

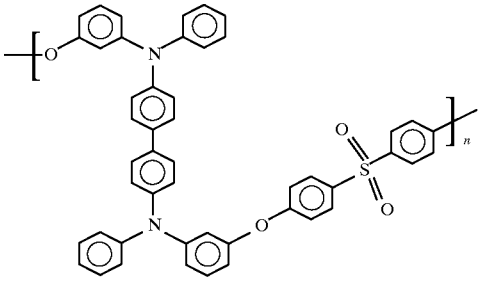

wherein n is an integer representing the number of repeating monomer units.

11. An imaging member according to claim 1 wherein the polymer is selected from

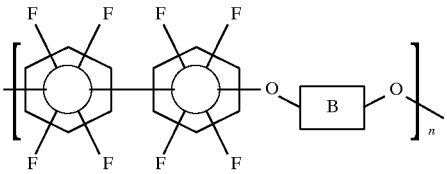

I

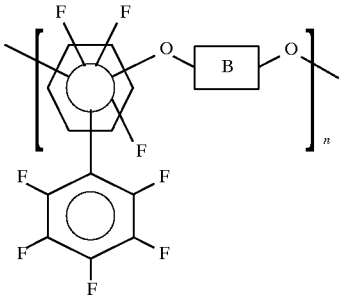

II

-continued
III
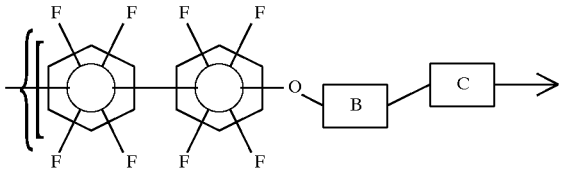
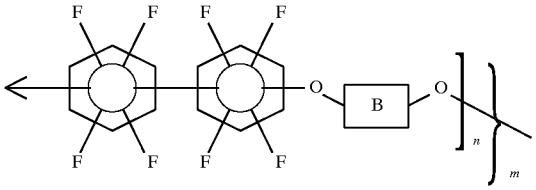
IV
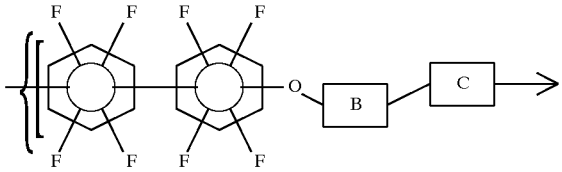
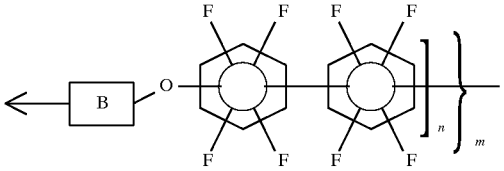
V
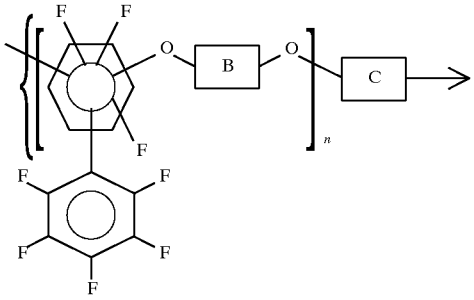
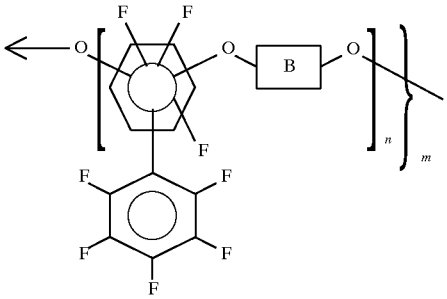
VI
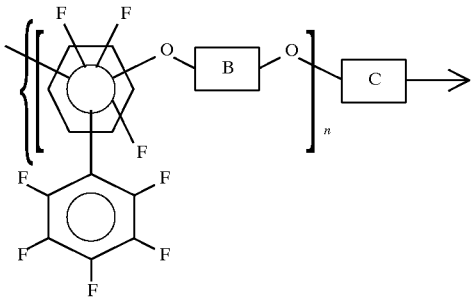

-continued
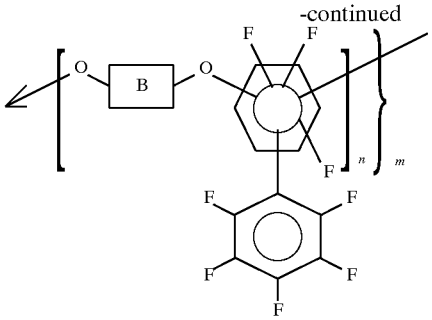
VII
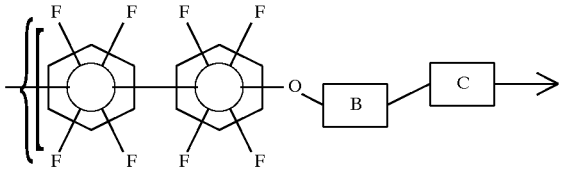
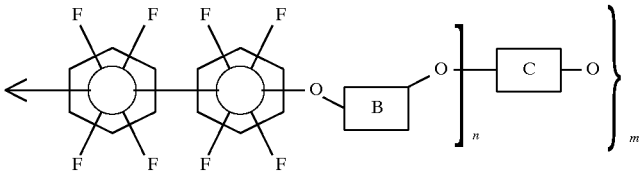
VIII
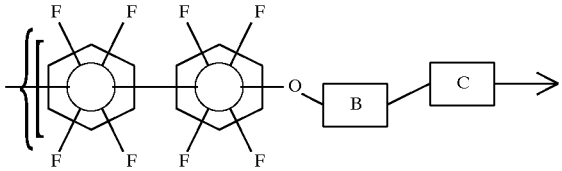
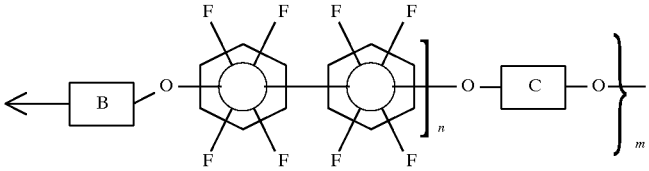
IX
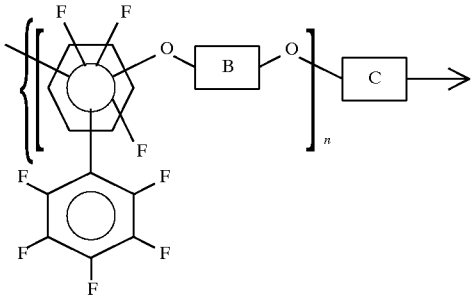
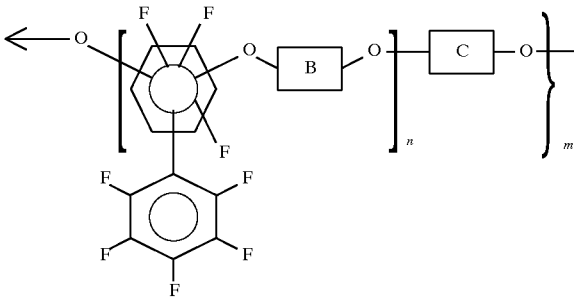
or -continued
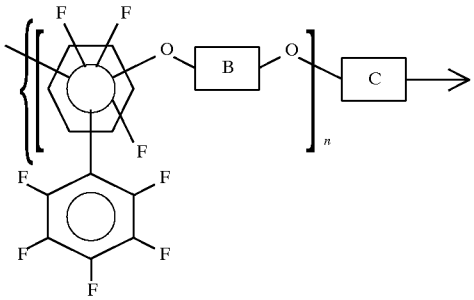
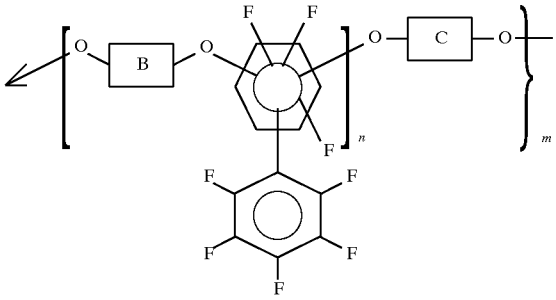
wherein x is an integer of 0 or 1, A is
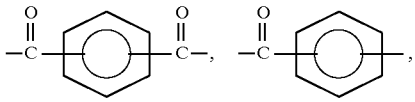
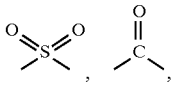
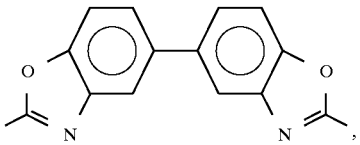
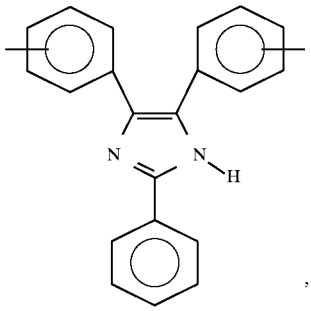
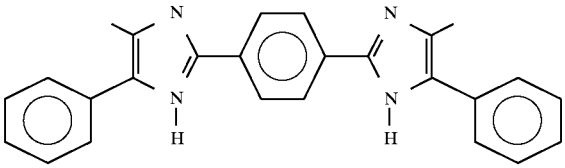
X
-continued
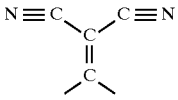
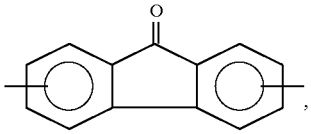
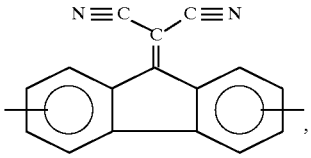
or mixtures thereof, B is
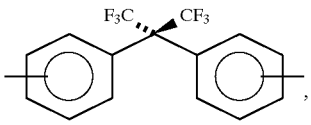
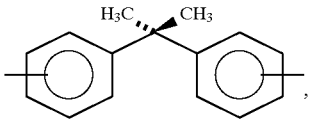
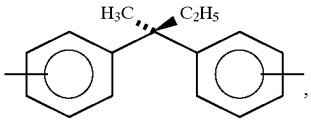

-continued
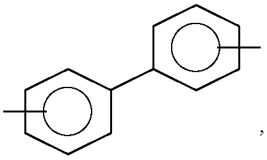
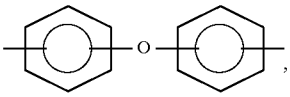
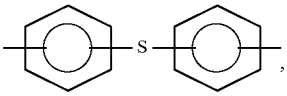
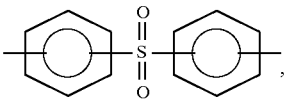
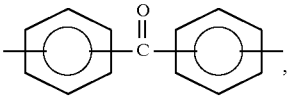
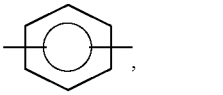
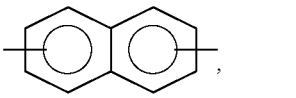
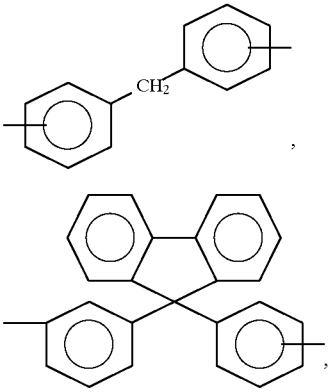
wherein v is an integer of from 1 to about 20,
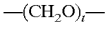
wherein t is an integer of from 1 to about 20,
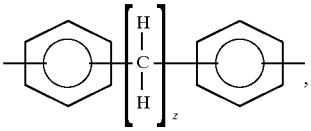
wherein z is an integer of from 2 to about 20,
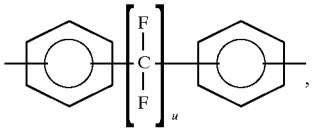
wherein u is an integer of from 1 to about 20,
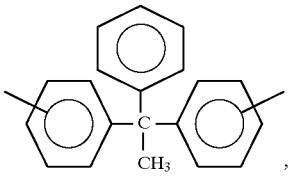
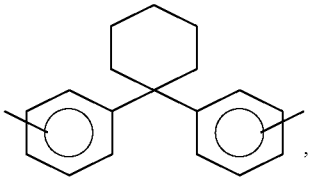
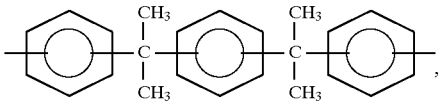
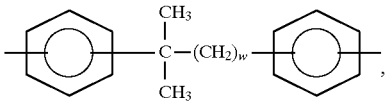
wherein w is an integer of from 1 to about 20,
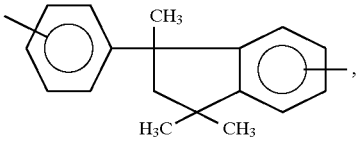
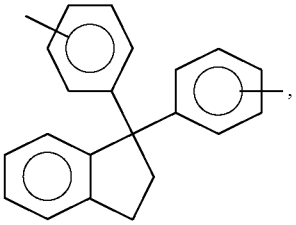
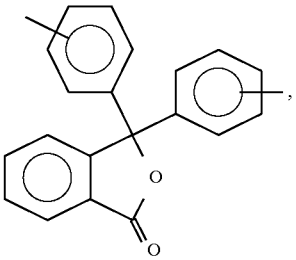
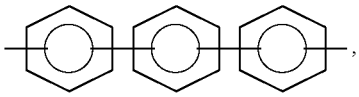

-continued
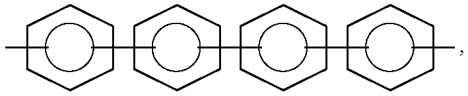
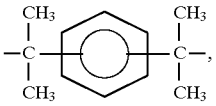
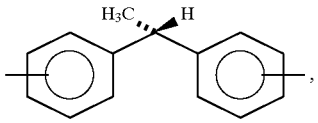
or
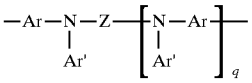
wherein (1) Z is
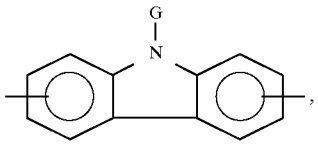
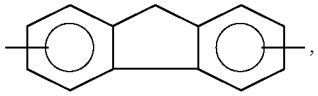
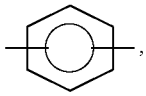
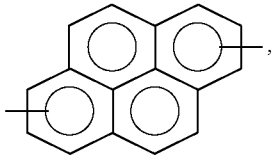
or
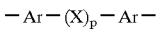
wherein p is 0 or 1; (2) Ar is
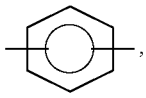
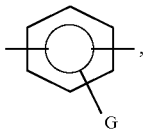
or
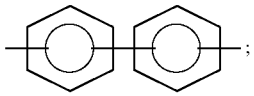
(3) G is an alkyl group selected from alkyl or isoalkyl groups containing from about 2 to about 10 carbon atoms; (4) Ar' is
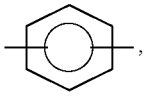
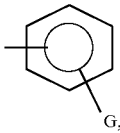
or
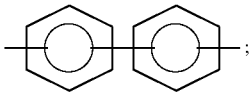
(5) X is
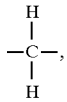
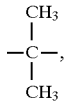
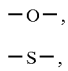
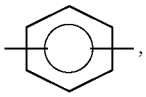
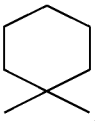
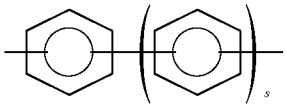
wherein s is 0, 1, or 2,
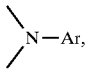
or
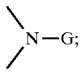
and (6) q is 0 or 1; or mixtures thereof, wherein at least some of the "B" groups are of the formula
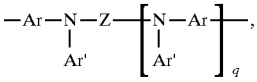

C is
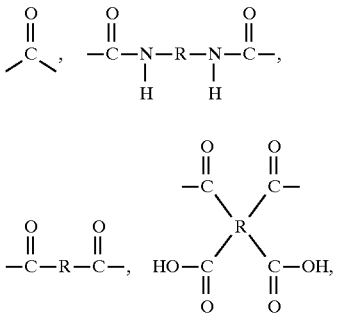
-continued
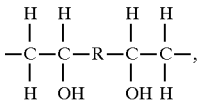
or mixtures thereof, wherein R is an alkyl group, an aryl group, an arylalkyl group, or mixtures thereof, and m and n are integers representing the number of repeating units.
12. An imaging member according to claim 1 wherein the polymer is selected from
I
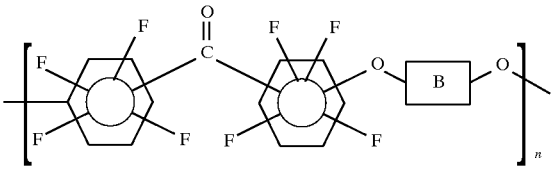
II
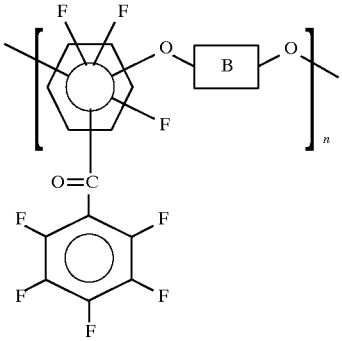
III
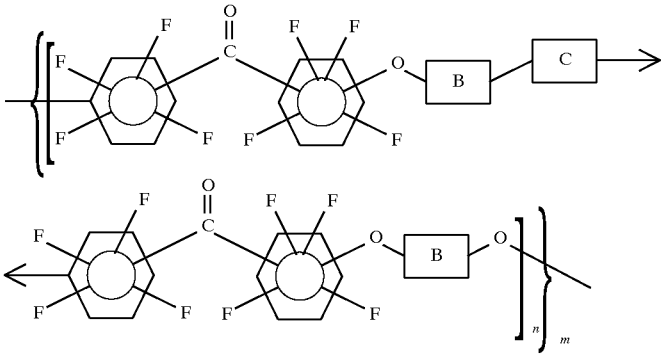
IV
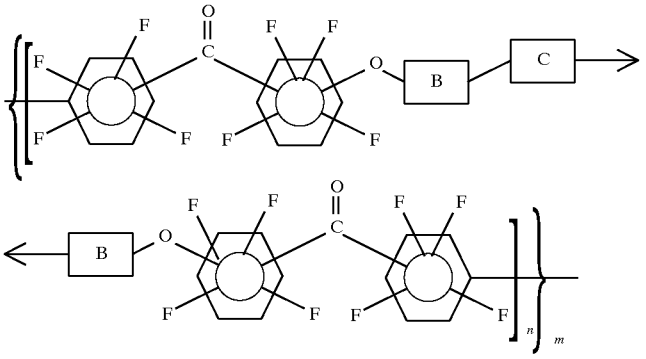

-continued
V
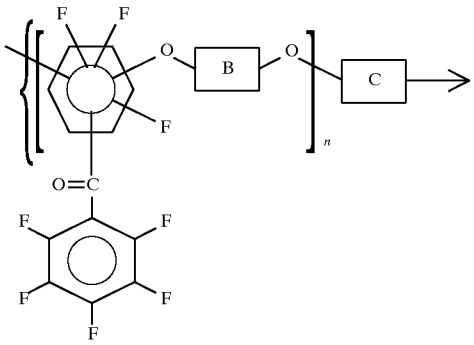
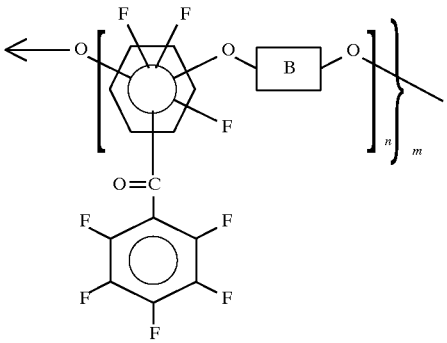
VI
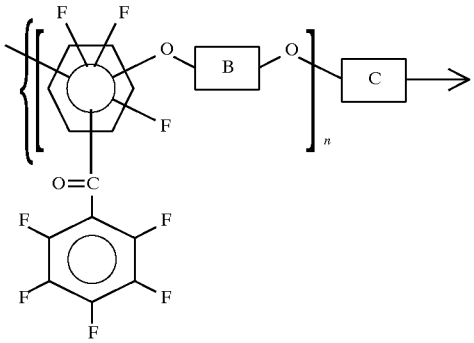
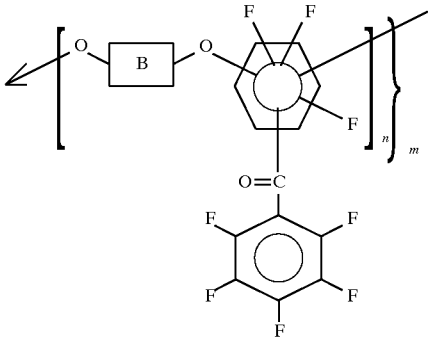
VII
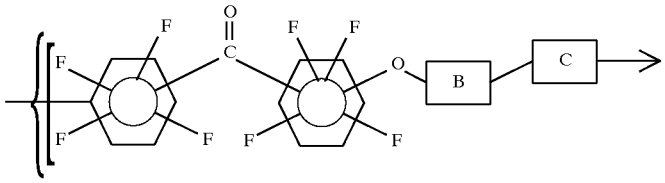

-continued
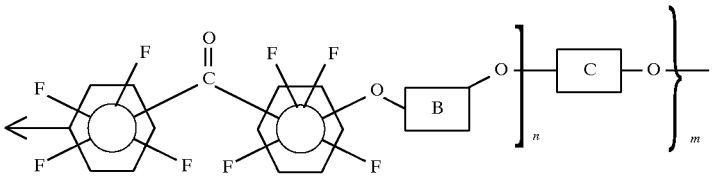
VIII
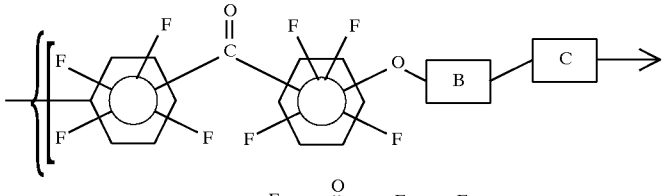
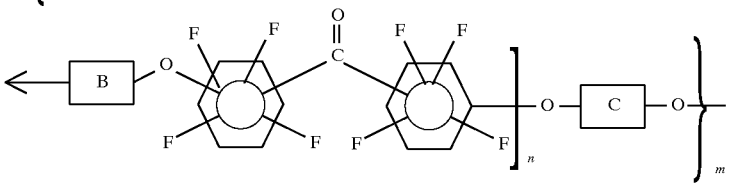
IX
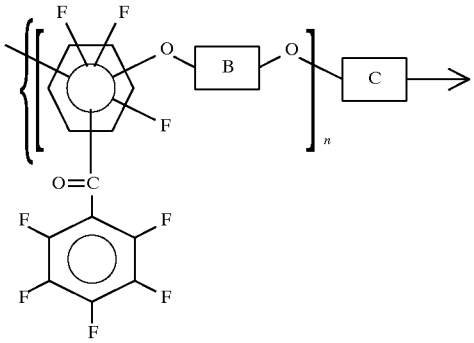
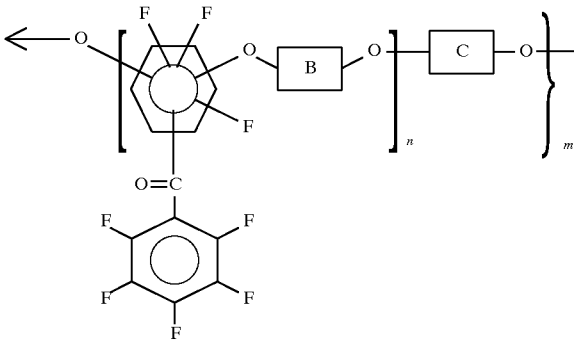
or
X
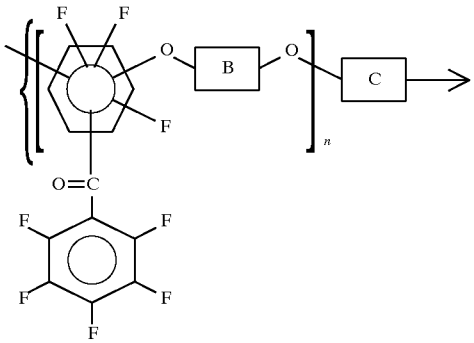

-continued
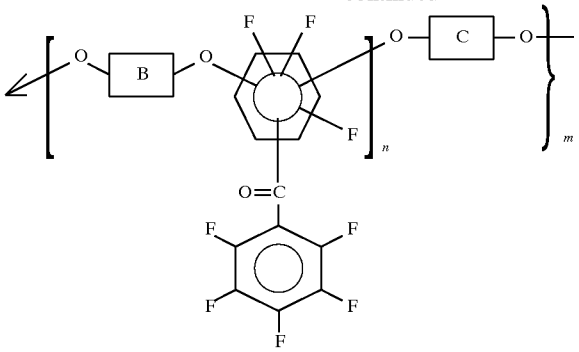
wherein x is an integer of 0 or 1, A is
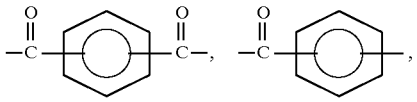
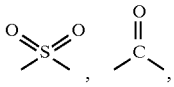
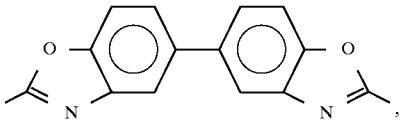
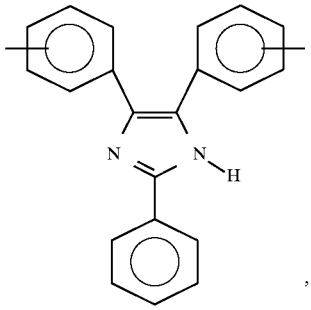
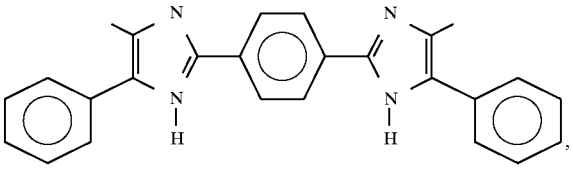
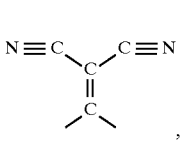
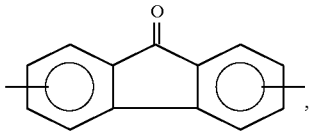
-continued
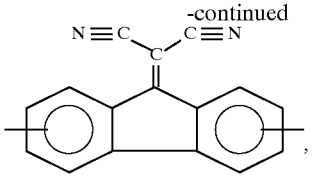
or mixtures thereof, B is
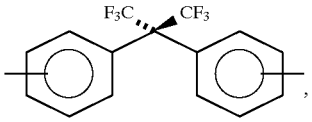
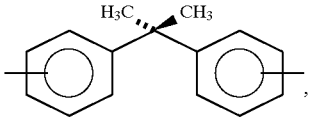
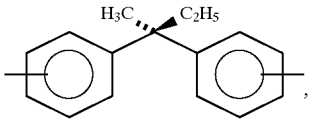
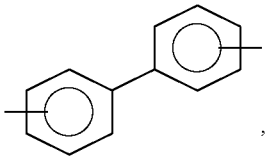
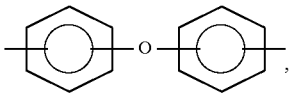
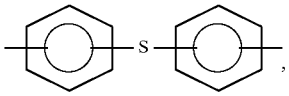
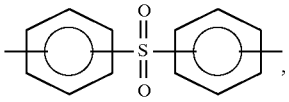
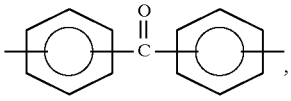

-continued
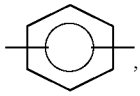
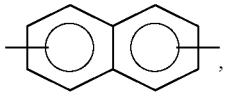
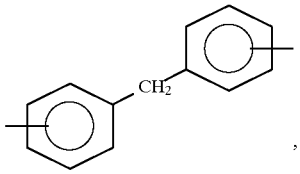
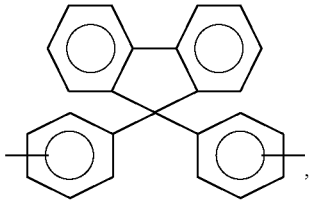
$-(CH_2)_v-$,
wherein v is an integer of from 1 to about 20,
$-(CH_2O)_t-$
wherein t is an integer of from 1 to about 20,
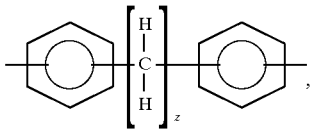
wherein z is an integer of from 2 to about 20,
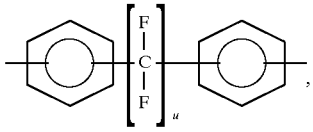
wherein u is an integer of from 1 to about 20,
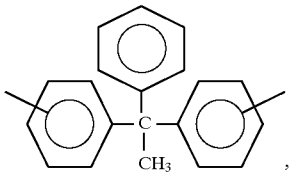
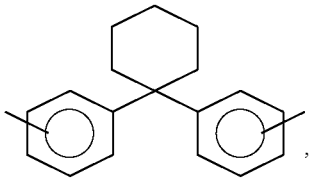
-continued
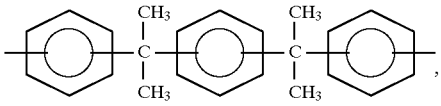
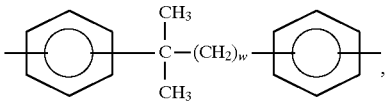
wherein w is an integer of from 1 to about 20,
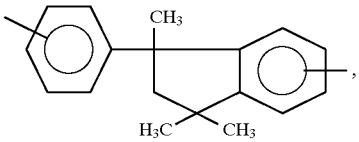
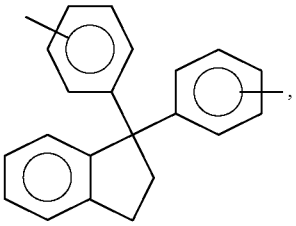
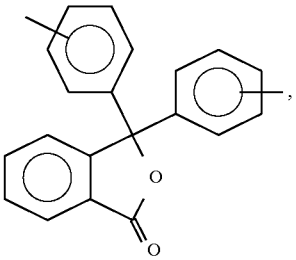
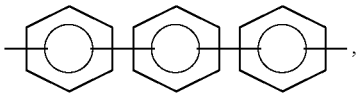
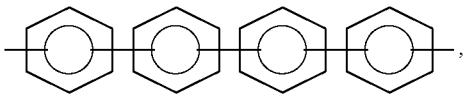
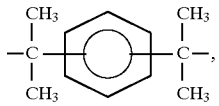
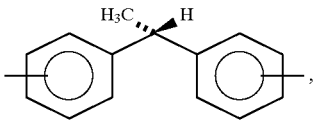
or
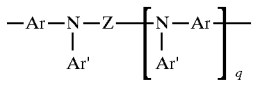

wherein (1) Z is
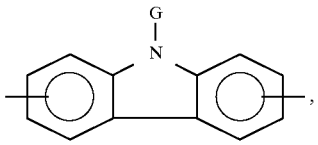
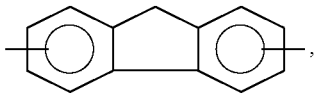
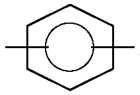
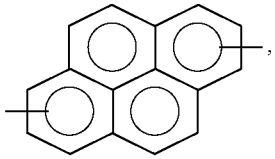
or
$-Ar-(X)_p-Ar-$
wherein p is 0 or 1; (2) Ar is
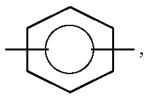
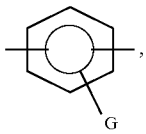
or
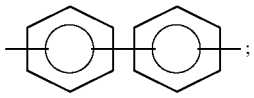
(3) G is an alkyl group selected from alkyl or isoalkyl groups containing from about 2 to about 10 carbon atoms; (4) Ar' is
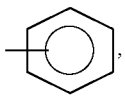
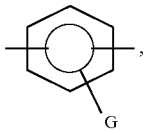
or
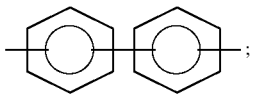
(5) X is
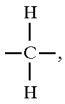
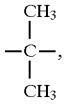
$-O-$,
$-S-$,
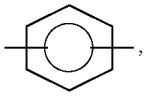
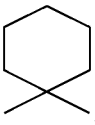
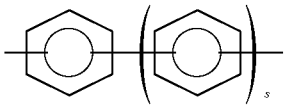
wherein s is 0, 1, or 2,
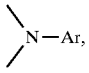
or
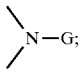
and (6) q is 0 or 1; or mixtures thereof, wherein at least some of the "B" groups are of the formula
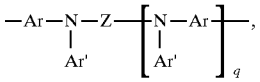
C is
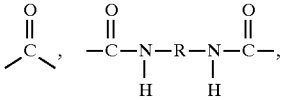
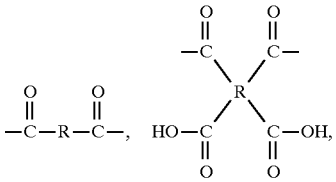

-continued
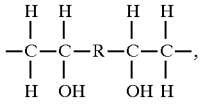
or mixtures thereof, wherein R is an alkyl group, an aryl group, an arylalkyl group, or mixtures thereof, and m and n are integers representing the number of repeating units.
13. An imaging member according to claim 1 wherein the B group is
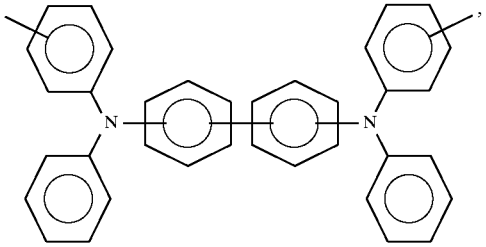
-continued
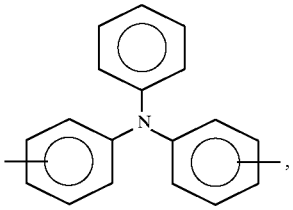
or
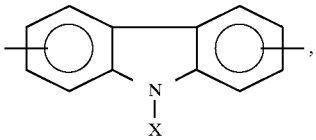
wherein X is an alkyl group, an aryl group, an arylalkyl group, a hydroxy group, or a halogen atom.
* * * * *